US007517175B2

(12) United States Patent
Timmerman

(10) Patent No.: US 7,517,175 B2
(45) Date of Patent: Apr. 14, 2009

(54) METHOD FOR MAINTAINING SEAWALLS

(76) Inventor: James E. Timmerman, 831 Perrine Ct., Marco Island, FL (US) 34145

( * ) Notice: Subject to any disclaimer, the term of this patent is extended or adjusted under 35 U.S.C. 154(b) by 296 days.

(21) Appl. No.: 11/156,847

(22) Filed: Jun. 20, 2005

(65) Prior Publication Data

US 2005/0232700 A1 Oct. 20, 2005

Related U.S. Application Data

(63) Continuation-in-part of application No. 10/617,206, filed on Jul. 11, 2003, now Pat. No. 6,908,258.

(51) Int. Cl.
*E02D 29/02* (2006.01)

(52) U.S. Cl. ..... 405/262; 405/284

(58) Field of Classification Search ..... 405/262, 405/284, 285, 286, 259.1
See application file for complete search history.

(56) References Cited

U.S. PATENT DOCUMENTS

| | | | | |
|---|---|---|---|---|
| 1,270,659 | A | | 6/1918 | Ravier |
| 1,876,720 | A | | 9/1932 | Merrill |
| 3,371,494 | A | | 3/1968 | Lagerstrom |
| 3,490,242 | A | | 1/1970 | Schnabel, Jr. |
| 3,541,798 | A | * | 11/1970 | Schnabel, Jr. ..... 405/262 |
| 3,802,204 | A | | 4/1974 | Mason |
| 3,815,368 | A | | 6/1974 | Turzillo |
| RE28,977 | E | | 9/1976 | Mason |
| 3,999,398 | A | | 12/1976 | Kurose |
| 4,036,026 | A | | 7/1977 | Asayama |
| 4,069,677 | A | | 1/1978 | Yamada et al. |
| 4,124,983 | A | | 11/1978 | Weatherby |
| 4,132,498 | A | | 1/1979 | Ikeda et al. |
| 4,189,891 | A | | 2/1980 | Johnson et al. |
| 4,253,781 | A | | 3/1981 | Fischer et al. |
| 4,480,945 | A | | 11/1984 | Schnabel, Jr. |
| 4,499,698 | A | * | 2/1985 | Hoyt et al. ..... 52/157 |
| 4,674,921 | A | | 6/1987 | Berger |

(Continued)

FOREIGN PATENT DOCUMENTS

| | | |
|---|---|---|
| JP | 08028045 | 1/1996 |

OTHER PUBLICATIONS

Chance® Company website print-out, 3 pages, Jul. 29, 2002.

(Continued)

*Primary Examiner*—Sunil Singh

(57) ABSTRACT

Apparatus for maintenance of a seawall comprises a plurality of anchoring members for being introduced through the seawall, a single retaining member for being secured on ends of the anchoring members which extend from a water facing side of the seawall, and a plurality of securing members for securing the retaining member on the ends of the anchoring members to tension the anchoring members and apply compressive force against the seawall. Another apparatus for maintenance of a seawall includes a retaining member having a rearward face beyond which the securing member and the end of the anchoring member do not protrude when installed on a seawall. An anchoring device installation system and method involves the use of a rail fixated to a floor at the bottom of a body of water on the water facing side of the seawall to guide formation of a passage in the seawall and the introduction of an anchoring member through the passage at preselected vertical and lateral angles.

17 Claims, 27 Drawing Sheets

U.S. PATENT DOCUMENTS 4,711,604 A * 12/1987 Heimsoth et al. ..... 405/259.5
4,728,225 A 3/1988 Brandt et al.
4,911,582 A 3/1990 Peirce, Jr. et al.
4,970,835 A 11/1990 Harmon
5,011,366 A 4/1991 Miller
5,120,163 A 6/1992 Holdeman et al.
5,139,368 A 8/1992 Hamilton et al.
5,171,107 A 12/1992 Hamilton et al.
5,213,448 A 5/1993 Seider et al.
5,580,191 A 12/1996 Egan
5,927,905 A 7/1999 van Halteren
5,971,669 A 10/1999 Crigler

OTHER PUBLICATIONS

Foresight Products, LLC website print-out, 12 pages, Sep. 18, 2002.

* cited by examiner

METHOD FOR MAINTAINING SEAWALLS

CROSS-REFERENCE TO RELATED PATENT APPLICATION

This application is a continuation-in-part of prior U.S. patent application Ser. No. 10/617,206 filed Jul. 11, 2003, now U.S. Pat. No. 6,908,258 the entire disclosure of which is incorporated herein by reference.

BACKGROUND OF THE INVENTION

1. Field of the Invention

The present invention relates generally to the maintenance of seawalls disposed between bodies of water and retained earth and, more particularly, to methods, systems and apparatus for maintaining seawalls using anchoring devices to strengthen the seawalls to resist potential damage and/or repair actual damage in the seawalls.

2. Discussion of the Related Art

Seawalls are commonly installed between bodies of water and earth to provide physical boundaries between the bodies of water and the earth and to support or retain the earth by resisting the pressure of the retained earth against the seawalls. Seawalls can be used to separate earth from various types of bodies of water of various sizes and depths. Seawalls can be constructed in various ways and of various materials. Typically, seawalls have a vertical span or height sufficient for an upper end of the seawall to normally extend above the water with a lower end or toe portion of the seawall embedded in the earthen floor to extend below the body of water. The distance that a seawall extends above the water may vary depending on the height of the retained earth above the water and/or anticipated fluctuations in water level. The depth to which the embedded toe portion extends below the water into the earthen floor may vary in accordance with the vertical span of the seawall, the height of the retained earth and/or the depth of the body of water to provide sufficient support for the seawall to resist movement from the pressure of the retained earth against the seawall. Accordingly, seawalls are usually designed for a particular depth body of water. The thickness of seawalls may vary depending on site-specific loads and other engineering parameters. One representative type of seawall comprises concrete panels about ten to fifteen feet high, about four feet wide and about four to ten inches thick disposed in side by side abutment to form a continuous wall. Oftentimes vertical pilings are installed in the water close to the water facing side of a seawall at spaced locations along the seawall, with lower ends of the pilings being driven into the earthen floor and upper ends of the pilings typically extending above the water. The pilings are sometimes installed as part of the original seawall installation.

Since the retained earth exerts greater pressure against seawalls than the pressure exerted against the seawalls by the water, seawalls are oftentimes damaged or destabilized during their lifetimes as evidenced, for example, by movement, displacement, shifting, cracking and/or misalignment of the seawalls. Sometimes seawalls are placed at risk for damage or instability due to a change in conditions occurring subsequent to installation of the seawalls. For instance, a body of water may be dredged and/or erosion of the earthen floor may occur subsequent to installation of a seawall, resulting in a greater depth body of water and a lesser depth of penetration for the toe portion of the seawall into the earthen floor. The lesser depth of penetration for the toe portion into the earthen floor may no longer be sufficient for the seawall to support the pressure of the retained earth such that the seawall is susceptible to damage or instability. In some cases, the height of the retained earth on the earth facing side of an existing seawall may be increased, causing increased pressure of retained earth against the seawall by which the seawall may be damaged or destabilized. A type of damage known as "toe out" may occur in seawalls where the toe portion shifts or displaces outwardly in a direction away from the retained earth due to the toe portion being insufficiently embedded in the earthen floor. In addition to the pressures of retained earth, seawalls may be damaged or destabilized directly or indirectly due to other conditions including collisions or other impacts, corrosion, environmental factors, and age. Since removal and replacement of damaged and/or unstable seawalls involves significant cost and disruption, it is preferable to strengthen existing seawalls to repair and/or avoid damage or instability.

One traditional method for arresting movement of seawalls involves installing vertical pilings in the water close to the water facing side of a seawall by driving lower ends of the pilings into the earthen floor. Depending on how close the pilings are to the seawall, cement bags may be packed between the pilings and the seawall to resist seawall movement. Sometimes vertical pilings are installed to shore up an undamaged portion of a seawall while repairs are made to another portion of the seawall that is in total failure. Another traditional method for arresting movement of seawalls entails the placement of riprap on the earthen floor adjacent the water facing side of a seawall. The latter methods are costly, obtrusive, and can initiate damage in other portions of the seawall. Where vertical pilings are used to shore up a portion of a seawall, installation of the pilings can cause portions of the seawall farther down to fail in a "domino" effect.

It has been proposed to strengthen seawalls to resist movement using anchors or tie rods in conjunction with cementitious material as represented by U.S. Pat. No. 1,270,659 to Ravier, U.S. Pat. No. 4,480,945 to Schnabel, Jr., U.S. Pat. No. 4,711,604 to Heimsoth et al., and U.S. Pat. No. 4,728,225 to Brandl et al. Heimsoth et al also discloses an installation system for drilling a passage through the seawall and installing the anchor through the passage from the water facing side of the seawall. However, the installation system of Heimsoth et al requires heavy equipment necessitating major cost and effort to transport and assemble, and requires that heavy equipment be placed on land on the earth facing side of the seawall. U.S. Pat. No. 3,371,494 to Lagerstrom, U.S. Pat. No. 4,253,781 to Fischer et al., and U.S. Pat. No. 4,911,582 to Pierce, Jr. et al. disclose the use of anchors or tie rods in conjunction with cementitious material to restrain structural walls other than seawalls. Helical anchors for building constructions are represented by U.S. Pat. No. 4,499,698 to Hoyt et al., U.S. Pat. No. 5,011,366 to Hamilton, et al., U.S. Pat. No. 5,120,163 to Holdeman et al., U.S. Pat. No. 5,139,368 and No. 5,171,107 to Hamilton et al., U.S. Pat. No. 5,213,448 to Seider et al., and U.S. Pat. No. 5,927,905 to van Halteren. U.S. Pat. No. 3,999,398 to Kurose discloses the use of anchor bolts in the installation of new retaining walls, but does not pertain to the stabilization of existing retaining walls or seawalls.

Prior apparatus and methods for repairing and/or strengthening seawalls and other retaining walls have various disadvantages including complicated structure and installation steps, major disruption, the need for excavating and/or disturbing the earth, the need to bring heavy machinery onto property on the earth facing side of the seawall, lengthy regulatory permitting requirements, partial or complete demolition of existing walls, the need to temporarily hold back or contain water during installation, the need to install additional and/or replacement wall structure, substantial duration of time from start to completion of work, the use of cementitious material to assist in anchoring, the need for backfill, and the inability to execute seawall stabilization from the water side of the seawall. Prior apparatus and methods which require substantial earth-side access or earth-side excavation are untenable where homes, other structures such as docks and pools, and/or landscaping are situated close to seawalls, making it undesirable and even prohibitive to disturb the earth or bring heavy equipment onto the land on the earth facing side of the seawall and/or to conduct seawall maintenance from the earth facing side. Prior attempts at stabilizing seawalls have failed to provide an integrated system of components to accomplish stabilization of various types of seawalls quickly, efficiently and economically from the water side of the seawall. Prior apparatus for repairing and/or strengthening seawalls and other retaining walls are essentially static and non-adjustable, and the use of cementitious material generally prevents adjustability in response to dynamic changes in the walls. Prior apparatus for repairing and/or strengthening seawalls and other retaining walls are essentially permanent and non-removable, especially where cementitious material is utilized. Prior apparatus for repairing seawalls and other retaining walls are in general unsuitable for monitoring changes occurring in the walls over time. Many prior apparatus and methods for repairing seawalls are environmentally incompatible and result in significant obstruction of or intrusion into the body of water on the water facing side of the seawall. Prior apparatus and methods for repairing and/or strengthening seawalls and other retaining walls using anchors or tie rods generally lack the ability to rigidly interconnect a plurality of spaced anchors or tie rods installed in a wall to maintain the spacing between the anchors or tie rods in a desired direction. Furthermore, prior apparatus and methods for repairing and/or maintaining seawalls and other retaining walls using anchors or tie rods do not allow a plurality of spaced anchors or tie rods installed in a wall to be adjustably interconnected to adjust the spacing between the anchors or tie rods. Prior apparatus and methods for repairing and/or strengthening seawalls and other retaining walls do not contemplate closing openings in the walls by adjustably moving the walls between interconnected anchors or tie rods installed in the walls on opposite sides of the openings.

SUMMARY OF THE INVENTION

The present invention is generally characterized in a method for maintenance of a seawall installed in use between a body of water on a water facing side of the seawall and retained earth on an earth facing side of the seawall. A passage is formed in the seawall from the water facing side of the seawall, and a forward end of an anchoring member is inserted in the passage from the water facing side. The anchoring member is advanced through the passage and into the retained earth to place an anchor of the anchoring member in the retained earth while a rearward end of the anchoring member extends from the passage along the water facing side of the seawall. As the anchoring member is advanced, a central longitudinal axis of the anchoring member is maintained at preselected vertical and lateral angles to the seawall. The retained earth is contacted with the anchoring member as it is advanced such that the anchoring member penetrates the retained earth and a portion of the anchoring member extending into the retained earth from the earth facing side of the seawall is embedded in the earth. The anchor of the anchoring member is anchored in the retained earth at a distance spaced from the earth facing side of the seawall. A retaining member is secured on the rearward end of the anchoring member extending from the passage along the water facing side of the seawall. Securing the retaining member on the rearward end of the anchoring member involves tensioning the anchoring member between the anchor and the retaining member and compressing the seawall and the retained earth between the anchor and the retaining member to resist displacement of the seawall due to pressure of the retained earth. The anchoring member and retaining member are left in place on the seawall.

The present invention is further generally characterized in a method for maintenance of a seawall located between a body of water on a water facing side of the seawall and retained earth on an earth facing side of the seawall, with there being a floor at the bottom of the body of water on the water facing side of the seawall. The method involves securing a forward rail support to forward rail support fixation structure that is secured to the floor so that the forward rail support is fixated at a selected location in front of the water facing side of the seawall. A forward end of an elongate rail is supported on the forward rail support and a rearward end of the rail is supported so that an installation axis, along which a drive shaft of an installation machine moves longitudinally when the installation machine is moved along the rail, intersects the water facing side of the seawall at a selected location and at preselected vertical and lateral angles to the seawall. The installation machine is moved along the rail toward the water facing side of the seawall, and a drill bit coupled with the drive shaft is moved coaxially along the installation axis toward the water facing side of the seawall. The drive shaft is rotated to rotate the drill bit to core a passage through the seawall coaxial with the installation axis. After the drill bit is withdrawn from the passage, a rearward end of an anchoring member is coupled coaxially with the drive shaft. The installation machine is again moved along the rail toward the water facing side of the seawall to move the anchoring member into the passage coaxial with the installation axis. The drive shaft is rotated to rotate the anchoring member into the retained earth to embed an anchor of the anchoring member in the earth. The drive shaft is uncoupled from a rearward end of the anchoring member which extends from the passage on the water facing side of the seawall. A retaining member is secured on the rearward end of the anchoring member to tension the anchoring member and apply compressive force against the seawall to resist displacement of the seawall. The anchoring member and retaining member are left in place on the seawall.

An additional characterization of the present invention is in an apparatus for maintenance of a seawall, the apparatus comprising an anchoring member, a retaining member and a securing member. The anchoring member includes a shaft for introduction through the seawall and having a forward end and a rearward end, and an anchor carried on the shaft. The shaft is of sufficient length for the anchor to be embedded in the earth on an earth facing side of the seawall with the rearward end of the shaft extending from a water facing side of the seawall. The retaining member has a hole for receiving the rearward end of the anchoring member therethrough, and the securing member secures the retaining member on the shaft so that a forward abutment surface of the retaining member applies compressive force against the seawall to resist displacement of the seawall. The retaining member has a rearward face opposite the forward abutment surface and beyond which the securing member and the rearward end of the shaft do not protrude when the retaining member is secured on the shaft by the securing member to apply the compressive force to resist displacement of the seawall.

The present invention is also characterized in an anchoring device installation system generally comprising an installation machine, a rail for guiding movement of the installation machine toward and away from the seawall on its water facing side, a forward rail support assembly for supporting a forward end of the rail and a rearward rail support assembly for supporting a rearward end of the rail so that the rail is at the proper orientation to guide the installation machine to form a passage in the seawall for installation of an anchoring member through the passage at selected vertical and lateral angles. The installation machine comprises a wheeled carriage for riding along a track of the rail and carrying a motor having a rotatable drive shaft coaxial with an installation axis along which the drive shaft moves longitudinally when the carriage is moved longitudinally along the track of the rail. The installation system may include a pushing device for pushing the installation machine with an appropriate amount of force or pressure toward the water facing side of the seawall. The forward rail support assembly and/or the rearward rail support assembly is/are used to position the rail so that the installation machine is guided to form the passage through the seawall to originate at a selected location on the water facing side of the seawall, to obtain a selected downward, neutral, or upward vertical angle for the anchoring member to be installed through the passage, and to obtain a selected left, neutral or right lateral angle for the anchoring member to be installed through the passage.

The forward rail support assembly comprises a forward rail support for supporting the forward end of the rail along the water facing side of the seawall, forward rail support fixation structure for being secured to a floor at the bottom of the body of water for fixating the forward rail support along the water facing side of the seawall, and a forward rail clamp for securing the forward end of the rail to the forward rail support. The forward rail support can comprise a forward horizontal support bar fixated by the forward rail support fixation structure to extend in a horizontal direction lengthwise along the water facing side of the seawall. The forward rail support fixation structure can comprise forward vertical support members having lower ends secured to the floor on the water facing side of the seawall and forward rail support clamps respectively securing opposite ends of the forward horizontal support bar to the forward vertical support members. The forward rail support can comprise a forward vertical support bar having a lower end secured to the floor. In the case of a vertical forward rail support, the forward rail support fixation structure can comprise a forward horizontal support bar, a forward rail support clamp clamping the forward horizontal support bar to the vertical forward rail support, and a pair of forward vertical support members respectively secured to opposite ends of the forward horizontal support bar with lower ends of the forward vertical support members being secured to the floor. The forward vertical support members can comprise vertical pilings already existing as part of or adjunct to the seawall. Alternatively, the forward vertical support members can comprise forward vertical support bars having their lower ends driven into or secured to the floor. The forward rail support assembly may further comprise a stabilizer for the forward rail support. In the case of a horizontal forward rail support, the stabilizer may comprise a vertical support bar having a lower end driven into or secured to the floor, and a stabilizer clamp clamping the vertical support bar of the stabilizer to the horizontal forward rail support between the forward vertical support members. In the case of a vertical forward rail support, the stabilizer can comprise a horizontal support bar having opposite ends respectively secured to vertical support members, and a stabilizer clamp clamping the horizontal support bar of the stabilizer to the vertical forward rail support.

The rearward rail support assembly comprises a rearward rail support for supporting the rearward end of the rail, rearward rail support fixation structure for fixating the rearward rail support and a rearward rail clamp for securing the rearward end of the rail to the rearward rail support. The rearward rail support assembly is disposed in its entirety on the water facing side of the seawall and requires no structural connection with the land or with equipment disposed on the land on the earth facing side of the seawall. The rearward rail support can comprise a rearward vertical support bar secured by the rearward rail clamp to the rearward end of the rail, and the rearward rail support fixation structure can comprise a lower end of the rearward vertical support bar driven into or secured to the floor. Alternatively, the rearward rail support can comprise a marine vessel on the body of water, and the rearward rail support fixation structure can comprise any structure for anchoring or fixing the position of the vessel. The rearward rail support could alternatively comprise a structure carried by a marine vessel in fixed position on the body of water, in which case the marine vessel may serve as part of the rearward rail support fixation structure. As another alternative, the rearward rail support may comprise a rearward horizontal support bar, and the rearward rail support fixation structure can comprise rearward vertical support bars having lower ends driven into or secured to the floor and rearward rail support clamps respectively securing opposite ends of the rearward horizontal support bar to the rearward vertical support bars.

Another aspect of the present invention comprises an apparatus for maintenance of a seawall where a single retaining member is secured to a plurality of anchoring devices using a plurality of securing members to tension the anchoring members and transmit compressive force against the seawall from the retaining member.

DESCRIPTION OF THE PREFERRED EMBODIMENTS

Figure 1A:
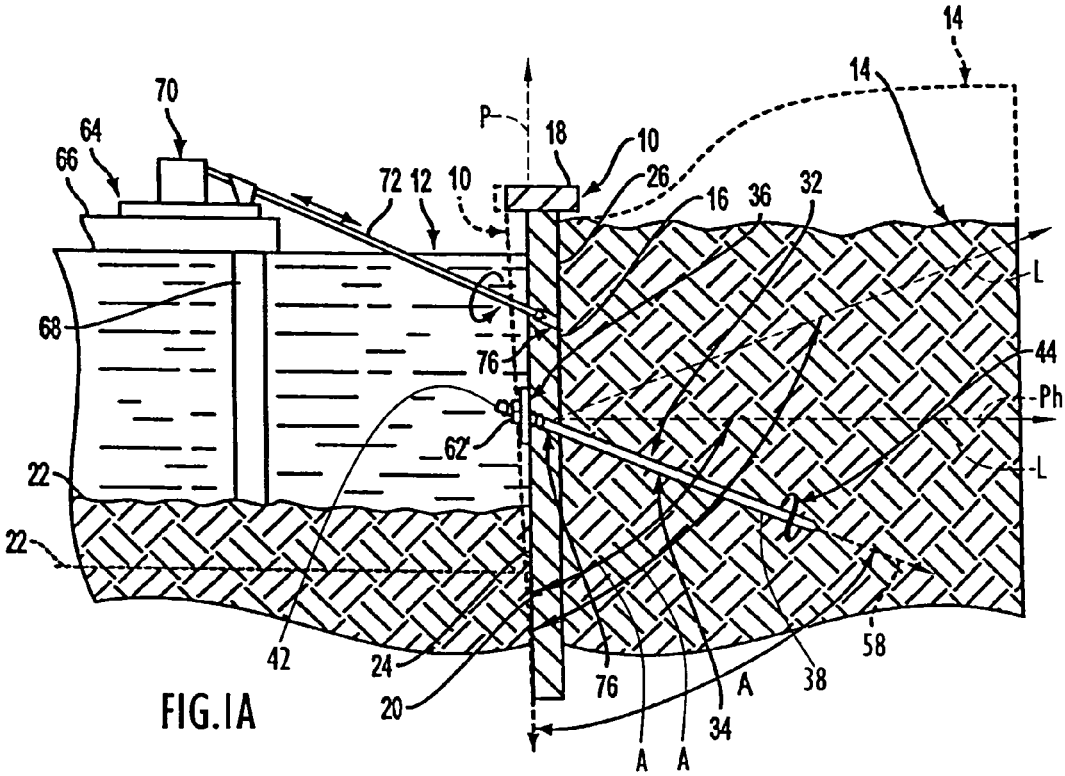
FIG. 1A is a broken side view, partly in section, illustrating a seawall, an anchoring device installed on the seawall, and a method of installing an anchoring device on the seawall.
Figure 1B:
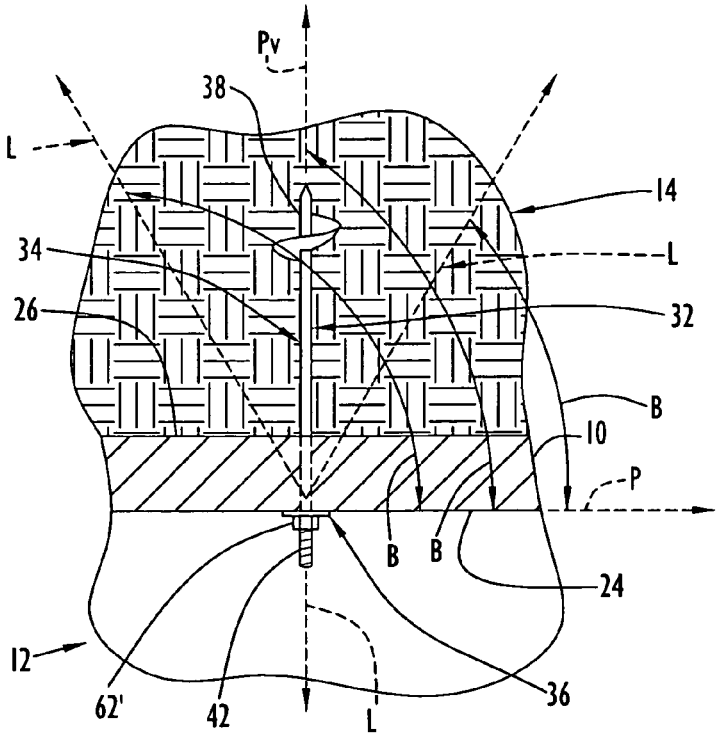
FIG. 1B is a broken top view, partly in section, of the anchoring device installed on the seawall of FIG. 1A.
Figure 5:
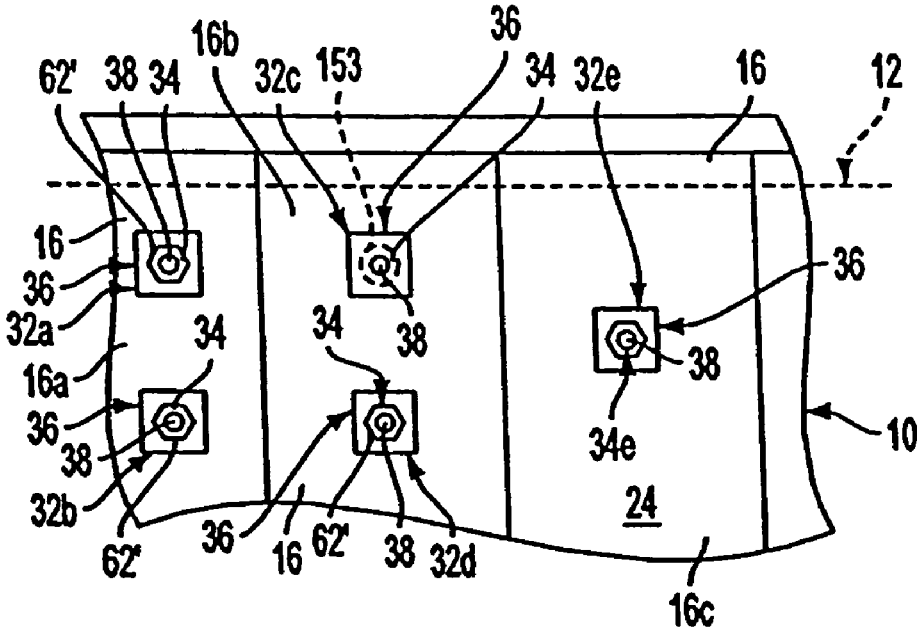
FIG. 5 is a broken plan view of the water facing side of the seawall of FIGS. 1A and 1B depicting one arrangement for a plurality of anchoring devices installed thereon.

FIGS. 1A, 1B and 5 illustrate a seawall or retaining wall 10 installed in use between a body of water 12 on a water facing side of the seawall and retained earth 14 on an earth facing side of the seawall. Seawall 10 comprises a plurality of seawall panels 16 in side by side abutment as shown in FIG. 5. Panels 16 are depicted as being planar with each panel having a height or span in the vertical direction, a width in the horizontal direction and a thickness perpendicular to the height and width. The width of each panel 16 extends between side edges of the panel, and the side edges of adjacent panels 16 may be in abutment as shown in FIG. 5 to form a continuous seawall 10 of any desired length corresponding to the cumulative width of the panels. The seawall 10 has an upper end, which may be finished with a cap or ledge 18, normally extending above the water 12, a lower end or toe portion 20 penetrating the earthen floor 22 to extend below the water 12, a water facing side 24 and an earth facing side 26. The distance that the upper end extends above water 12 will usually depend on the height of retained earth 14 above water 12 and/or anticipated fluctuations in the level of water 12, for example due to tides and/or storms. The toe portion 20 is typically driven into or otherwise embedded in the earthen floor 22 during installation of seawall 10, and the distance that the toe portion extends below the water 12 is typically selected in accordance with the depth of body of water 12, the height of retained earth 14, the height of seawall 10 and/or other site-specific conditions to support the seawall in an upright vertical orientation to resist the pressure of retained earth 14. As described below for seawall 410, vertical pilings may be installed adjacent or close to the water facing side 24 of seawall 10 at spaced locations or intervals along the length of the seawall.

In one representative seawall, the panels 16 are made of concrete and have a height of about ten to fifteen feet, a width of about four feet and a thickness of about four to ten inches. The seawall 10 can be constructed in various alternative ways including, for example, as bulkheads, pilings and/or piers, and of various materials including, for example, steel, wood, plastic/composite and concrete. The seawall 10 can have various dimensions. Body of water 12 may be any type of natural or artificially created body of water including, for example, oceans, harbors, bays, channels, sounds, canals, streams, reservoirs, rivers, lakes and ponds. Body of water 12 may have various constituents including salt and/or fresh water. The retained earth 14 may comprise one or more constituents including, for example, dirt, sand, rock and/or shells. One representative composition for retained earth 14 is an aggregate of sand and shell. Site-specific conditions may be determined using standard engineering tests and/or calculations, such as soil analysis, from which the force or pressure on seawall 10 from earth 14 can be determined mathematically or empirically.

The force or pressure exerted on seawall 10 by retained earth 14 is ordinarily greater than the force or pressure exerted on seawall 10 by body of water 12 such that the seawall may become damaged or unstable. Damage or instability of seawall 10 may be evidenced by movement, displacement or shifting of seawall 10 from its upright vertical orientation or other originally installed orientation, by openings in the seawall due to cracks in individual seawall panels 16 or separation of adjacent seawall panels 16, and/or by misalignment of seawall panels or cracked portions of panels. Various other conditions may contribute to or cause damage or instability in seawall 10 including collisions or other impacts with the seawall, corrosion and age. Changes in the water depth and/or the height of the retained earth subsequent to installation of the seawall 10 may also contribute to or cause seawall damage or instability. Where body of water 12 is deepened due to dredging and/or erosion of earthen floor 22 after construction of seawall 10, the increased depth of body of water 12 results in a reduced penetration depth for toe portion 20 into the earthen floor 22 as shown by dotted line 22 in FIG. 1A. Consequently, the seawall 10 may no longer be able to support or retain the retained earth 14 and may be increasingly susceptible to damage or instability. If the height of retained earth 14 is increased as shown by dotted line 14 in FIG. 1A, the increased pressure of retained earth exerted on seawall 10 may place the seawall at increased risk of damage or instability. In accordance with the present invention, seawall 10 is maintained by installing one or more anchoring devices to strengthen and repair the seawall where there is actual damage or instability in the seawall and/or to strengthen the seawall to resist potential damage or instability in the seawall from the pressure of earth 14 or other causes. Accordingly, maintenance of a seawall in accordance with the present invention is intended to encompass repair and/or strengthening of a seawall in cases of actual and potential damage or instability arising from the pressure of retained earth and/or other causes.

Figure 2:
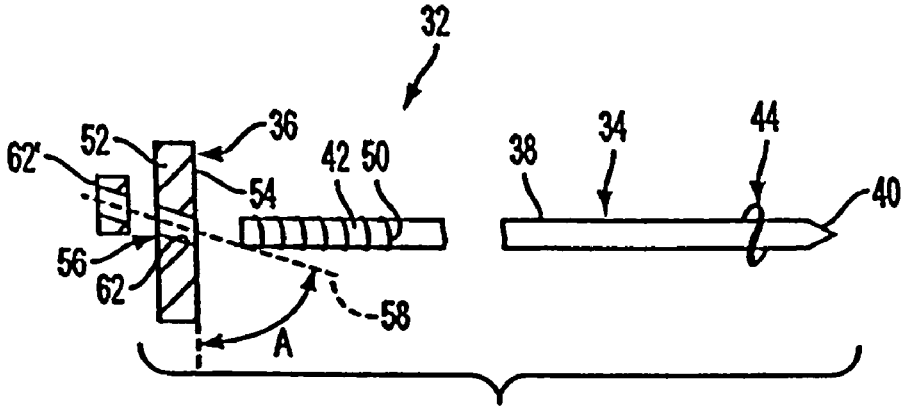
FIG. 2 is a broken, exploded side view of the anchoring device of FIGS. 1A and 1B.

An anchoring device 32 according to the present invention is illustrated in FIGS. 1A, 1B and 2 and comprises an anchoring member 34 and a retaining member 36. Anchoring member 34 includes an elongate shaft 38 having a forward end 40, a rearward end 42 and at least one anchor 44 carried on shaft 38. The shaft 38 is longitudinally straight and has a central longitudinal axis L. The shaft may have various uniform or non-uniform cross-sections to extend through a passage formed in seawall 10 as explained further below.

Shaft 38 is depicted with a circular cross-section that is uniform or constant along the length of the shaft; however, the cross-section of the shaft can be non-uniform or non-constant along its length. The anchor 44 may be carried on shaft 38 close to or along forward end 40 as shown in FIGS. 1A and 2, but may be disposed at various locations along the length of the shaft. More than one anchor 44 can be provided on shaft 38. The anchor 44 can have various configurations to anchor the anchoring member 34 in earth 14 and resist withdrawal of the anchoring member from the earth, and any type of earth anchor can be used for anchor 44. The anchor 44 is depicted as comprising a helical formation of sufficient external diameter to anchor the anchoring member 34 in earth 14 and resist withdrawal of the anchoring member from the earth. The configuration of the helical formation facilitates advancement of the anchoring member 34 in earth 14 via rotation and forward longitudinal movement of the anchoring member but resists withdrawal of the anchoring member from the earth. The forward end 40 may terminate at a taper, point or other configuration to facilitate advancement of the anchoring member 34 in earth 14 as described further below. The rearward end 42 may be provided with engagement structure 50 for engagement with securing structure of the anchoring device as described further below. The engagement structure may be designed in various ways, and the engagement structure 50 is depicted by way of example as an external thread along the rearward end 42 of the shaft 38. The anchoring member 34 may be made of various materials enabling the anchoring member to sustain preselected torque, compression and tensile forces. Representative materials include galvanized steel and stainless steel, preferably marine grade type 304 stainless steel. The anchoring member 34 can have various sizes and dimensions depending on site specific requirements. In one embodiment, the anchoring member 34 is about sixteen feet long with a shaft about one inch in diameter and a helical formation about six inches in diameter.

The retaining member 36 may be designed in various ways to be secured on the rearward end 42 of shaft 38 via securing structure formed separately from or as part of the retaining member. The retaining member 36 includes a flange 52 having a forward abutment surface 54 and a bore hole 56 extending through the flange at an angle to the abutment surface. The flange 52 is depicted as being planar with planar abutment surface 54 for abutment with the water facing side 24 of seawall 10. It should be appreciated, however, that the abutment surface 54 and/or the flange 52 can have various non-planar configurations and can have various perimetrical configurations including a square perimetrical configuration as shown in FIG. 5. The retaining member 36 can have one or more angled segments extending from flange 52 as described below for retaining member 436. The bore hole 56 may be centrally or non-centrally located in flange 52 and has a central longitudinal axis 58 disposed at an angle A with the abutment surface 54 as shown in FIG. 2. The bore hole 56 has a cross-sectional configuration and size to receive the rearward end 42 of the anchoring member 34 therethrough.

As an example of securing structure formed as part of the retaining member, the retaining member 36 can include securing structure 62 engageable with the engagement structure 50 of shaft 38 to secure the retaining member 36 on the shaft 38 in a desired longitudinal position along the length of the shaft 38. The securing structure 62 formed as part of the retaining member 36 can be designed in various ways and may comprise an internal thread along bore hole 56 threadedly engageable with the external thread forming the engagement structure 50 of shaft 38.

As an example of securing structure formed separately from the retaining member, the anchoring device 32 may comprise a securing member 62', having securing structure for engagement with the engagement structure 50 of shaft 38. The securing member 62' can be a nut having securing structure comprising an internal thread along a hole therethrough for threadedly engaging the external thread forming the engagement structure 50 of shaft 38 and having an external size preventing passage of the nut through the bore hole 56 of the retaining member. For ease of installation and adjustment, the securing member 62' may be preferable to the securing structure 62, in which case the retaining member 36 can be provided without securing structure 62.

When retaining member 36 is disposed on shaft 38 with the rearward end 42 extending through bore hole 56, the central longitudinal axis 58 of bore hole 56 and the central longitudinal axis L of anchoring member 34 are coaxial or substantially coaxial, and both axes 58 and L are disposed or substantially disposed at angle A with the plane P of abutment surface 54 as shown in FIG. 1A. Since the abutment surface 54 abuts the water facing side 24 of the seawall, plane P also corresponds to a plane of seawall 10 and its water facing side 24 as shown in FIGS. 1A and 1B. Angle A is depicted in FIG. 1A as an acute angle which corresponds to an acute angle selected for the central longitudinal axis L of anchoring member 34 with plane P of seawall 10 when the shaft 38 extends angularly downwardly through the thickness of the seawall 10 from the water facing side 24 to the earth facing side 26 as explained further below. However, as shown by dotted lines in FIG. 1A, the angle A between the central longitudinal axis L of anchoring member 34 and plane P could be a perpendicular or 90° angle such that axis L is contained in a horizontal plane Ph perpendicular to plane P, and the angle A could be an obtuse angle if it is desired for the shaft 38 to extend upwardly through the thickness of the seawall from the water facing side 24 to the earth facing side 26. As shown in FIG. 2, the central longitudinal axis of the hole through the securing member 62' may be coaxial with axis 58 so that the hole through the securing member 62' is disposed at angle A to a forward face of the securing member 62'. The retaining member 36 and securing member 62' may be made of any suitable materials including galvanized and stainless steels, and preferably marine grade type 304 stainless steel.

In most cases, the bore hole 56 will be arranged in flange 52 as shown in FIG. 1B so that the central longitudinal axis L of the anchoring member 34 extending through the bore hole is contained in a vertical plane Pv perpendicular to planes P and Ph. In this arrangement, the central longitudinal axis L of the anchoring member 34 is at a perpendicular or 90° angle B to the plane P of the seawall. However, it may be desirable in some cases for the anchoring member 34 and its central longitudinal axis L to be disposed at an angle to plane Pv, such as where the anchoring member must avoid an obstacle in earth 14. It should be appreciated, therefore, that the bore hole 56 can be arranged in flange 52 so that the axis L of the anchoring member 34 can be disposed at a preselected acute angle B to plane P or at a preselected obtuse angle B to plane P as shown in dotted lines in FIG. 1B. Angles A and B are explained further below.

A method for maintaining seawall 10 using anchoring device 32 may be performed from body of water 12 without the need for excavating or disturbing retained earth 14 or earthen floor 22 and without the need for earth-side access to seawall 10. As shown in FIG. 1A, the method can be conducted from a vessel 64, which may be a conventional spud barge having a platform 66 which floats upon the body of water 12 and spuds 68 (only one of which is shown) selectively extendable for lowering from platform 66 onto the earthen floor 22 whereby the platform 66 is maintained at a location relative to the water facing side 24 of seawall 10 suitable to conduct the seawall maintenance. Of course, various types of traditional marine anchors can be used to fix the position of the vessel 64. The vessel 64 may be towed to the selected location by a tugboat or may be self-powered to the selected location. The vessel 64 serves as a workstation for equipment, materials and personnel. The spuds 68 may be raised and lowered using winches.

An installation machine 70 is supported on vessel 64 and includes a rotatable drive shaft 72 that is movable forwardly and rearwardly in a longitudinal or axial direction for the drive shaft as shown by arrows in FIG. 1A. Forward and rearward longitudinal movement of the drive shaft 72 is along an installation axis coaxial with the central longitudinal axis of the drive shaft. The installation machine 70 may include a directional drilling or boring machine in which the drive shaft 72 is capable of being positioned or extended longitudinally at various angles to the seawall 10. A drill bit is carried by a forward end of drive shaft 72 and may be removably coupled or connected coaxially to the forward end of drive shaft 72 in any suitable manner. Various couplings or connectors may be provided for removably coupling or connecting the drive shaft 72 to the anchoring member 34 in coaxial relation or alignment, and the drive shaft 72 may also be removably coupleable or connectable with the retaining member 36 and/or the securing member 62' using suitable couplings or connectors. Additional machinery and/or tools may be carried by vessel 64 as needed to conduct seawall maintenance pursuant to the present invention. The installation machine 70 also includes suitable instruments or gauges for measuring tension, compression and torque, or such instruments or gauges may be separate from the installation machine.

In accordance with a method of the present invention, the drive shaft 72 carrying the drill bit is positioned so that the installation axis is at a preselected angle A to plane P of seawall 10 and at a preselected angle B to plane P. Positioning the installation axis at the preselected angle A involves moving the drive shaft vertically upwardly or downwardly as needed in a vertical plane perpendicular or transverse to plane P. Positioning the installation axis at the preselected angle B involves moving the drive shaft laterally to the left or right as needed in a horizontal plane perpendicular or transverse to plane P. However, it should be appreciated that the installation axis does not have to be positioned at the preselected angles A and B using separate movements of the drive shaft in the vertical and horizontal planes in that the drive shaft can be moved using a single complex or compound movement. The drive shaft 72 is rotatably driven while being advanced or moved forwardly in a longitudinal or axial direction along the installation axis to form a passage 76 extending entirely through the thickness of seawall 10 from the water facing side 24 to the earth facing side 26 as shown in FIG. 1A. The passage 76 has a cross-sectional size to accommodate the anchoring member 34 extending therethrough and, accordingly, a drill bit of appropriate size is selected for formation of the passage 76. The drive shaft 72 is retracted or moved rearwardly in the longitudinal or axial direction along the installation axis for withdrawal from the seawall 10 upon completion of the passage 76 to the appropriate depth. Operation of the machine 70 to control rotation and axial or longitudinal advancement and retraction of the drive shaft 72 may be effected by an operator situated on the vessel 64. A central longitudinal axis of the passage 76 is disposed at the preselected angle A to the plane P of the seawall 10 and at the preselected angle B to the plane P so that the central longitudinal axis L of the anchoring member 34 installed coaxially through the passage will be disposed at the preselected angles A and B to the seawall. As shown in FIG. 1A for the anchoring member 34, angle A can be an acute angle where the anchoring member extends downwardly from the water facing side 24 to the earth facing side 26 of the seawall. Angle A may be in the range of about 70 to 80° so that the central longitudinal axis L of the anchoring member installed in passage 76 will extend at a downward vertical angle of about 10 to 20° from the horizontal plane Ph to provide a sufficient earth overburden on the anchoring member. However, other sizes and directions for angle A are possible depending on the vertical angle desired for the central longitudinal axis L of the anchoring member with the seawall including a neutral vertical angle where the central longitudinal axis L of the anchoring member will be contained in the horizontal plane Ph (angle A of 90°) and an upward vertical angle where the central longitudinal axis L of the anchoring member will extend upwardly from the water facing side 24 to the earth facing side 26 (obtuse angle A) as illustrated in dotted lines in FIG. 1A for the anchoring member 34. Accordingly, the selection of angle A corresponds to the selection of a downward, neutral or upward vertical angle for the anchoring member installed through the passage. As shown by FIG. 1B, the passage 76 can be formed through seawall 10 so that the anchoring member 34 installed through the passage has its central longitudinal axis L contained in the vertical plane Pv and is disposed at a neutral lateral angle. It should be appreciated, however, that the passage 76 can be formed through the seawall 10 so that the anchoring member 34 installed through the passage will have its central longitudinal axis L disposed at a preselected lateral angle to either the left or right of vertical plane Pv as shown in dotted lines in FIG. 1B. In the case of a left lateral angle, the central longitudinal axis L would extend toward the left of plane Pv from the water facing side 24 to the earth facing side 26 of seawall 10 (obtuse angle B). In the case of a right lateral angle, the central longitudinal axis L would extend toward the right of plane Pv from the water facing side 24 to the earth facing side 26 (acute angle B). Accordingly, the selection of angle B corresponds to the selection of a left, neutral, or right lateral angle for the anchoring member installed through the passage. The actual sizes and directions of the vertical and lateral angles, the cross-sectional size of the passage 76 and the type and size of anchoring member 34 are predetermined or preselected in accordance with site-specific conditions, engineering tests and/or calculations.

Once the passage 76 has been formed in seawall 10, the drive shaft 72 is coupled or connected with the shaft 38 of anchoring member 34 in coaxial relation or alignment. Coupling or connection of the drive shaft 72 with the shaft 38 may be performed above the water on or from the vessel 64. The drive shaft 72 having the anchoring member 34 coupled or connected thereto is coaxially aligned with the passage 76 so that the anchoring member is positioned at the preselected vertical and lateral angles to the seawall. The drive shaft 72 is again advanced in a longitudinal or axial direction coaxial with the installation axis to introduce the anchoring member 34, forward end 40 first, into and through the passage 76 from the water facing side 24 to the earth facing side 26 of the seawall 10. The drive shaft 72 is rotated while continuing to be advanced in the longitudinal or axial direction to rotate and advance the anchoring member 34 into the retained earth 14 while the rearward end 42 of the shaft 38 extends from the passage 76 along the water facing side 24 of seawall 10. The configuration of forward end 40 and anchor 44 of anchoring member 34 facilitate advancement of the anchoring member in earth 14. As it is advanced, the anchoring member 34 contacts the retained earth 14 such that the anchoring member penetrates and burrows through the retained earth. Accordingly, the portion of the anchoring member 34 extending into the retained earth from the earth facing side 26 of seawall 10 is embedded in the retained earth 14 without any intentionally created gap or space of significance between the anchoring member and the surrounding earth. The anchoring member 34 is advanced a preselected or predetermined distance into earth 14 such that anchor 44 is anchored and embedded in earth 14 at a preselected or predetermined distance from the earth facing side 26 of seawall 10. The configuration of anchor 44 embedded in earth 14 resists withdrawal of the anchoring member 34 from the earth 14, and the anchor 44 is anchored in the retained earth by virtue of being embedded in the retained earth. The shaft 38 of anchoring member 34 extends through the passage 76, and the rearward end 42 of shaft 38 extends from the passage 76 on the water facing side 24 of seawall 10. As shown in FIG. 1A, depending on the location for the anchoring member 34 along the height of seawall 10, the rearward end of shaft 38 may extend from the passage 76 into the body of water 12.

Figure 4:
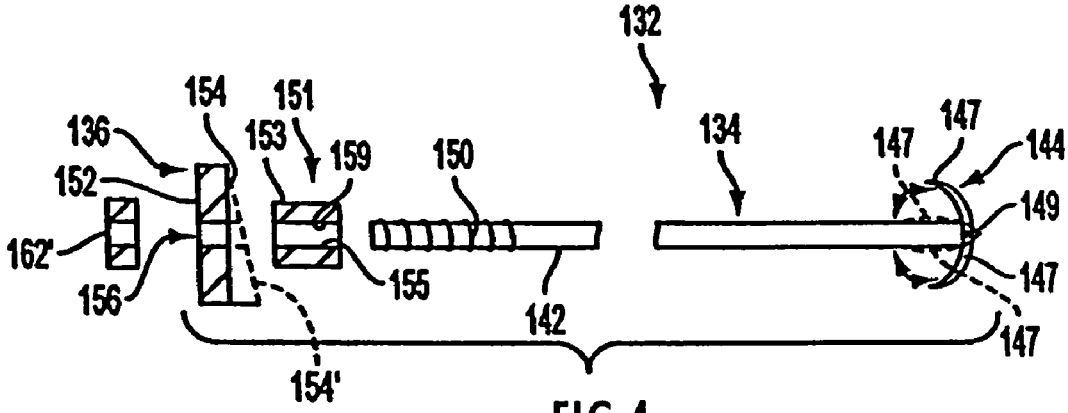
FIG. 4 is a broken, exploded side view of the alternative anchoring device of FIG. 3.

It should be appreciated that the anchoring member 34 can be introduced through the passage 76 with its central longitudinal axis L at the preselected vertical and lateral angles A and B without the central longitudinal axis of the passage being disposed at the preselected vertical and lateral angles to the seawall. Accordingly, the central longitudinal axis of the anchoring member does not have to be exactly coaxial with the passage through the seawall. The cross-sectional size of passage 76 may be made larger than necessary to accommodate the cross-section of shaft 38, and may be made large enough to accommodate the cross-section of anchor 44. Where the seawall 10 is made of a material capable of being cut or penetrated by anchor 44 being driven through the seawall, the cross-sectional size of passage 76 may be made no larger than necessary to accommodate the cross-section of shaft 38 extending therethrough. Depending on the material of seawall 10 and/or the material of anchoring member 34, the anchoring member 34 itself could be used to form the passage 76, thereby simplifying the equipment and steps required for installation of anchoring device 32. As described below, anchors may be used which have collapsed positions presenting a relatively small or narrow cross-section and expanded positions presenting a relatively large or wide cross-section, and the passage 76 may be made no larger than necessary to accommodate the cross-section of the anchor in the collapsed position. Where an annular, radial or other gap is presented in passage 76 around shaft 38 due to the cross-sectional size of the passage being larger than the cross-section of the shaft 38 extending therethrough, this gap can be filled with any suitable filler or plug as explained further below. Accordingly, the anchoring device 32 may further comprise a filler or plug, such as the plug member 153 described below and as shown in FIG. 4.

The retaining member 36 is secured on the rearward end 42 of shaft 38 along the water facing side 24 of seawall 10 with a predetermined torque to obtain a predetermined tension in anchoring member 34 and a predetermined compression against seawall 10 in an anchored position for the anchoring member. The rearward end 42 of shaft 38 extending from the passage along the water facing side of the seawall is inserted in the bore hole 56 of retaining member 36 with the forward abutment surface 54 of the retaining member facing the water facing side 24 of seawall 10. Where the retaining member 36 is provided with securing structure 62 comprising an internal thread and the shaft 38 is provided with engagement structure 50 comprising an external thread, the retaining member 36 is rotated relative to the shaft 38 in a first rotational direction with the external thread on the rearward end 42 in threaded engagement with the internal thread of bore hole 56. Rotation of the retaining member 36 on the shaft 38 in the first rotational direction causes forward advancement of the retaining member 36 longitudinally along the shaft 38 toward seawall 10. The retaining member 36 is rotated relative to the shaft 38 in the first rotational direction to a predetermined torque with the abutment surface 54 in abutment with the water facing side 24 of seawall 10 along plane P to obtain a predetermined tension in anchoring member 34 and a predetermined compression against seawall 10. The retaining member 36 is secured on the shaft 38 in the longitudinal position corresponding to the predetermined torque, compression and tension due to engagement of engagement structure 50 with the securing structure 62. The installation machine 70 may be used to rotate the retaining member 36 relative to and along the shaft 38.

Where the anchoring device 32 comprises the separate securing member 62', the rearward end 42 of shaft 38 is inserted in the bore hole 56, which may be provided without the securing structure 62, with the abutment surface 54 facing the water facing side 24. The retaining member 36 is advanced along the shaft 38 in the direction of the seawall, and the end 42 of shaft 38 extending rearwardly from the bore hole 56 is inserted in the hole of securing member 62' to threadedly engage the internal thread forming the securing structure of the securing member 62' with the external thread forming the engagement structure 50 of shaft 38. The securing member 62' is rotated in a first rotational direction to advance the securing member 62' forwardly along shaft 38 into compressive engagement with the retaining member 36. The securing member 62' is rotated to a predetermined torque with the abutment surface 54 of the retaining member 36 in abutment with the water facing side of seawall 10 to obtain a predetermined tension in anchoring member 34 and a predetermined compression against seawall 10. The securing member 62' and the retaining member 36 are secured on shaft 38 in longitudinal positions corresponding to the predetermined torque, compression and tension, the securing member 62' being held in place due to engagement of its securing structure with the engagement structure of shaft 38. The installation machine 70 may be used to advance the retaining member along the shaft and/or to rotate the securing member 62' on the shaft.

When the anchoring device 32 is installed on seawall 10, the seawall 10 and earth 14 between the retaining member 36 and anchor 44 are compressed, and the anchoring member 34 is tensioned between retaining member 36 and anchor 44 to strengthen seawall 10 to resist displacement of the seawall in the direction of water 12. The predetermined torque, compression and tension are selected in accordance with site-specific conditions, the type and/or size of anchoring member, and engineering specifications. The abutment surface 54 is in face to face abutment or contact with the water facing side 24 of seawall 10 along plane P, and the central longitudinal axis L of anchoring member 34 is disposed at the preselected vertical and lateral angles. In FIG. 1A, the central longitudinal axis L of the anchoring member 34 extends downwardly from the water facing side 24 to the earth facing side 26 and defines a downward vertical angle. In FIG. 1B, the central longitudinal axis L of the anchoring member 34 is contained in plane Pv and is thusly at a neutral lateral angle. Although plane P of the seawall is depicted as an upright vertical plane essentially perpendicular to the earthen floor 22, it should be appreciated that plane P does not have to be truly upright vertical or perpendicular to the earthen floor but, rather, could be canted toward or away from the body of water 12 due to being installed non-perpendicular to the earthen floor or due to displacement from an originally installed orientation.

The retaining member 36 can be secured on the shaft 38 at various positions along the length of the shaft 38. Where the retaining member 36 is provided with securing structure 62, the torque, compression and tension can be increased by further rotating the retaining member 36 relative to the shaft 38 in the first rotational direction, and the torque, compression and tension can be decreased by rotating the retaining member 36 relative to shaft 38 in a second rotational direction, opposite the first rotational direction, to cause retraction or rearward movement of the retaining member 36 longitudinally along the shaft 38 in a direction away from seawall 10. When the securing member 62' is used to secure the retaining member 36, the torque, compression and tension can be increased by further rotating the securing member 62' in the first rotational direction, and the torque, compression and tension can be decreased by rotating the securing member 62' in a second rotational direction, opposite the first rotational direction, to cause retraction or rearward movement of the securing member 62' longitudinally along the shaft 38 in the direction away from seawall 10. Accordingly, torque, compression and tension adjustments are possible in the anchoring devices of the present invention. The retaining member 36 and securing member 62' could be rotated, advanced and retracted via drive shaft 72 using appropriate connectors or couplings to releasably couple or connect the retaining member 36 and/or securing member 62' to the drive shaft 72. The retaining member 36 and securing member 62' can be secured on the anchoring member 34 using any other suitable machinery or tools operated and controlled from the vessel 64.

FIG. 1A depicts anchoring device 32 as a first anchoring device installed on seawall 10 at a first location and depicts drive shaft 72 in the process of drilling another passage 76 through seawall 10 for installation of another or second anchoring device to be installed on seawall 10 at a second location spaced laterally in the vertical direction above the first anchoring device 32. In FIGS. 1A and 1B, a portion of rearward end 42 of the installed anchoring device 32 protrudes from the securing member 62' on the water facing side 24 of seawall 10. If desired, this portion can be cut or trimmed following installation of anchoring device 32. However, it may be advantageous to allow a sufficient length of this portion to remain intact to facilitate torque, compression and/or tension adjustments of anchoring device 32 conducted following installation. The installed anchoring devices are nonetheless unobtrusive, and do not intrude on the body of water 12 to any significant degree. Following installation, the anchoring devices 32 can be periodically checked or inspected, and the torque, compression and/or tension can be increased or otherwise adjusted as needed to strengthen seawall 10, particularly in response to dynamic changes occurring in seawall 10 over time. Any of the anchoring devices 32 installed in the seawall 10 can be removed and replaced with the same or different anchoring members including anchoring members installed to new torque, compression and/or tension specifications. Anchoring members that are replaced may be replaced with anchoring members of greater length, greater anchor size and/or greater cross-sectional shaft size. Anchoring members that are removed and not replaced can be retained for future use. The anchoring devices 32 can be used to monitor for dynamic changes in seawall 10 potentially indicative of seawall instability. One way the anchoring devices 32 can be used to monitor for dynamic changes in the seawall is by providing a visually detectable indication of seawall displacement and/or anchoring device displacement. Another way the anchoring devices 32 can be used to monitor for dynamic changes in the seawall is by taking torque, tension and/or compression measurements of the anchoring devices and comparing them to previously measured values.

Where seawall 10 is not already damaged or unstable, one or more anchoring devices 32 may be installed on seawall 10 above and/or below the surface of water 12 to strengthen the seawall to resist potential damage or instability. One or more anchoring devices 32 can be installed on an undamaged portion of a seawall to provide shoring for the undamaged portion when another portion of the seawall has failed and/or undergoes major repair. Use of the anchoring devices to strengthen or shore up a portion of a seawall eliminates the need to drive vertical pilings into the earthen floor along the water facing side of the seawall and avoids the "domino" failure effect associated with the use of vertical pilings. The compressive force applied by the one or more anchoring devices 32 against the seawall via the intermediary of earth 14 enables the seawall to resist deviation from original design specifications, such as displacement from an upright vertical orientation or other originally installed orientation.

Where seawall 10 has already deviated from its original design specifications and experienced actual damage or instability, such as displacement from an upright vertical orientation or other originally installed orientation, one or more anchoring devices 32 installed above and/or below the surface of water 12 can be used to strengthen the seawall to prevent further damage or to reverse the actual deviation or damage. As an example, FIG. 1A depicts seawall 10 in solid lines in an originally installed upright vertical orientation and depicts seawall 10 in dotted lines displaced from its originally installed upright vertical orientation in the direction of water 12 due to the pressure of earth 14. Depending on the amount of displacement of seawall 10 from its original design specifications, sufficient compressive force may be applied against the seawall 10 by the installation of one or more anchoring devices 32 above and/or below the surface of water 12 to repair the seawall by moving it back to the originally installed orientation and to strengthen the seawall by resisting displacement from the upright vertical orientation. Accordingly, a seawall that has deviated from its original design specifications may be restored to its original design specifications upon the installation of one or more anchoring devices 32. More commonly, incremental adjustments made to the one or more anchoring devices periodically over time will be needed to restore a deviated seawall to its original design specifications. One or more anchoring devices 32 can be installed on seawall 10 to repair various types of damage and various stages of damage in seawall 10.

Where a plurality of anchoring devices 32 are installed on seawall 10, the preselected vertical angles for the anchoring members may be the same as or different from each other, and the preselected lateral angles for the anchoring members may be the same as or different from each other. Also, the torque, compression and tension for a plurality of installed anchoring devices 32 may be the same for all anchoring devices or different for some or all of the anchoring devices. Paint, epoxy and/or urethane may be applied to exposed surfaces following installation of one or more anchoring devices for added strength, protection and/or cosmetic enhancement.

Figure 3:
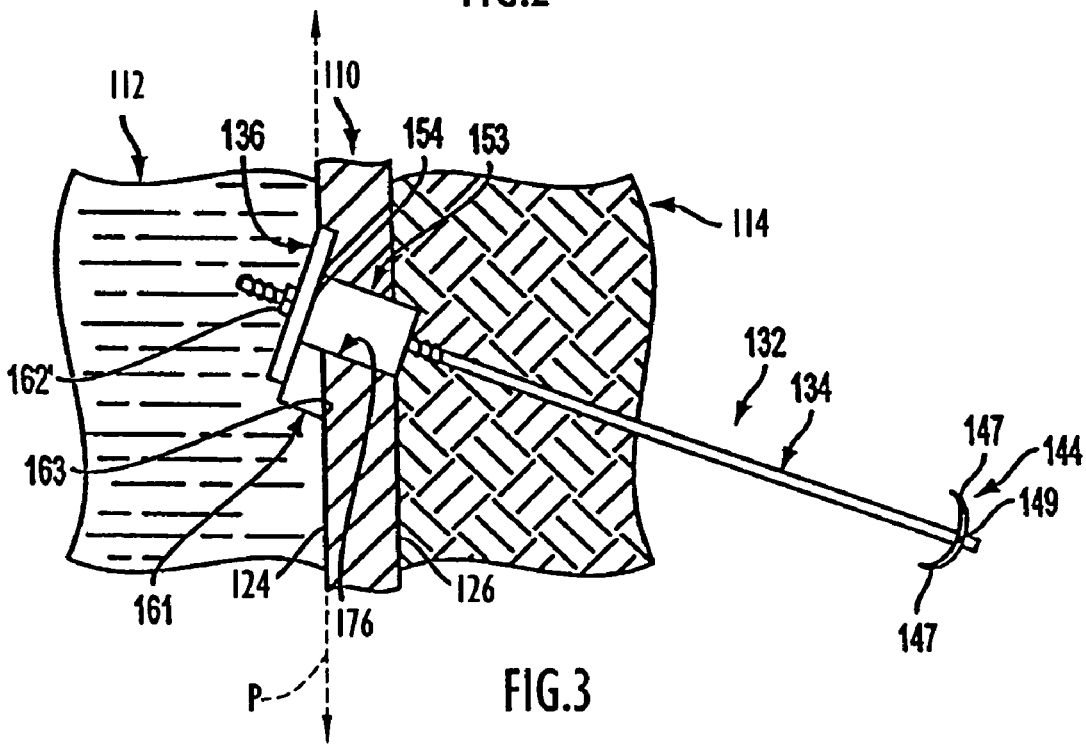
FIG. 3 is a broken side view, partly in section, depicting a seawall, an alternative anchoring device installed on the seawall, and a method of installing the alternative anchoring device on the seawall.

FIGS. 3 and 4 depict an alternative anchoring device 132, the anchoring device 132 being shown in FIG. 3 installed on a seawall 110 that is similar to seawall 10. Anchoring device 132 comprises anchoring member 134, retaining member 136 and filler or plug 151. Anchoring member 134 is similar to anchoring member 34 except that anchor 144 for anchoring member 134 has an arm formation including a plurality of arms 147 and has a collapsible/expandable formation. Arms 147 have ends pivotally mounted to shaft 138 at a pivot location 149 such that the arms 147 are pivotable relative to the shaft 138 about the pivot location. The arms 147 extend angularly outwardly from the shaft 138 in the rearward direction in an expanded position for anchor 144 shown in FIG. 3 and in solid lines in FIG. 4. In the expanded position, the anchor 144 presents a configuration to resist withdrawal of the anchoring member 134 from earth 114 and presents a relatively large or wide cross-sectional profile. The arms 147 are disposed alongside shaft 138 in a collapsed position for anchor 144 shown in dotted lines in FIG. 4 such that anchor 144 presents a configuration facilitating insertion and advancement of anchoring member 134 through the seawall 110 and into earth 114 during installation. In the collapsed position, anchor 144 presents a relatively small or narrow cross-sectional profile. The anchor 144 is disposed in the collapsed position while the anchoring member 134 is being passed through the seawall 110 and advanced in the earth 114, and the anchor 144 is moved to the expanded position to be embedded in the earth 114 upon the anchoring member 134 being advanced the appropriate distance. Various mechanical mechanisms can be provided for selectively moving the anchor 144 between the collapsed and expanded positions and/or for locking the anchor 144 in the expanded position. The anchor 144 is anchored in the retained earth by virtue of being moved to the expanded position and embedded in the retained earth. The retaining member 136 is similar to retaining member 36 except that the bore hole 156 through flange 152 of retaining member 136 is perpendicular to abutment surface 154. The bore hole 156 may be threaded for engagement with an external thread forming securing structure 150 of shaft 138 or may be without a thread. The anchoring device 132 may include a separate securing member 162' for securing the retaining member 136 on shaft 138 when the bore hole 156 is without a thread. The securing member 162' is similar to securing member 62' except that the threaded hole through securing member 162' is perpendicular to the forward face of the securing member 162'.

The filler or plug 151 comprises a plug member 153 formed by a cylindrical ferrule or sleeve having a lumen 155 extending axially therethrough. The lumen 155 has a cross-sectional diameter or size to receive the shaft 138 therethrough with a close fit. The plug member 153 has an external diameter or cross-sectional size to be disposed in passage 176 with an interference or close fit. The plug member 153 could be provided with engagement structure along lumen 155 for engaging the engagement structure 150 of shaft 138, and such engagement structure may comprise a thread 159 for threaded engagement with an external thread forming the engagement structure 150 on the rearward end of shaft 138.

Installation of anchoring device 132 on seawall 110 in a method of maintaining seawall 110 is similar to that described above for anchoring device 32. A passage 176 of appropriate size is formed through the thickness of seawall 110 for insertion of anchoring member 134 therethrough at the selected vertical and lateral angles with the anchor 144 maintained in the collapsed position. The anchoring member 134 is advanced into the retained earth 114 the appropriate distance and anchor 144 is moved from the collapsed position to the expanded position whereby the anchor 144 is embedded and anchored in the retained earth 114 to resist withdrawal of anchoring member 134. The filler or plug 151 is used to fill the annular or radial gap or space present in passage 176 around the shaft 138 extending therethrough. Accordingly, the plug member 153 is positioned on the rearward end 142 of shaft 138 which extends from the passage 176 along the water facing side 124 of seawall 110 as accomplished by inserting the rearward end 142 in the lumen 155. The plug member 153 is advanced longitudinally along the shaft 138 in the direction of seawall 110 so that the plug member enters passage 176 with an interference or close fit and thereby fills the gap or space around shaft 138. The plug member 153 also supports and centers the shaft 138 in the passage 176. Where the plug member 153 is provided with an internal thread 159, the plug member is advanced by being rotated relative to the shaft 138 in a first rotational direction. The longitudinal position of the plug member 153 along the shaft 138 may be maintained due to the interference fit and/or threaded engagement of the external thread on shaft 138 with the internal thread 159. The drive shaft 72 of machine 70 or any other suitable machinery and/or tools can be used to position and advance the plug member 153 on the shaft 138 from vessel 64. The plug member 153 may be retracted or moved rearwardly along the shaft 138 for longitudinal adjustment and, where the plug member is provided with internal thread 159, it may be rotated on shaft 138 in a second rotational direction, opposite the first rotational direction, to cause longitudinal rearward movement of the plug member along the shaft 138 in a direction away from seawall 110. The plug member 153 may be removed entirely from passage 176 and may be removed entirely from shaft 138. The plug member 153 may be made of any suitable material including plastic, galvanized steel and stainless steel. Although filler or plug 151 is depicted as a definitive structural component, it should be appreciated that the filler or plug may comprise any suitable filler material with or without a definitive structural shape.

The retaining member 136 is secured on the portion of rearward end 142 which protrudes from plug member 153 and the passage 176 on the water facing side of seawall 110 and is used to establish tension in anchoring member 134 and compression against seawall 110 as described above for retaining member 36. Tension in anchoring member 134 and compression against seawall 110 may be established using securing member 162' as described for securing member 62'. Since the bore hole 156 of retaining member 136 is perpendicular to abutment surface 154, the abutment surface 154 is at an angle to the water facing side 124 of seawall 110 due to the downward vertical angle of passage 176. Accordingly, the abutment surface 154 is not in face to face abutment with the water facing side 124, and there is a space presented between the abutment surface 154 and the water facing side 124. As shown in FIG. 3, the anchoring device 132 further comprises an insert 161 for being disposed in the space between the abutment surface 154 and the water facing side 124 to transmit force against the seawall 110 from retaining member 136. Insert 161 may have any geometric configuration needed to distribute the force of retaining member 136 against the water facing side 124. In the case of anchoring device 132, the insert 161 has a wedge shaped configuration for being disposed in the angular space presented between abutment surface 154 and water facing side 124, with an abutment surface 163 of the insert facing the water facing side 124. During installation, the retaining member 136 is advanced along shaft 138 with the insert 161 interposed between abutment surface 154 and water facing side 124. The retaining member 136 is advanced along shaft 138 into abutment with the insert 161, which in turn abuts the water facing side 124 via abutment surface 163 along plane P and applies compressive force against the seawall as explained above for retaining member 36.

Anchoring device 32 thusly is representative of an anchoring device in which the abutment surface of the anchoring device in contact with the water facing side of the seawall is formed in its entirety by the abutment surface of the retaining member. Anchoring device 132 is representative of an anchoring device in which the abutment surface of the anchoring device in contact with the water facing side of the seawall is formed in part by the abutment surface of the retaining member and in part by an abutment surface of an insert interposed between the retaining member and the water facing side. It should be appreciated that in the anchoring device 132, the abutment surface 154 of retaining member 136 itself can be designed with a configuration 154' corresponding to the configuration resulting from the combination of abutment surfaces 154 and 163 as shown in dotted lines in FIG. 4 so that insert 161 may be eliminated. Accordingly, the abutment surfaces of the anchoring devices which apply force against the seawall may be formed partly or entirely by the abutment surfaces of the retaining members and may be formed partly or entirely by the abutment surfaces of the inserts. The insert 161 can be designed in various ways as one or more parts or materials and may comprise various shoring or shim members.

FIG. 5 illustrates one of many possible arrangements for one or more anchoring devices installed on seawall 10. FIG. 5 depicts a plurality of adjacent seawall panels 16*a*, 16*b* and 16*c* each having one or more anchoring devices installed thereon. Although one or more anchoring devices will typically be installed on each seawall panel, any number of seawall panels 16 which form the seawall 10 can have any number of anchoring devices installed thereon, and some panels may be without anchoring devices. Panel 16*a* has anchoring devices 32*a* and 32*b* installed thereon at first and second spaced locations, respectively, on panel 16*a* laterally spaced from and aligned with each other in the vertical direction. Panel 16*b* is adjacent panel 16*a* and has anchoring devices 32*c* and 32*d* installed thereon. Anchoring device 32*c* includes a plug member 153 as described above and is depicted without the securing member 62' in order to show plug member 153 in dotted lines. Anchoring devices 32*c* and 32*d* are installed at first and second spaced locations, respectively, on panel 16*b* laterally spaced from and aligned with each other in the vertical direction. In addition, the first and second locations for anchoring devices 32*c* and 32*d* are laterally spaced from and aligned with the first and second locations for anchoring devices 32*a* and 32*b*, respectively, in the horizontal direction. Panel 16*c* is adjacent panel 16*b* and has one anchoring device 32*e* installed thereon at a location laterally spaced from the first and second locations for anchoring devices 32*c* and 32*d*. The location for anchoring device 32*e* is not aligned in the horizontal direction with the first and second locations for anchoring devices 32*c* and 32*d* but, rather, is staggered or offset with respect thereto in the horizontal direction. FIG. 5 shows an arrangement where all of the anchoring devices are disposed below water 12; however, it should be appreciated that any or all of the anchoring devices could be disposed above the water depending on site-specific conditions.

Figure 6:
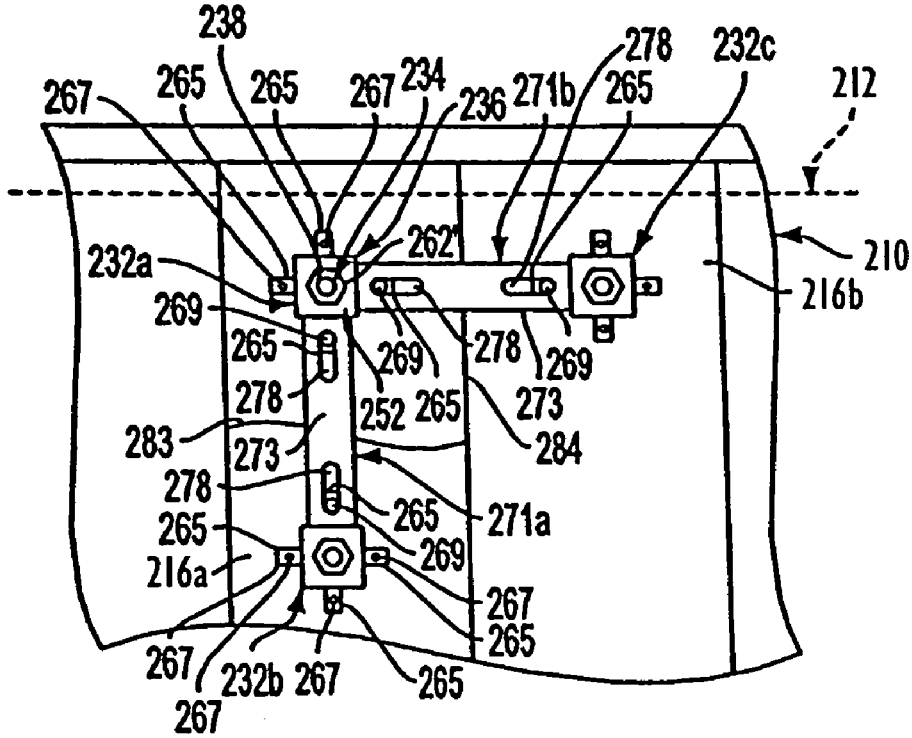
FIG. 6 is a broken plan view of the water facing side of a stabilized seawall depicting a plurality of further alternative anchoring devices installed thereon in rigid interconnected relation.

FIG. 6 depicts an apparatus for maintaining a seawall comprising a plurality of alternative anchoring devices, at least one connecting member for interconnecting a pair of the alternative anchoring devices and one or more fasteners for connecting the at least one connecting member to the pair of anchoring devices which are to be interconnected. The apparatus of FIG. 6 comprises first, second and third anchoring devices 232*a*, 232*b* and 232*c* each comprising an anchoring member 234 and a retaining member 236 as shown for anchoring device 232*a*. Each anchoring device 232*a*, 232*b* and 232*c* is also shown as comprising a securing member 262'. The anchoring members 234 may be similar to anchoring members 34 or 134 and include shafts 238 as shown for anchoring device 232*a*. The retaining members 236 may be similar to retaining members 36 or 136 except that each retaining member 236 includes one or more legs 265 extending therefrom. Each retaining member 236 may comprise a flange 252 of square peripheral configuration defined by four straight sides, with there being a leg 265 extending perpendicularly from each side in a direction radial to the bore hole of the flange which receives shaft 238. However, it should be appreciated that the flange 252 can have any desired peripheral configuration and that one or more legs 265 may extend from any location on the flange 252 in any desired direction. Each leg 265 has a hole 267 therethrough for receiving a fastener. The securing member 262' may be similar to securing members 62' or 162'. The apparatus of FIG. 6 comprises first and second connecting members 271*a* and 271*b* each comprising a straight, longitudinally extending channel member 273 having first and second opposing ends. A longitudinal slot 278 is formed in each of the first and second ends, the slots 278 being aligned with one another in the longitudinal direction for the channel member. Each slot 278 has a closed inner end and a closed outer end. The channel members 273 are rigid members of fixed predetermined length with a predetermined longitudinal distance between the outer ends of slots 278. The channel members 273 may be made of any suitable material including galvanized and stainless steels. Four fasteners are provided in the apparatus of FIG. 6, each comprising a threaded bolt 269 and a nut (nut shown) threadedly engageable on the bolt 269.

In a method of seawall maintenance using the apparatus of FIG. 6, the anchoring devices 232*a*, 232*b* and 232*c* may be installed on a seawall 210 with the anchoring member of each anchoring device placed in its anchored position in a manner similar to that described above for anchoring devices 32 and 132. FIG. 6 illustrates first and second anchoring devices 232*a* and 232*b* installed on panel 216*a* of seawall 210 and third anchoring device 232*c* installed on panel 216*b* of seawall 210. The first and second anchoring devices 232*a* and 232*b* are installed at laterally spaced first and second locations on seawall 210 on opposite sides of a crack 283 in panel 216*a* which has not yet separated or opened. Since the crack 283 extends in the horizontal direction, the first and second anchoring devices 232*a* and 232*b* are laterally spaced from and aligned with one another in the vertical lateral direction traversing crack 283. The retaining members 236 for anchoring devices 232*a* and 232*b* are positioned so that a leg 265 of first anchoring device 232*a* is aligned with a leg 265 of second anchoring device 232*b* in the vertical lateral direction traversing crack 283, and the aligned legs 265 of the first and second anchoring devices 232*a* and 232*b* extend toward each other from their respective flanges 252. Anchoring device 232*c* is installed on panel 216*b* of seawall 210 at a third location on seawall 210 laterally spaced from and aligned in the horizontal lateral direction with the first location for anchoring device 232*a*. The first anchoring device 232*a* and the third anchoring device 232*c* are installed on opposite sides of a vertically extending seam 284 defined between the side edges of adjacent panels 216*a* and 216*b*, and the seam 284 has not yet separated or opened. The retaining members 236 for anchoring devices 232*a* and 232*c* are positioned so that a leg 265 of first anchoring device 232*a* is aligned with a leg 265 of third anchoring device 232*c* in the horizontal lateral direction traversing seam 284. The aligned legs 265 of the first and third anchoring devices 232*a* and 232*c* extend toward each other from their respective flanges 252.

Following installation of the first and second anchoring devices 232*a* and 232*b* with their anchoring members in their anchored positions, the method of seawall maintenance utilizing the apparatus of FIG. 6 involves rigidly interconnecting the anchoring members 234 of the first and second anchoring devices 232*a* and 232*b* to fix or maintain the separation distance between the anchoring members of the first and second anchoring devices in the vertical lateral direction. The first connecting member 271*a* is rigidly interconnected to the anchoring members 234 of the first and second anchoring devices 232*a* and 232*b* by aligning the outer ends of slots 278 of the first connecting member 271 a with the holes 267 in aligned legs 265 of the first and second anchoring devices, respectively. Bolts 269 are inserted through each pair of aligned outer ends and holes 267 and are secured in place via nuts, respectively. If desired, the holes 267 in the legs 265 of the anchoring devices may be threaded to threadedly engage the bolts. The first end of the first connecting member 271*a* is adjacent or in abutment with the retaining member 236 of first anchoring device 232*a* and the second end of the first connecting member 271*a* is adjacent or in abutment with the retaining member 236 of second anchoring device 232*b*. Accordingly, the first and second anchoring devices 232*a* and 232*b* are prevented from moving inwardly toward one another in the vertical lateral direction. The anchoring devices 232*a* and 232*b* are prevented from moving outwardly away from one another in the vertical lateral direction due to engagement of bolts 269 with the closed outer ends of the slots 278 of the first connecting member 271*a*. Since the anchoring devices 232*a* and 232*b* are not rigidly interconnected until after installation with their anchoring members in their anchored positions, the tension and compression established with each anchoring device is independent of the tension and compression established in the other.

Following installation of the first anchoring device 232*a* and the third anchoring device 232*c* with their anchoring members in their anchored positions, the method of seawall maintenance utilizing the apparatus of FIG. 6 involves rigidly interconnecting the anchoring members 234 of the first and third anchoring devices 232*a* and 232*c* to fix or maintain the separation distance between the anchoring members of the first and third anchoring devices in the horizontal lateral direction. The second connecting member 271*b* is rigidly interconnected to the anchoring members 234 of the first and third anchoring devices 232*a* and 232*c* by aligning the outer ends of slots 278 of the second connecting member 271*b* with the holes 267 in the aligned legs 265 of the first and third anchoring devices, respectively. Bolts 269 are inserted through each pair of aligned outer ends and holes 267 in the aligned legs 265 of the first and third anchoring devices and are secured in place via nuts, respectively. The first end of the second connecting member 271*b* is adjacent or in abutment with the retaining member 236 of the first anchoring device 232*a* and the second end of the second connecting member 271*b* is adjacent or in abutment with the retaining member 236 of the third anchoring device 232*c* to prevent movement of the first and third anchoring devices inwardly toward one another in the horizontal lateral direction. Movement of the first and third anchoring devices 232*a* and 232*c* outwardly away from one another in the horizontal lateral direction is also prevented due to engagement of bolts 269 with the closed outer ends of slots 278 of the second connecting member 271*b*. Again, the tension and compression established with anchoring device 232*a* is independent of that established with anchoring device 232*c* since the first and third anchoring devices are not rigidly interconnected until after the first and third anchoring devices have been installed.

Due to the rigid interlocking connection between the first and second anchoring devices 232*a* and 232*b*, separation, misalignment or other displacement of crack 283 is prevented. Due to the rigid interlocking connection between the first and third anchoring devices 232*a* and 232*c*, separation, misalignment or other displacement of seam 284 is prevented. It should be appreciated that the legs 265 can extend from the retaining members 236 in any desired lateral direction to fix or maintain a desired separation distance between a pair of interconnected anchoring devices in any desired lateral direction. Any suitable machinery and/or tools can be used to secure the connecting members to the anchoring devices in interconnected relation from vessel 64. The anchoring devices 232*a*, 232*b* and 232*c* can be inspected or checked periodically and torque, compression and tension adjustments can be made to the anchoring devices as needed and adjustments can be made to the fasteners as needed.

Figure 7:
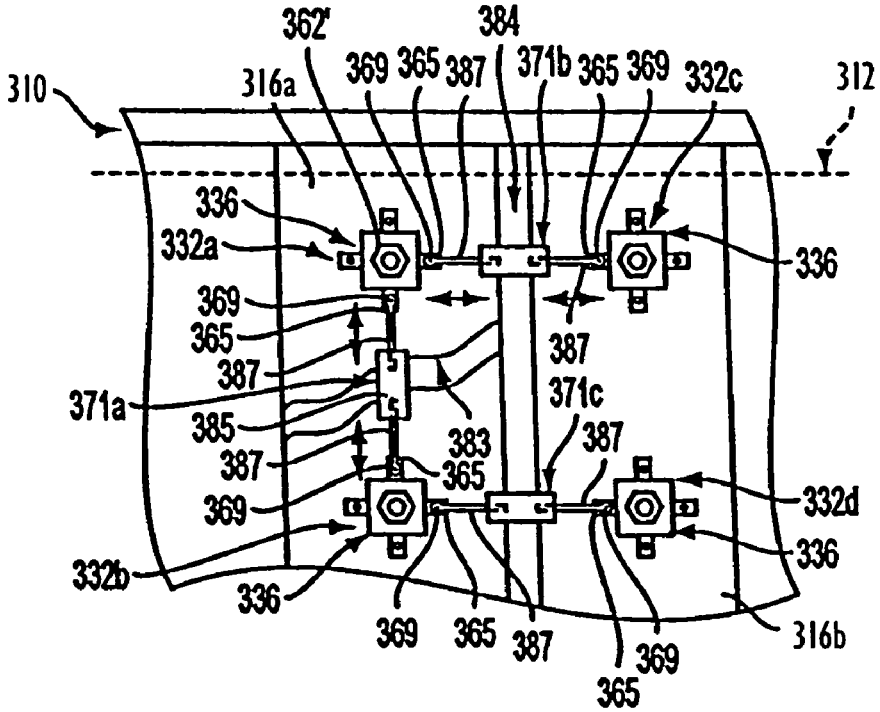
FIG. 7 is a broken plan view of the water facing side of a seawall having openings therein and depicting additional alternative anchoring devices installed thereon in pairs on opposite sides of the openings in adjustable interconnected relation.
Figure 8:
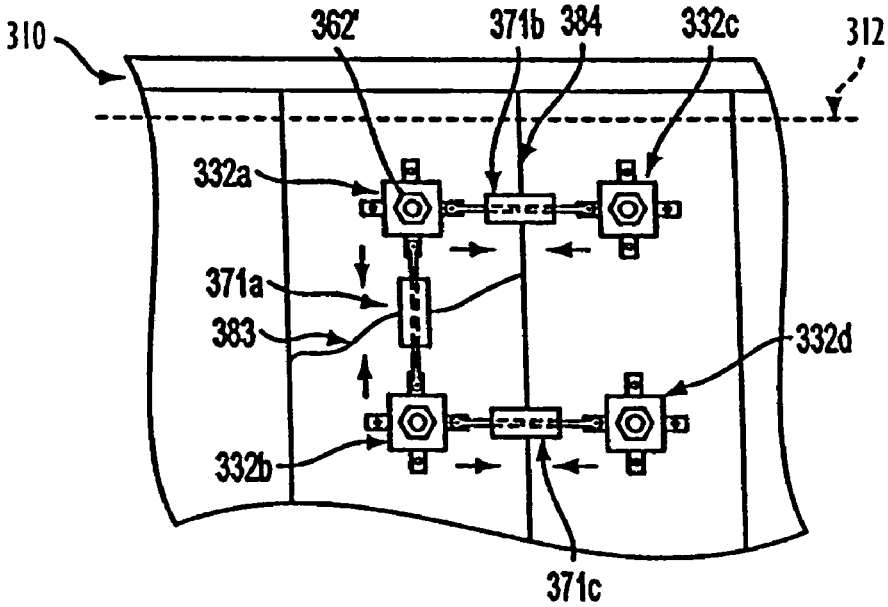
FIG. 8 is a broken plan view depicting stabilization of the seawall of FIG. 7 by drawing the interconnected pairs of additional alternative anchoring devices toward one another to close the openings.

A further alternative apparatus for seawall maintenance is shown in FIGS. 7 and 8 and is similar to the apparatus depicted in FIG. 6 except for the number of anchoring devices and connecting members and except for the connecting members of the apparatus of FIGS. 7 and 8 having an adjustable length. The apparatus of FIGS. 7 and 8 comprises first, second, third and fourth anchoring devices 332*a*, 332*b*, 332*c* and 332*d* which are similar to the anchoring devices 232*a*, 232*b* and 232*c*. The apparatus of FIGS. 7 and 8 comprises first, second and third connecting members 371*a*, 371*b* and 371*c*, each comprising a tumbuckle or other adjustment mechanism. As shown for connecting member 371 a, each connecting member 371*a*, 371*b* and 371*c* comprises an actuator or housing 385 and a pair of adjustment members 387 mounted to the housing. Each adjustment member 387 has a straight stem externally threaded at one end thereof and having an eye formation at the opposite end thereof. The housing 385 has opposed ends with threaded openings respectively threadedly receiving the threaded ends of the stems of the adjustment members 387, which extend from the housing to terminate at the eye formations at opposed first and second ends of the connecting member. The housing 385 is rigid and the threaded openings are located in the housing to mount the straight stems of the adjustment members 387 to extend longitudinally from the opposed ends of the housing 385 in opposite directions and in longitudinal alignment with one another along a common extension axis. The adjustment members 387 are rigid with the eye formations being in line with the stems thereof. The housing 385 may be cylindrical or any suitable configuration. The stems and, therefore, the adjustment members 387, are longitudinally extendable from the housing 385 along the extension axis when the housing is rotated in a first rotational direction relative to the adjustment members 387 while being longitudinally retractable in the housing 385 along the extension axis when the housing is rotated relative to the adjustment members 387 in a second rotational direction, opposite the first rotational direction, as shown by arrows in FIG. 7. The apparatus depicted in FIGS. 7 and 8 includes fasteners for connecting the first and second ends of each connecting member with a pair of anchoring devices, and the fasteners may each comprise a bolt 369 and nut (not shown) similar to the fasteners of the apparatus of FIG. 6.

In a method of seawall maintenance using the apparatus of FIGS. 7 and 8, the anchoring devices 332*a*, 332*b*, 332*c* and 332*d* may be installed on a seawall 310 in a manner similar to that described above for anchoring devices 232*a*, 232*b* and 232*c*. FIG. 7 illustrates first and second anchoring devices 332*a* and 332*b* installed on panel 316*a* of seawall 310 and third and fourth anchoring devices 332*c* and 332*d* installed on adjacent panel 316*b* of seawall 310. The first and second anchoring devices 332*a* and 332*b* are installed at laterally spaced first and second locations on seawall 310 on opposite sides of a horizontally extending crack 383 in seawall panel 316*a* which has separated or opened to present an opening between upper and lower portions of panel 316*a*. Since the crack 383 extends in the horizontal direction, the first and second anchoring devices 332*a* and 332*b* are laterally spaced from and aligned with one another in the vertical lateral direction traversing the crack 383. The retaining members 336 for anchoring devices 332*a* and 332*b* are positioned so that a leg 365 of first anchoring device 332*a* is aligned with a leg 365 of second anchoring device 332*b* in the vertical lateral direction traversing crack 383. The aligned legs 365 of the first and second anchoring devices 332*a* and 332*b* extend toward each other from the flanges of their respective retaining members 336.

Anchoring device 332*c* is installed on panel 316*b* of seawall 310 at a third location on seawall 310 laterally spaced from and aligned in the horizontal lateral direction with the first location for anchoring device 332*a*. First anchoring device 332*a* and third anchoring device 332*c* are installed on opposite sides of a vertically extending seam 384 defined between the side edges of adjacent panels 316*a* and 316*b*, and the seam 384 has separated or opened to present an opening between the panels 316*a* and 316*b*. The retaining members 336 for anchoring devices 332*a* and 332*c* are positioned so that a leg 365 of first anchoring device 332*a* is aligned with a leg 365 of third anchoring device 332*c* in the horizontal lateral direction traversing seam 384. The aligned legs 365 of the first and third anchoring devices 332*a* and 332*b* extend toward each other from the flanges of their respective retaining members 336. Anchoring device 332*d* is installed on panel 316*b* at a fourth location on seawall 310 laterally spaced from and aligned in the horizontal lateral direction with the second location for anchoring device 332*b*. The second anchoring device 332*b* and the fourth anchoring device 332*d* are installed on opposite sides of the seam 384. The retaining members 336 for anchoring devices 332*b* and 332*d* are positioned so that a leg 365 of second anchoring device 332*b* is aligned with a leg 365 of fourth anchoring device 332*d* in the horizontal lateral direction traversing seam 384. The aligned legs 365 of the second and fourth anchoring devices 332*b* and 332*d* extend toward each other from the flanges of their respective retaining members 336. The third and fourth anchoring devices 332*c* and 332*d* are in vertical alignment with one another on seawall panel 316*b*.

A method of seawall maintenance utilizing the apparatus of FIGS. 7 and 8 further involves adjustably rigidly interconnecting the anchoring members of the first and second anchoring devices 332*a* and 332*b*, adjustably rigidly interconnecting the anchoring members of the first and third anchoring devices 332*a* and 332*c*, and adjustably rigidly interconnecting the anchoring members of the second and fourth anchoring devices 332*b* and 332*d*. Following installation of the first and second anchoring devices 332*a* and 332*b*, the first connecting member 371*a* is interconnected to the anchoring members of the first and second anchoring devices by aligning the eye formations of the first connecting member with the respective holes in the aligned legs of the first and second anchoring devices. A bolt 369 is inserted through each pair of aligned eye formations and holes, and the bolts are respectively secured with nuts. With the first and second ends of the first connecting member 371*a* thusly secured to the aligned legs 365 of the first and second anchoring devices 332*a* and 332*b*, the housing 385 of the first connecting member 371*a* is rotated in the first rotational direction to retract the adjustment members 387 thereof into the housing whereby the anchoring members of the first and second anchoring devices are moved or drawn toward one another in the vertical lateral direction as shown by arrows in FIG. 8. The adjustment members 387 of the first connecting member 371*a* are retracted into the housing 385 an amount sufficient to draw the anchoring members of the first and second anchoring devices 332*a* and 332*b* together a distance sufficient to move the upper and lower portions of panel 316*a* toward one another to close or reduce the size of the opening of crack 383 as shown in FIG. 8. Once the first and second anchoring devices 332*a* and 332*b* have been drawn together to close or reduce the size of crack 383 with a desired compressive force, the separation distance between the anchoring members of the first and second anchoring devices 332*a* and 332*b* in the vertical lateral direction is fixedly maintained by the first connecting member 371*a* due to threaded engagement of the stems of the adjustment members 387 and the housing 385.

Following installation of the first anchoring device 332*a* and the third anchoring device 332*c*, the second connecting member 371*b* is interconnected to the anchoring members of the first and third anchoring devices 332*a* and 332*c* by aligning the eye formations of the second connecting member 371*b* with the respective holes in the aligned legs 365 of the first and third anchoring devices and securing the eye formations to the aligned legs 365 using bolts 369 and nuts as described for the first connecting member 371*a*. The housing 385 for the second connecting member 371*b* is rotated in the first rotational direction to retract the stems of the second connecting member into the housing thereby moving or drawing the anchoring members of the first and third anchoring devices 332*a* and 332*c* toward one another in the horizontal lateral direction to correspondingly draw panels 316*a* and 316*b* toward one another to close or reduce the size of the opening of seam 384 as shown in FIG. 8. Once the opening of seam 384 has been closed or reduced in size with a desired compressive force, the longitudinal separation distance between the anchoring members of the first and third anchoring devices 332*a* and 332*c* in the horizontal lateral direction is fixedly maintained by the second connecting member 371*b*. The anchoring members of the second and fourth anchoring devices 332*b* and 332*d* are drawn together using third connecting member 371*c* to close or reduce the size of the opening of seam 384 and thereafter maintain a fixed separation distance between the anchoring members of the second and fourth anchoring devices as described for the second connecting member 371*b* and the first and third anchoring devices 332*a* and 332*c*.

Figure 9:
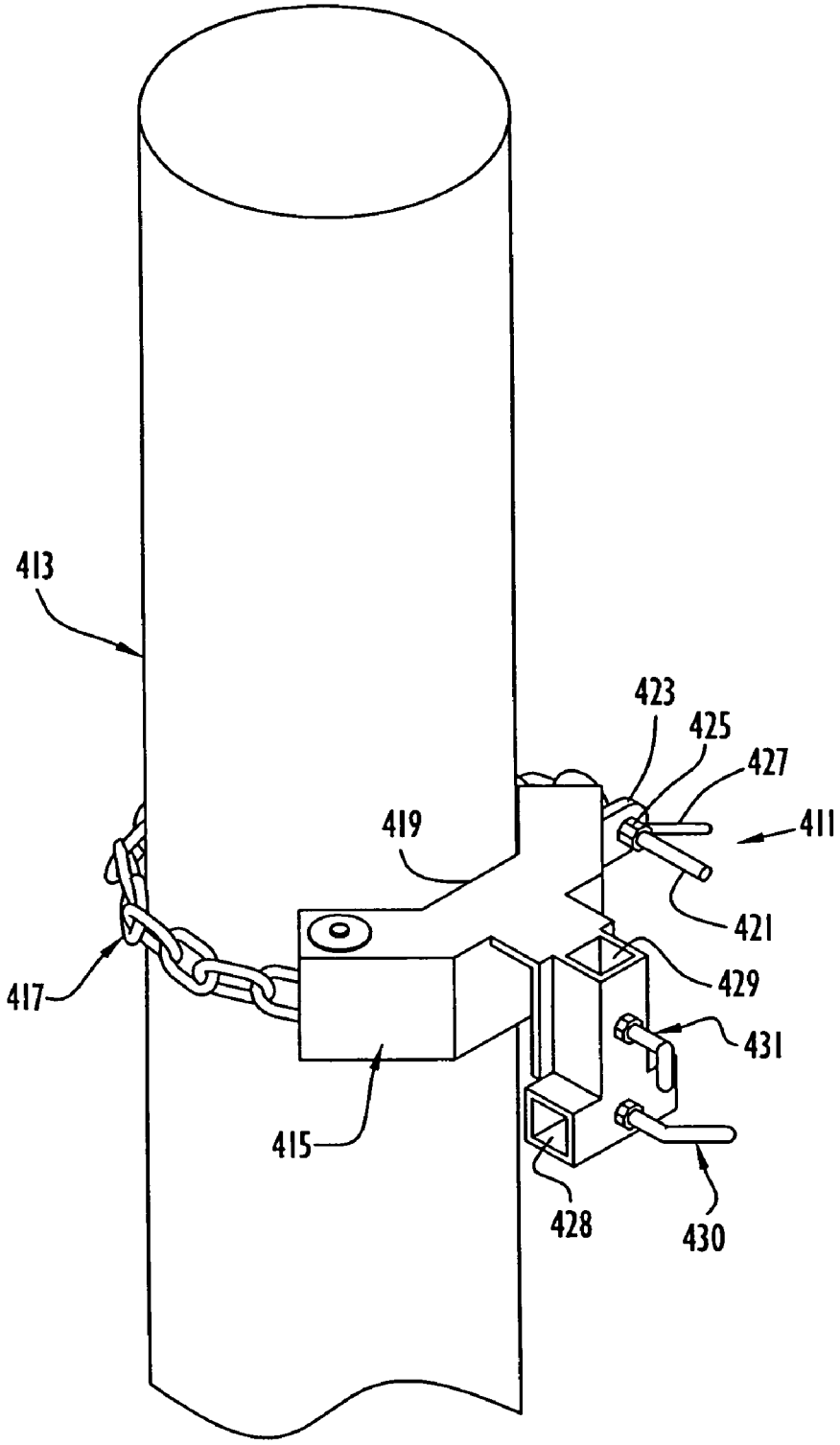
FIG. 9 is a broken perspective view of a vertical piling and a piling clamp used in an anchoring device installation system and method of the present invention.
Figure 10:
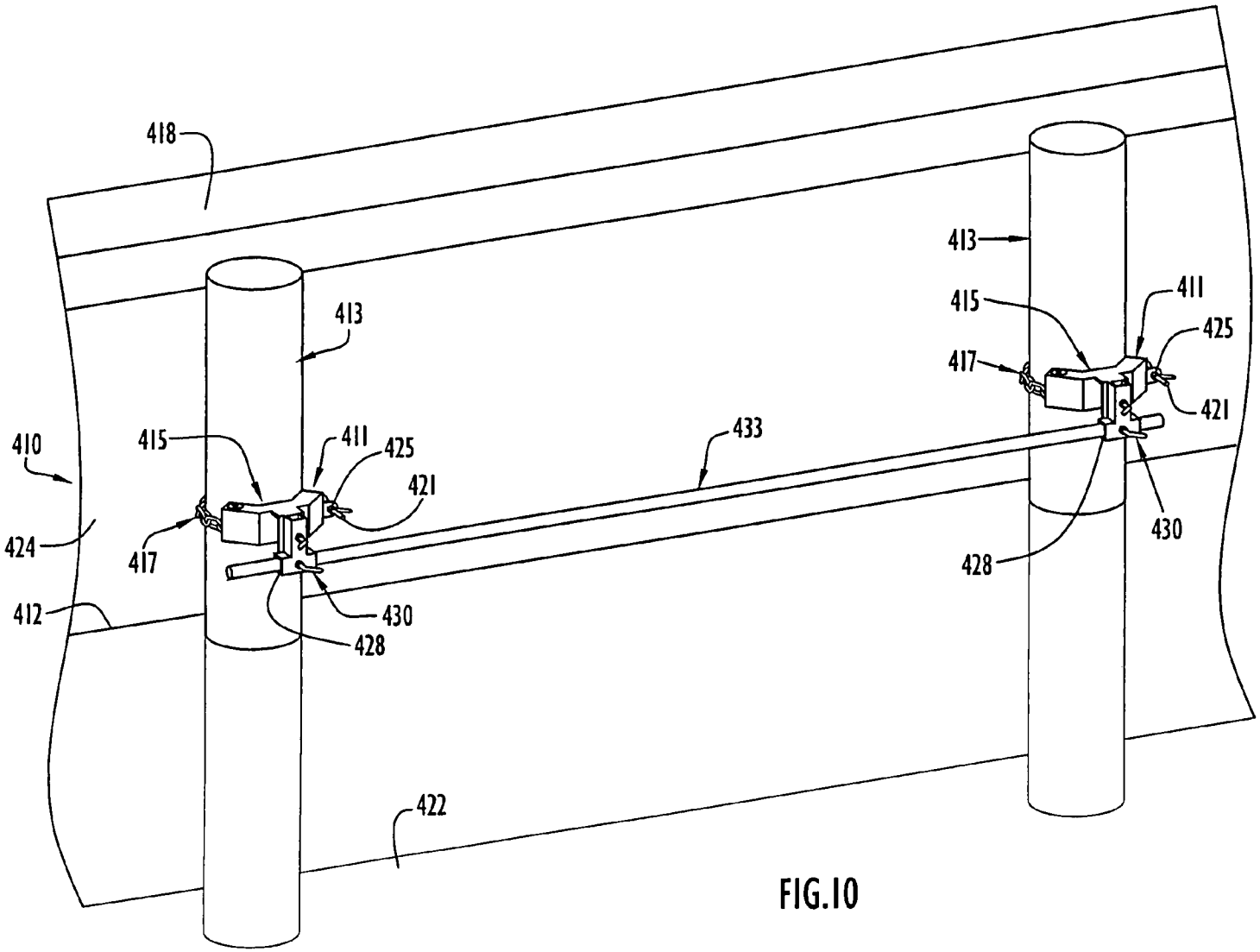
FIG. 10 is a broken perspective view of a forward rail support of the installation system fixated near the water facing side of a seawall using fixation structure comprising a pair of the vertical pilings and a pair of the piling clamps of FIG. 9.
Figure 21:
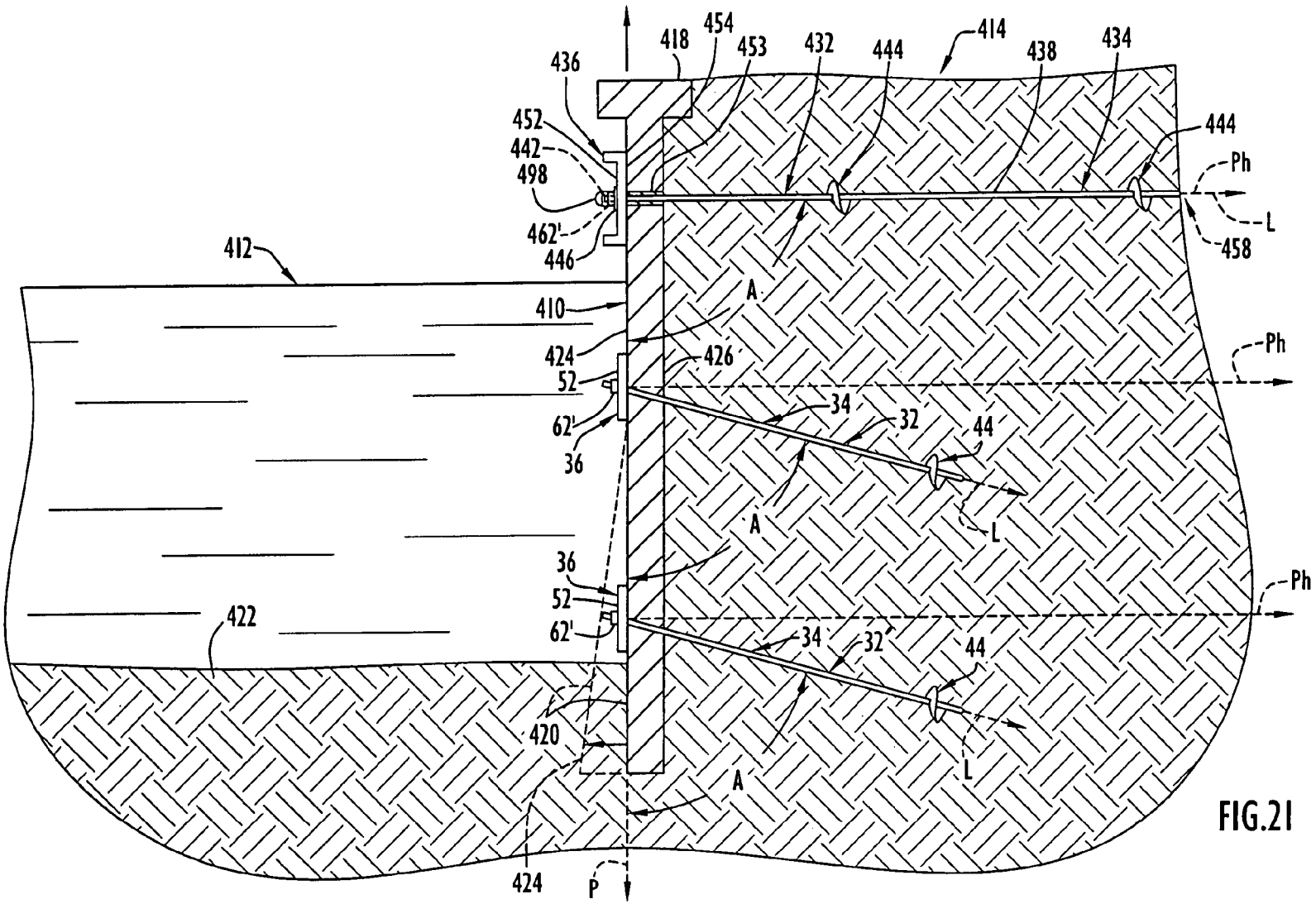
FIG. 21 is a broken side view, partly in section, of the seawall of FIG. 19 with the anchoring device of FIG. 20 installed thereon and showing another anchoring device installed on the seawall to resist "toe out".

The adjustably interconnected pairs of anchoring devices can be drawn together simultaneously, sequentially or in alternating increments with one another. Since the stems are retractable in and extendable from the housings 385, the separation distance between interconnected pairs of anchoring devices can be adjusted to decrease, increase or maintain a separation distance between the interconnected anchoring devices. Accordingly, in addition to being used to reduce the separation distance between a pair of interconnected anchoring devices, the connecting members 371*a*, 371*b* and 371*c* can be used to increase the separation distance between an interconnected pair of anchoring devices to separate seawall panels or seawall panel portions by moving seawall panels or seawall panel portions away from one another by rotating the housing 385 in the second rotational direction. Various machinery and/or tools can be used to secure the connecting members 371*a*, 371*b* and 371*c* to the anchoring devices and to effect actuation of the adjustment members 387 via rotation of the housing 385 from the vessel 64. Depending on the size of the opening in the seawall, the opening may be completely closed with one adjustment of interconnected anchoring members. More commonly, an opening will be closed incrementally over time with periodic adjustments of interconnected anchoring members FIGS. 9 and 10 illustrate forward rail support clamps 411 and forward vertical support members 413 comprising forward rail support fixation structure in an anchoring device installation system of the present invention. The forward vertical support members 413 are existing vertical pilings installed in the water 412 along the water facing side 424 of seawall 410. The vertical pilings are typically installed as part of or adjunct to the original seawall installation, and preferably are not installed for the purpose of carrying out the present invention. Seawall 410 may be constructed as a plurality of abutting concrete panels as described above for seawall 10 or in any other suitable manner. Seawall 410 is depicted as having a cap or ledge 418 at its upper end, and the cap 418 may be of greater depth or thickness than the portion of the seawall below the cap 418 as seen in FIG. 21. Accordingly, the water facing side 424 of seawall 410 along cap 418 may extend or protrude beyond the water facing side 424 of the seawall below cap 418 and/or the earth facing side 426 of the seawall 410 along cap 418 may extend or protrude beyond the earth facing side 426 below cap 418 as illustrated in FIG. 21. The pilings are typically disposed adjacent, near or close to the water facing side 424 at spaced locations or intervals along the length of seawall 410. The pilings extend in a vertical direction along the height of the seawall, with lower ends of the pilings being driven into and thereby secured to the earthen floor 422 and upper ends of the pilings typically extending above the surface of water 412. The pilings are ordinarily parallel or substantially parallel to one another and are ordinarily perpendicular or substantially perpendicular to the earthen floor 422. The pilings are typically elongate, longitudinally straight and cylindrical in configuration with a circular cross-section. The pilings are commonly made from wood.

Where the forward vertical support members 413 are existing vertical pilings, the forward rail support clamps 411 are piling clamps. Each piling clamp, as best depicted in FIG. 9, has a clamp body 415 and a constricting device 417 for securing the clamp body on the vertical piling. The clamp body 415 has an inner surface 419 for being secured in contact with the outer periphery or circumference of the piling. In the illustrated clamp 411, the clamp body 415 comprises a straight central section and two straight side sections extending angularly in opposite directions from the central section. The inner surface 419 of the clamp 411 is thusly defined by a planar surface of the central section and by planar surfaces of the side sections extending from the planar surface of the central section at an angle so that the inner surface 419 cradles a segment of the outer periphery or circumference of the piling with the planar surfaces of the central section and side sections in contact with the outer periphery or circumference of the piling. By forming the inner surface 419 of the clamp body with flat or planar surfaces in contact with the arcuate outer periphery or circumference of the piling, rotational movement of the clamp body 415 in the circumferential direction along the piling is resisted.

The constricting device 417 comprises a length of material, such as heavy chain, having one end connected to a side section of the clamp body 415 and the other end attached to a threaded bolt 421 insertable through a hole formed in a protruding tab 423 on the other side section of the clamp body. An internally threaded nut 425 is threaded onto a free end of bolt 421 extending from the hole in tab 423 and has an attached wing arm 427 for rotating the nut 425 on the bolt 421. The clamp body 415 and constricting device 417 form a band-like or belt-like structure for encircling the piling peripherally or circumferentially. This band-like or belt-like structure is tightened or constricted on the piling by rotating the nut 425 via the wing arm 427 to bear against the tab 423. Rotation of nut 425 allows the constricting device 417 to be tightened circumferentially an amount sufficient to tightly secure the inner surface 419 of the clamp body 415 against the piling so that the piling clamp is fixed in place on the piling. Conversely, the nut 425 can be rotated on the bolt 421 in the opposite direction to loosen the clamp 411 for removal from the piling. The clamp 411 can be positioned on the piling with the nut 425 already initially threaded onto the bolt 421 passing through the hole in tab 423 but with the clamp 411 in a sufficiently loose condition to be slid over the upper end of the piling and moved to a desired location on the piling at which the clamp 411 is tightened. Alternatively, the bolt 421 can be completely removed from the hole in tab 423, allowing the clamp 411 to be wrapped around the piling. The bolt 421 can then be inserted through the hole in tab 423 and the nut 425 can be threaded onto the end of the bolt to tighten the clamp 411 at a desired location on the piling. Removal of the clamp 411 from the piling involves rotating the nut 425, in a direction opposite that used for tightening, to loosen the constricting member 417 a sufficient amount for the clamp 411 to be slid over the upper end of the piling. Alternatively, the nut 425 can be completely unthreaded from the bolt 421, allowing the bolt 421 to be completely removed from the hole in tab 423 to effect removal of the clamp 411 from the piling.

The body 415 of the clamp 411 has a spacer extending from the central section in a radially outward direction to the central longitudinal axis of the piling on which the piling clamp is secured. The spacer is attached to a channel member of inverted T-shaped configuration defining a horizontal channel 428 therethrough and a vertical channel 429 therethrough perpendicular to the horizontal channel. The horizontal and vertical channels 428 and 429 are spaced from the outer periphery or circumference of the piling by the spacer. The horizontal channel 428 lies perpendicular or substantially perpendicular to the central longitudinal axis of the piling, and the vertical channel 429 lies parallel or substantially parallel to the central longitudinal axis of the piling. The horizontal channel 428 has a cross-sectional size and configuration to receive a forward rail support of the installation system therein with a close fit and has a locking device 430 associated therewith for securing the forward rail support in the horizontal channel as explained further below. The vertical channel 429 intersects the horizontal channel 428 and has a cross-sectional size and configuration to receive a vertical support bar therein with a close fit when the horizontal channel is not occupied. The vertical channel 429 has a locking device 431 associated therewith for securing a vertical support bar in the vertical channel. The locking devices 430 and 431 can be designed in various ways and are depicted as comprising threaded locking members threadedly engaged in nuts or nut formations associated with holes in the channel member respectively in communication with the horizontal and vertical channels 428 and 429. Ends of the locking members which do not pass into the nuts and channel member may be bent or angled to facilitate rotation of the locking members for selective advancement in and retraction from the respective horizontal and vertical channels 428 and 429. Advancement of the locking member of locking device 430 into horizontal channel 428 causes the locking member to lockingly engage the forward rail support in the horizontal channel, and retraction of the locking member from the horizontal channel causes disengagement of the locking member from the forward rail support. Advancement of the locking member of locking device 431 into vertical channel 429 causes the locking member to lockingly engage the vertical support bar in the vertical channel, and retraction of the locking member from the vertical channel causes disengagement of the locking member from the vertical support bar. The horizontal and vertical channels 428 and 429 may be square in cross-section to better resist rotation of a forward rail support and a vertical support bar of circular cross-section respectively locked therein.

As shown in FIG. 10, an anchoring device installation method utilizing the forward rail support clamps or piling clamps 411 and the forward vertical support members or pilings 413 involves securing a pair of the clamps 411 on respective pilings 413, which are spaced in parallel along the water facing side 424 of seawall 410. The clamps 411 are secured in place on the pilings 413 by tightening the constricting devices 417 as described above. The clamps 411 are secured on the pilings 413 with the channel members of the clamps located diametrically opposite the water facing side 424 of the seawall and with the horizontal channels 428 of the clamps in longitudinal alignment with each other perpendicular or substantially perpendicular to the central longitudinal axes of the pilings. The clamps 411 are illustrated in FIG. 10 secured on the pilings 413 above the surface of water 412. However, depending on the intended location for the anchoring member to be installed through the seawall, the clamps 411 may be secured on the pilings 413 below the surface of water 412.

FIG. 10 illustrates a forward rail support 433 of the installation system. The forward rail support 433 comprises an elongate, longitudinally straight, forward horizontal support bar of sufficient length for the opposite ends of the bar to be respectively received and locked in the horizontal channels 428 of the piling clamps 411 secured on the pilings 413. The ends of the forward rail support 433 have a cross-sectional size and configuration to fit within the horizontal channels 428 of the piling clamps 411 with a close fit. In the installation method utilizing the installation system, the forward rail support 433 is inserted end first longitudinally in the outer end of a first one of the horizontal channels 428 and is moved longitudinally in the direction of the second one of the horizontal channels 428 for insertion end first longitudinally in the inner end of the second horizontal channel so that opposite ends of the forward rail support 433 are respectively received in the horizontal channels 428. The ends of the forward rail support 433 may extend beyond the outer ends of the horizontal channels 428 as shown in FIG. 10. In order to insert the forward rail support 433 in the horizontal channels 428, it may be necessary to rotate the locking members of locking devices 430 to obtain sufficient retraction of the locking members from the horizontal channels to accommodate the ends of the forward rail support therein. It should also be appreciated that the piling clamps 411 can be designed to permit lateral insertion of the forward rail support 433 in the horizontal channels 428. For example, the clamp bodies could be provided with slots extending the entire length of the horizontal channels and providing communication with the horizontal channels, the slots being of a size to permit insertion of the forward rail support laterally through the slots into the horizontal channels. Once the forward rail support 433 has been inserted in the horizontal channels 428 of the clamps 411, it is secured in place by locking or clamping the ends of the forward rail support in the respective horizontal channels using the locking devices 430. Accordingly, the locking members of locking devices 430 are rotated to advance the locking members into their respective horizontal channels 428 to bear against the forward rail support 433 with sufficient force to secure the forward rail support in place. The pilings 413 will be disposed between the forward rail support 433 and the water facing side 424 of the seawall 410. The pilings 413 thusly space the forward rail support 433 an appropriate distance in front of the water facing side 424 of the seawall 410 with the central longitudinal axis of the forward rail support extending horizontally lengthwise along the seawall perpendicular or substantially perpendicular to the central longitudinal axes of the pilings. Normally, there is at least substantial uniformity between the pilings 413 such that the forward rail support 433 is typically parallel or substantially parallel to the water facing side 424 of the seawall. The position of the forward rail support 433 is fixated by the clamps 411 and pilings 413, which are secured to the earthen floor 422. The forward rail support 433 can be disassembled from the piling clamps 411 by rotating the locking members of locking devices 430 to disengage from the forward rail support and then sliding the forward rail support out of the horizontal channels 428.

Figure 11:
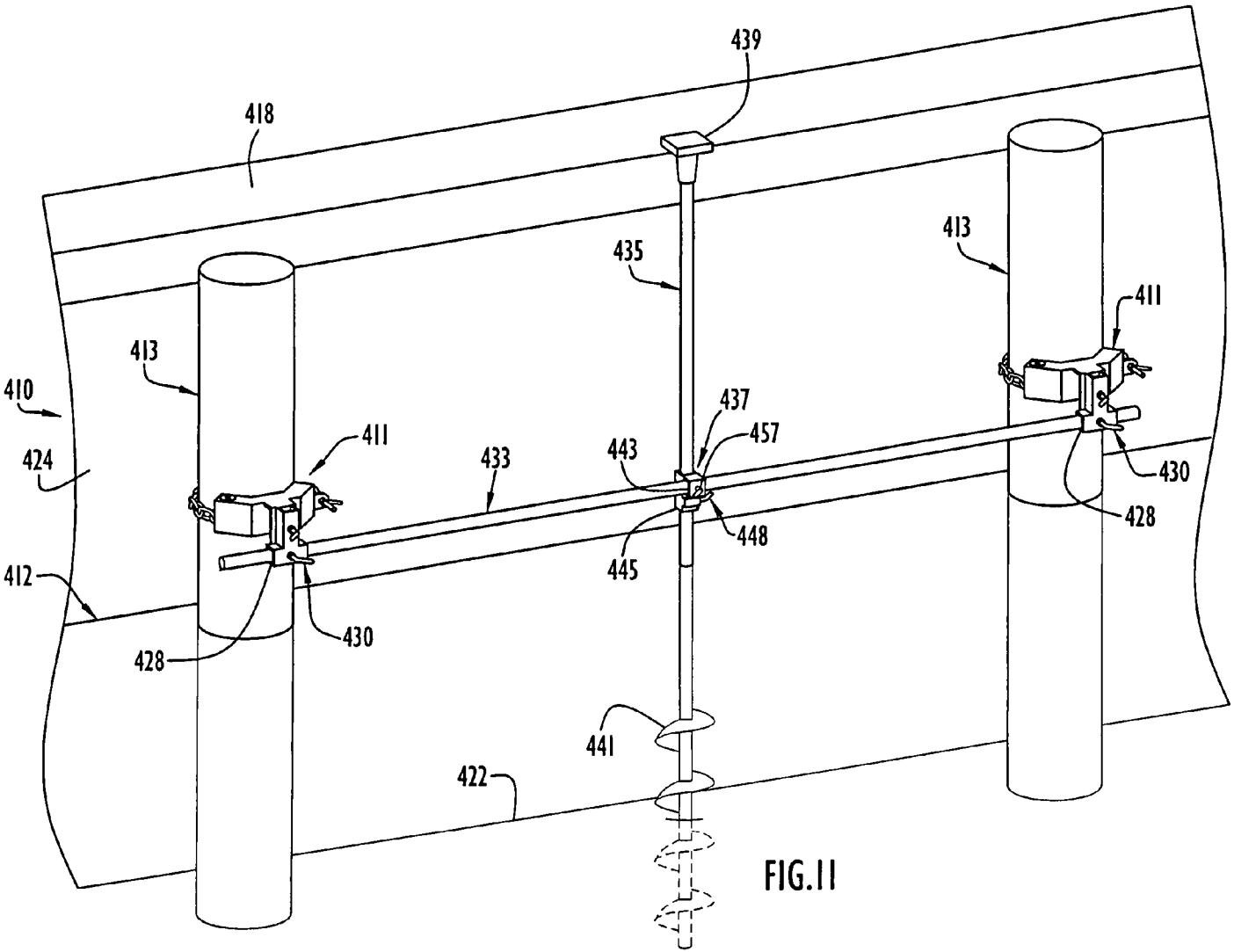
FIG. 11 is a broken perspective view of the seawall of FIG. 10 depicting a stabilizer of the installation system to assist in stabilizing the forward rail support.

The installation system may further comprise a stabilizer for the forward rail support 433 to assist in maintaining the position and rigidity of the forward rail support 433 between the forward vertical support members 413. As shown in FIG. 11, the stabilizer can comprise a vertical support bar 435 and a stabilizer clamp 437 for securing the forward rail support 433 to the vertical support bar. The vertical support bar 435 is of elongate, longitudinally straight configuration with a cross-sectional size and configuration to fit within a vertical passage of the stabilizer clamp 437 with a close fit. The vertical support bar 435 has an upper end attached to a removable shield 439 and a lower end having a penetrating formation 441 thereon. The penetrating formation 441 is configured to facilitate penetration of the earthen floor 422 by the lower end of the vertical support bar 435. The penetrating formation 441 may comprise a helical or screw formation allowing the lower end of the vertical support bar 435 to be rotated into the earthen floor 422 and to reset withdrawal from the earthen floor. The vertical support bar 435 is of sufficient length for its upper end to extend above the forward rail support 433 with the penetrating formation 441 driven into the earthen floor 422 a sufficient depth to secure the vertical support bar in place. The stabilizer clamp 437 comprises a brace defining a horizontal passage 443 therethrough and a vertical passage 445 therethrough perpendicular to the horizontal passage 443. The horizontal and vertical passages 443 and 445 have locking devices 448 and 457 respectively associated therewith. The horizontal passage 443 has a cross-sectional size and configuration to receive the forward rail support 433 therethrough with a close fit, and the vertical passage 445 has a cross-sectional size and configuration to receive the vertical support bar 435 therethrough with a close fit. The horizontal and vertical passages 443 and 445 may have a square cross-section to resist rotation of a forward rail support 433 and vertical support bar 435 of circular cross-section respectively received therein. The locking devices 448 and 457 are similar to the locking devices 430 and 431 and comprise threaded locking members rotatable for selective advancement in and retraction from the respective horizontal and vertical passages to selectively lockingly engage with and disengage from the forward rail support 433 and vertical support bar 435 respectively received in the passages.

In an anchoring device installation method employing the stabilizer, the forward rail support 433 can be inserted end first longitudinally in and through the horizontal passage 443 of stabilizer clamp 437 prior to being inserted in the horizontal channel 428 of at least one of the clamps 411 so that the stabilizer clamp 437 is disposed on the forward rail support 433 between the clamps 411. In order to insert the forward rail support 433 through the horizontal passage 443, it may be necessary to rotate the locking member of locking device 448 to ensure the locking member is sufficiently retracted from the horizontal passage for the forward rail support to fit therein. Once the forward rail support 433 has been locked or clamped in the horizontal channels 428 of the clamps 411 as described above, the stabilizer clamp 437 can be moved or slid longitudinally along the forward rail support 433 to a desired location for the stabilizer to stabilize and rigidify the forward rail support to resist movement. In FIG. 11, stabilizer clamp 437 has been positioned along the forward rail support 433 at a location about midway between the forward vertical support members 413 but other locations are possible. The vertical passage 445 of stabilizer clamp 437 is oriented parallel or substantially parallel to the central longitudinal axes of the forward vertical support members 413. The vertical passage 445 is located just behind the forward rail support 433 between the forward rail support 433 and the water facing side 424 of seawall 410. The stabilizer clamp 437 is locked or clamped to the forward rail support 433 by rotating the locking member of locking device 448 for advancement into the horizontal passage 443 to bear against the forward rail support 433 with sufficient force to secure the stabilizer clamp 437 in place on the forward rail support. It should be appreciated that the stabilizer clamp 437 could be designed to permit the forward rail support 433 to be placed in the horizontal passage 443 of the stabilizer clamp after the forward rail support 433 has been inserted in and locked in place in the horizontal channels 428 of both forward rail support clamps 411. As an example, the brace of stabilizer clamp 437 can be designed with a slot extending along the entire length of the horizontal passage 443 and providing communication with the horizontal passage 443 for placement of the clamp 437 on the forward rail support 433 by inserting the forward rail support laterally into the horizontal passage through the slot. Also, the stabilizer clamp 437 can be secured to the forward rail support 433 after the vertical support bar 435 has been assembled as described below.

The vertical support bar 435 is inserted in the stabilizer clamp 437 to extend through the vertical passage 435 as illustrated in FIG. 11. The vertical support bar 435 may be inserted, lower end first, longitudinally into an upper end of the vertical passage 445 and moved longitudinally downwardly within the vertical passage toward the earthen floor 422. In order to insert the vertical support bar 435 in the vertical passage 445, it may be necessary to rotate the locking member of locking device 457 to ensure the locking member is retracted sufficiently from the vertical passage for the vertical support bar to fit therein. The stabilizer clamp 437 could be designed to permit lateral insertion of the vertical support bar 435 in the vertical passage 445 using a slot extending the entire length of the vertical passage and providing communication with the vertical passage for insertion of the vertical support bar laterally into the vertical passage as described above for the horizontal support bar. By rotating the vertical support bar 435 within the vertical passage 445, the lower end of the vertical support bar penetrates and is drawn into the earthen floor 422 due to the penetrating formation 441 as the vertical support bar continues to move longitudinally downwardly. The vertical support bar 435 is driven or inserted into the earthen floor 422 a sufficient depth for the penetrating formation 441 to resist withdrawal of the vertical support bar from the earthen floor 422 and thereby secure the vertical support bar to the earthen floor. Once the vertical support bar 435 has been secured to the earthen floor 422, the locking member of locking device 457 is rotated for advancement into the vertical passage 445 to lockingly engage the vertical support bar 435 therein. It should be appreciated that more than one stabilizer can be assembled to the forward rail support 433 at any selected location along the forward rail support for increased stability and rigidity. In addition, where the forward rail support 433 does not need the extra stability and rigidity provided by the stabilizer, such as where the forward vertical support members 413 are close together, the installation system and method can be implemented without a stabilizer. The stabilizer can be disassembled by rotating the locking member of locking device 457 to disengage from the vertical support bar 435, allowing the vertical support bar to be withdrawn from earthen floor 422 by rotating it in the opposite direction from that used to drive the vertical support bar into the earthen floor. As it is withdrawn from the earthen floor, the vertical support bar 435 is moved longitudinally upwardly and is continued to be moved longitudinally upwardly for withdrawal from the vertical passage 445 of the stabilizer clamp 437. The stabilizer clamp 437 is removed from the forward rail support 433 by rotating the locking member of locking device 448 to disengage from the forward rail support, and withdrawing the forward rail support from the horizontal passage 443 of the stabilizer clamp.

The forward rail support fixation structure comprising the forward rail support clamps or piling clamps 411, the forward vertical support members or pilings 413 and optionally one or more stabilizers serves to fixate the forward rail support 433 along the water facing side of seawall 410. Together with a forward rail clamp described below, the forward rail support fixation structure including forward rail support clamps 411 and forward vertical support members 413, the forward rail support 433 and optionally one or more stabilizers comprise a forward rail support assembly for supporting the forward end of a rail of the installation system as explained further below. The forward rail support 433 is fixated to the earthen floor 422 since the pilings are secured or fixed to the earthen floor. By virtue of the forward rail support 433 being secured to the forward vertical support members 413 and optionally to the vertical support bar 435, which is also secured to the earthen floor, the forward rail support is constrained from moving longitudinally in the direction of its central longitudinal axis and radially in a direction radial to its central longitudinal axis. Accordingly, the forward rail support 433 is constrained from moving relative to the seawall 410 upwardly and downwardly in a vertical plane along the height of the seawall, toward and away from the water facing side of the seawall in a horizontal plane perpendicular or transverse to the seawall, and lengthwise along the seawall in the horizontal plane.

Figure 12:
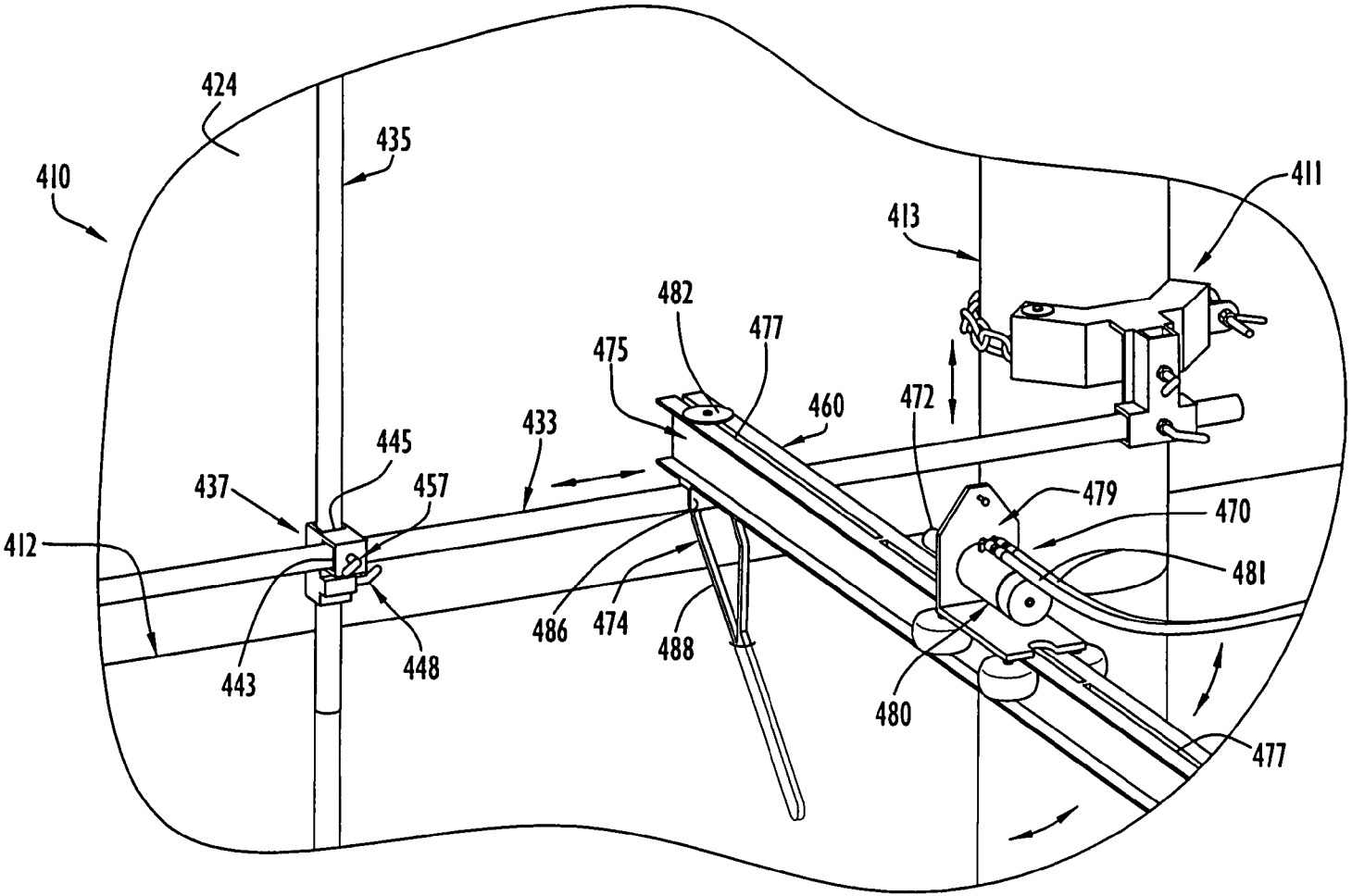
FIG. 12 is a broken perspective view of the seawall of FIG. 11 illustrating a rail of the installation system with its forward end supported by the forward rail support and showing an installation machine of the installation system mounted for movement along the rail.

Additional components of the anchoring device installation system are illustrated in FIG. 12 and include a rail 460 for guiding movement of an installation machine toward and away from the water facing side 424 of seawall 410, an installation machine 470 for riding along the rail 460, and a forward rail clamp 474 for securing a forward end of the rail 460 to the forward rail support 433. The rail 460 comprises an elongate, longitudinally straight beam structure having an I-shaped cross-sectional configuration defining a track 475 having a track section on each side of a central partition, only one track section being visible in FIG. 12. The rail 460 has a forward end for being supported by the forward rail support 433 of the forward rail support assembly and has a rearward end, visible in FIG. 13, for being supported by a rearward rail support of a rearward rail support assembly of the installation system as explained further below. The rail 460 is supported by the forward and rearward rail supports such that the central partition extends vertically, and the central partition may thusly be considered a central vertical partition with the track sections disposed laterally alongside one another in opposite sides of the vertical partition. Each track section of track 475 of the rail 460 is defined between parallel end flanges of the beam structure that extend perpendicular to the central partition. When the central partition is oriented vertically, the parallel end flanges extend horizontally and may be considered top and bottom horizontal flanges. The rail 460 has longitudinal slots 477 extending along at least its forward and rearward ends. The slots 477 in rail 460 are in a plane centrally bisecting the rail perpendicular to the parallel flanges, the plane bisecting the rail centrally being a vertical plane where the central partition is vertical and the parallel flanges are horizontal. The slots 477 extend entirely through the rail 460 along the centrally bisecting plane. The beam structure comprising rail 460 can be fabricated integrally, unitarily or monolithically as a single component or can be formed of a plurality of separate components assembled together. Rail 460 can advantageously be made of two girder members of generally C-shaped cross-section having their webs connected to one another in parallel spaced relation with the parallel end flanges of one girder member extending in the opposite direction from the parallel end flanges of the other girder member. The webs can be connected to one another at one or more discrete locations along the length of the girder members, leaving the webs unconnected along one or more segments of the length of the girder members to define the slots 477. In a rail of this type, which is represented in FIG. 12, the webs of the girder members define the central partition of the rail. A typical length for the rail is about eighteen feet long.

The installation machine 470 comprises a wheeled carriage 479 and a motor 480 mounted on the carriage. The carriage 479 can be designed in various ways and has a base, an end wall extending perpendicularly from a front end of the base, and a plurality of wheels mounted to the bottom of the base on opposite sides thereof for rotatable engagement in the track sections of track 475 of rail 460. In the case of carriage 479, two wheels are provided on each side of the base at or near the front and back ends of the base for rotatable engagement with the corresponding track section of track 475. However, it should be appreciated that one wheel or any number of multiple wheels could be provided on each side of the base for rotatable engagement with the corresponding track section of track 475 of the rail 460. The wheels rotate about axles perpendicular to the parallel flanges of the rail 460 and fit between the parallel flanges of the rail for sliding or rolling contact with the central partition of the rail. When the rail 460 is oriented such that its central partition extends vertically and its parallel end flanges extend horizontally, the base of the carriage is disposed vertically over the top horizontal flanges of the rail when the wheels are engaged in the track sections. The carriage 479 can be assembled on the rail 460 by sliding the carriage onto the rail from either end of the rail to rotatably engage the wheels in the track sections with the base of the carriage disposed over the top horizontal flanges of the rail. The carriage 479 is assembled on the rail 460 so that the front of the carriage faces the forward end of the rail and the back of the carriage faces the rearward end of the rail. When the carriage 479 is assembled on the rail 460 as shown in FIG. 12, the carriage is guided for longitudinal movement along the rail forwardly toward the forward end of the rail and rearwardly toward the rearward end of the rail.

The motor 480 can be mounted on the end wall of the carriage 479 and comprises a rotatable drive shaft 472 extending forwardly of the end wall. When the carriage 479 is assembled on the rail 460 as shown in FIG. 12, the motor drive shaft 472 extends from the end wall toward the forward end of the rail. The motor drive shaft 472 is spaced over and above the top horizontal flanges of the rail 460 with the central longitudinal axis of the motor drive shaft 472 parallel to the central longitudinal axis of the rail 460. Also, the central longitudinal axis of the motor drive shaft 472 is contained in the plane centrally bisecting the rail 460. The central longitudinal axis of the drive shaft 472 defines or is coaxial with an installation axis along which the drive shaft moves longitudinally when the carriage 479 is moved longitudinally along the rail 460. The motor 480 can be powered or driven by any suitable power source to rotate the drive shaft 472. Preferably, the motor 480 is powered hydraulically using hydraulic power supplied from a portable hydraulic transmission rig (not shown) located on land on the earth side of seawall 410 and connected to the motor via one or more connecting lines 481 as needed to supply hydraulic power to the motor to rotate the drive shaft 472. Rotation of the motor drive shaft 472 can be controlled remotely from the hydraulic transmission rig.

The forward rail clamp 474 is illustrated in FIG. 12 assembled to the forward rail support 433 and to the forward end of the rail 460. The forward rail clamp 474 comprises a plate component including an end or top plate 482 and a stem extending perpendicularly from the plate 482, a foot component including a foot 486 and an externally threaded shaft extending perpendicularly from the foot 486, and a clamping device 488 associated with the foot. A passage extends longitudinally entirely through the stem in alignment with a hole in the top plate 482 for receiving the threaded shaft therethrough. An internally threaded nut can be secured on an end of the threaded shaft which protrudes from the plate 482 to secure the plate component to the foot component. The forward rail clamp 474 could be designed for the plate 482 and foot 486 to be selectively or adjustably drawn together via rotational advancement of the nut on the externally threaded shaft to adjust the separation distance between the top plate and the foot for the rail 460 to fit closely therebetween or to be forcefully clamped therebetween when the forward rail clamp is assembled to the rail 460 as explained further below. The foot 486 has a configuration to engage with the forward rail support 433 to support the forward end of the rail 460 thereon, and the foot 486 can have a horizontal channel extending longitudinally therethrough perpendicular to the externally threaded shaft for receiving the forward rail support to extend longitudinally through the horizontal channel. The foot 486 could also have a horizontal slot in communication with and extending the entire length of the horizontal channel for insertion of the forward rail support 433 laterally into the horizontal channel through the horizontal slot. The clamping device 488 can be designed in various ways for operation to forcefully secure or clamp the foot 486 to the forward rail support 433 with the forward rail support extending longitudinally through the horizontal channel of the foot. The clamping device 488 is seen as constituting vise-like jaws but could constitute threaded locking members selectively extendable into and retractable from the horizontal channel of the foot to selectively engage with and disengage from the forward rail support 433 in the horizontal channel. The features of forward rail clamp 474 may be more clearly understood with reference to the forward rail clamp 1074 described below and illustrated in FIG. 29, especially since the stem and shaft of clamp 474 are not visible in FIG. 12 due to being disposed in slot 477.

In the anchoring device installation method utilizing the installation system, the foot component of the forward rail clamp 474 is assembled on the forward rail support 433 by engaging the foot 486 with the forward rail support. In the case of forward rail clamp 474, the foot 486 is engaged with the forward rail support 433 by inserting the forward rail support 433 laterally or longitudinally into the horizontal channel of the foot. Insertion of the forward rail support 433 into the horizontal channel of the foot 486 could be accomplished in a manner similar to that described above for insertion of the forward rail support 433 in the horizontal passage 443 of stabilizer clamp 437. The clamping device 488 is used to clamp the foot 486 to the forward rail support 433 such that the shaft on the foot 486 extends upwardly relative to the horizontally extending forward rail support 433. When the foot 486 is clamped to the forward rail support 433, the foot component cannot move relative to the forward rail support. The rail 460 is assembled to the foot component by placing the forward end of the rail over the end of the shaft to align the bottom of slot 477 with the end of the shaft and moving the rail 460 toward the foot 486 to introduce the end of the shaft into the bottom of the slot 477. If the stem of the plate component has already been inserted in the slot 477 from top to bottom, the end of the shaft is introduced in the passage of the stem. The rail 460 is moved toward the foot 486 until the bottom flanges of the rail are supported on the foot and the end of the shaft extends from the top of the slot 477 and the top flanges of the rail. If the shaft has been inserted through the passage of the stem, the end of the shaft will extend from the hole in plate 482. If the plate component has not already been assembled to the rail 460 when the rail 460 is assembled to the foot component, the plate component is assembled to the rail 460 and to the foot component by aligning the bottom end of the stem with the end of the shaft extending from the top of slot 477 and moving the plate component toward the foot 486 to insert the shaft into the passage of the stem. The plate component is moved toward the foot 486 such that the stem enters the slot 477 around the shaft and the end of the shaft exits the hole in plate 482. The nut is threadedly secured on the end of the shaft extending from the hole 482 to secure the plate component to the foot component, and is rotatably advanced on the shaft to confine the forward end of the rail 460 between the plate 482 and the foot 486. The nut can be used to apply sufficient compressive force against the plate 482 to forcefully clamp the rail 460 between the plate 482 and foot 486. Releasing the clamping device 488 so that the foot 486 is not clamped to the forward rail support 433 allows the foot component, with or without the rail 460 assembled thereto, to be moved linearly along the length of the forward rail support 433 in a horizontal plane transverse or perpendicular to the seawall 410 as shown by an arrow in FIG. 12. Accordingly, the foot 486 can be moved to a selected location along the length of the forward rail support 433 for formation of a passage in seawall 410 to originate on the water facing side 424 where the installation axis intercepts the water facing side of the seawall. Clamping the foot 486 to the forward rail support 433 using the clamping device 488 secures the foot 486 and the rail 460 at the selected location for formation of the passage in the seawall. Although the forward end of rail 460 can be assembled to the foot component prior to or subsequent to the foot component being moved linearly along and clamped to the forward rail support 433 at the selected location, it may be preferable to clamp the foot component to the forward rail support at the selected location before assembling the rail to the foot component so that the foot component can be moved along the forward rail support to the selected location without having to move the rail therewith. However, if the forward end of the rail 460 is not yet at the selected location along the forward rail support 433 after the rail 460 has been assembled to the foot component, the foot component with the forward end of rail 460 attached thereto can be moved linearly along the length of the forward rail support to the selected location. When the clamping device 488 is released, the foot component with or without the rail 460 assembled thereto can also be pivoted or rotated about the central longitudinal axis of the forward rail support 433 for pivotal movement or positioning of the rail 460 in a vertical plane transverse or perpendicular to the seawall 410 to adjust the rearward end of the rail 460 upwardly or downwardly relative to its forward end as shown by an arrow in FIG. 12 to position the installation axis at a selected vertical angle for formation of a passage in seawall 410 to receive an anchoring member. Depending on the vertical angle selected, the rail 460 can be positioned so that the installation axis, which is parallel to the central longitudinal axis of the rail, is contained in a horizontal plane perpendicular to the seawall 410, i.e. neutral vertical angle, extends downwardly from the water facing side to the earth facing side of the seawall, i.e. downward vertical angle, or extend upwardly from the water facing side to the earth facing side of the seawall, i.e. upward vertical angle. When the nut is sufficiently untightened, the rail 460 can be pivoted or rotated in a horizontal plane transverse or perpendicular to the seawall 410 about the central longitudinal axis of the shaft in order to adjust the rearward end of the rail laterally relative to its forward end as shown by an arrow in FIG. 12 to position the installation axis at a selected lateral angle. Rotation of the rail 460 about the central longitudinal axis of the shaft may be accomplished by rotating the rail and stem relative to the shaft or by providing the stem with an external configuration that permits rotation of the rail relative to the stem. Depending on the lateral angle selected, the rail 460 can be positioned so that the installation axis is contained in the vertical plane perpendicular to the seawall, i.e. neutral lateral angle, extends to the left of the vertical plane from the water facing side to the earth facing side of the seawall, i.e. left lateral angle, or extends to the right of the vertical plane from the water facing side to the earth facing side of the seawall, i.e. right lateral angle. The vertical and lateral angles respectively correspond to the vertical angle A and the lateral angle B discussed above. The clamping device 488 can be tightened once the rail 460 is in the proper position for the installation axis to be disposed at the selected vertical and lateral angles. Positioning of the rail 460 at the selected vertical angle can also be effected by raising or lowering the forward end of the rail 460 relative to its rearward end in that the forward end of the rail 460 can be moved linearly along the height of the seawall in a vertical plane transverse or perpendicular to the seawall by adjusting the position of the forward rail support 433 along the forward vertical support members 413 as shown by an arrow in FIG. 12. Positioning of the rail 460 at the selected lateral angle can also be effected by moving the forward end of the rail laterally relative to its rearward end via linear movement of the forward rail clamp 474 to the left or right along the forward rail support 433. The forward end of rail 460 can be detached from the forward rail clamp 474 by removing the nut, withdrawing the stem from the slot 477, and disengaging the rail from the shaft of the plate component. The forward rail clamp 474 and/or its plate component can be removed from the forward rail support 433 by releasing the clamping device 488 and disengaging the foot 486 from the forward rail support 433. It should be appreciated that the steps described above for assembling the foot component to the forward rail support, the rail to the foot component, and the plate component to the foot component and rail can be performed in any appropriate sequence and need not be performed in the specific sequence set forth. For example, the entire forward rail clamp could be assembled to the rail prior to assembling the foot to the forward rail support.

Figure 13:
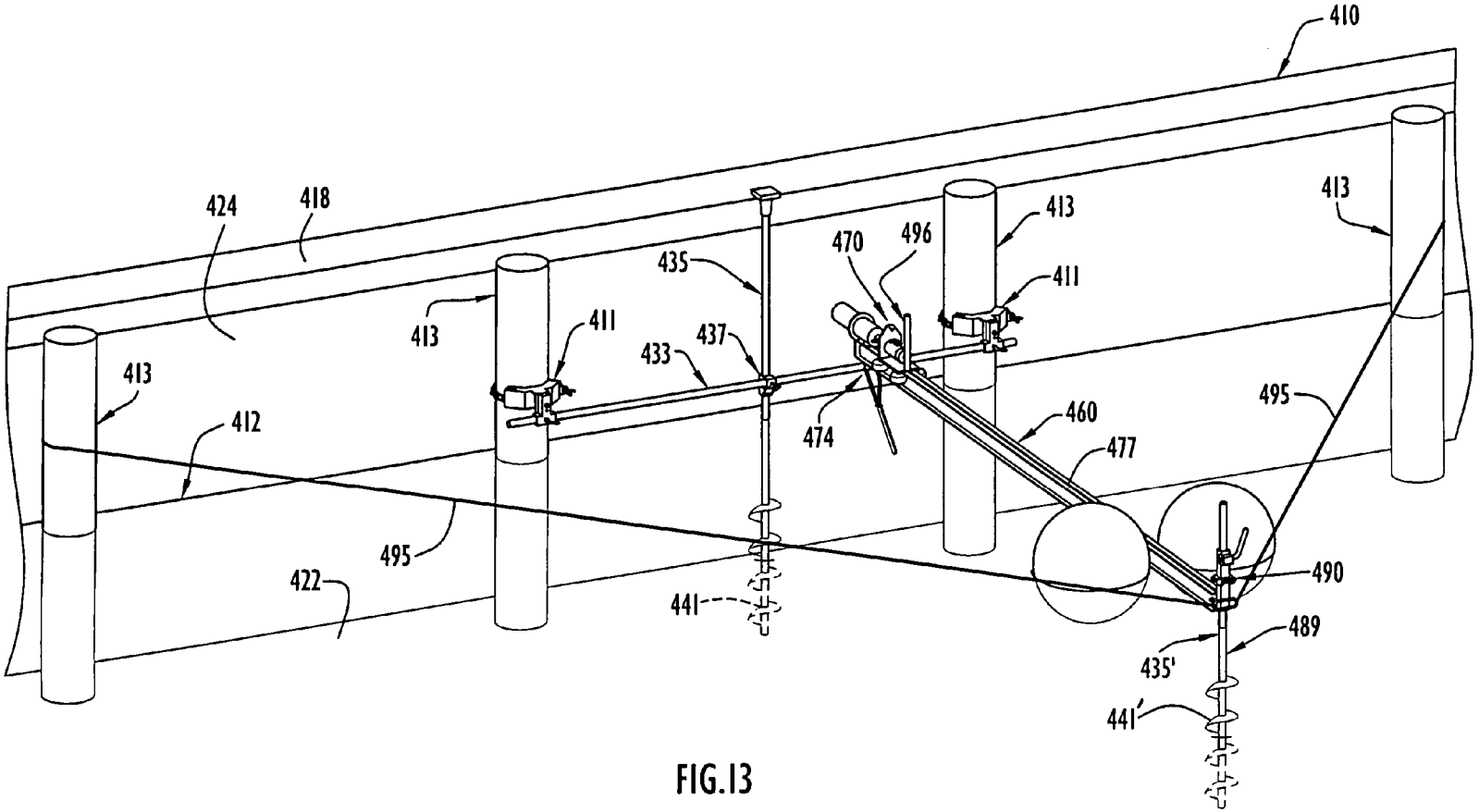
FIG. 13 is a broken perspective view of the seawall of FIG. 12 depicting a rearward end of the rail supported by a rearward rail support of the installation system.

The rearward end of the rail 460 is supported by the rearward rail support assembly depicted in FIG. 13 and comprising a rearward rail support 489, rearward rail support fixation structure for fixating the rearward rail support 489, and a rearward rail clamp 490 for securing the rearward end of the rail 460 to the rearward rail support 489. The rearward rail support 489 depicted in FIG. 13 comprises an elongate, longitudinally straight, rearward vertical support bar 435' similar to the vertical support bar 435 of the stabilizer. The rearward vertical support bar 435' is depicted without a shield at its upper end but a shield could be provided if warranted. The rearward vertical support bar 435' has a lower end with a penetrating formation 441' thereon similar to penetrating formation 441. The penetrating formation 441' constitutes the rearward rail support fixation structure by which the rearward rail support 489 is secured in place at the appropriate location to support rail 460 with the installation axis at the selected vertical and lateral angles. The rearward vertical support bar 435' has a cross-sectional size and configuration to fit within a vertical cavity of the rearward rail clamp 490 with a close fit as described further below.

Figure 14:
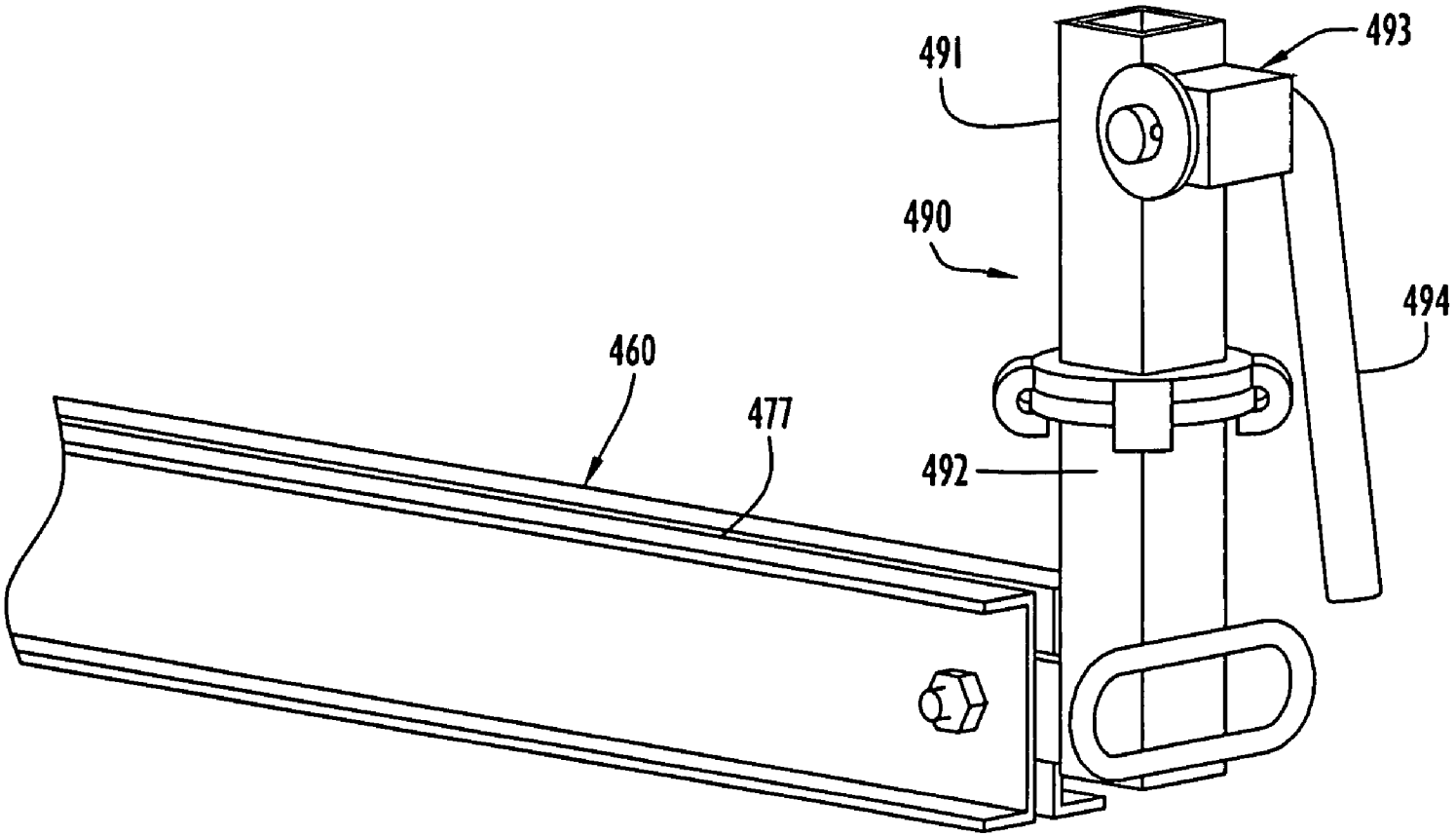
FIG. 14 is a broken perspective view of the rearward end of the rail of FIG. 13 depicting a rearward rail clamp of the installation system in an unlocked position secured to the rearward end of the rail.
Figure 15:
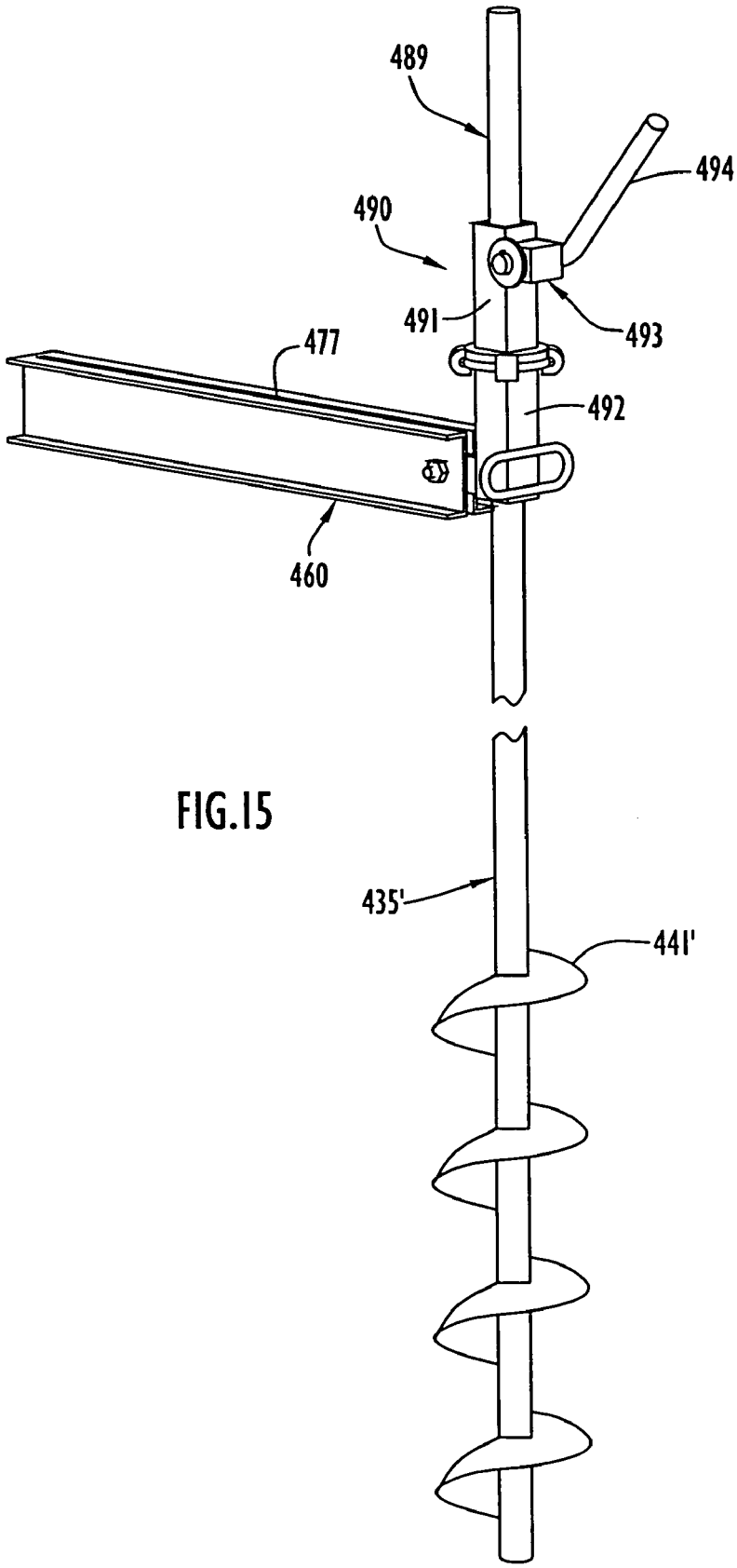
FIG. 15 is a broken perspective view of the rearward rail clamp of FIG. 14 with the rearward rail support assembled to the rearward rail clamp which is shown in a locked position.

The rearward rail clamp 490 is illustrated in FIGS. 13-15 and comprises a housing having an upper housing section 491 and a lower housing section 492, and a locking device 493 associated with the housing. The upper and lower housing sections 491 and 492 each have a longitudinal passage extending entirely therethrough. The upper housing section 491 is mounted on the lower housing section 492 in end to end relation, with the longitudinal passages of the housing sections in longitudinal alignment to define a vertical cavity extending longitudinally entirely through the housing. The upper and lower housing sections 491 and 492 are rotatable relative to one another about the central longitudinal axis of the vertical cavity. The end of the upper housing section 491 that is in end to end relation with the lower housing section 492 is provided with an external, annular, flat protruding rim, and the end of the lower housing section 492 that is in end to end relation with the upper housing section 491 is provided with a similar rim. The rims are in face to face abutment when the upper and lower housing sections 491 and 492 are mounted in end to end relation, and the rim of the upper housing section 491 is provided with a plurality of outwardly extending fingers that are bent over the outer edge of the lower housing section rim to the underside thereof. The fingers secure the upper and lower housing sections 491 and 492 together in end to end relation while permitting the upper housing section 491 to rotate relative to the lower housing section 492 about the central longitudinal axis of the vertical cavity. As the upper housing section 491 rotates relative to the lower housing section 492, the rim of the upper housing section 491 slides rotationally on the rim of the lower housing section 492. The rims of the upper and lower housing sections 491 and 492 are circular in peripheral configuration with the fingers extending radially from the upper housing rim flange to facilitate relative rotation between the housing sections. The upper and lower housing sections 491 and 492 are depicted with a square cross-sectional configuration defining a vertical cavity of square cross-section through the housing. However, the housing sections 491 and 492 can have various cross-sectional configurations, and the vertical cavities thereof can have any suitable cross-section to receive the rearward rail support 489 therethrough with a close fit.

The locking device 493 is provided on the upper housing section 491 and includes an operating handle 494 movable from an unlocked position for the locking device shown in FIG. 14 to a locked position for the locking device shown in FIGS. 13 and 15. The operating handle 494 has an angled bend connecting a shorter handle segment to a longer handle segment. The shorter handle segment is rotatably mounted in a rotation block extending from the back of the upper housing section 491, with the central longitudinal axis of the shorter handle segment perpendicular to and spaced rearwardly of the central longitudinal axis of the vertical cavity through the housing. The handle 494 is rotatable about the central longitudinal axis of the shorter handle segment by manually pivoting or rotating the longer handle segment upwardly and downwardly for movement between the unlocked and locked positions. The locking device 493 includes a locking member (not visible) in the upper housing section 491 movable into and out of locking engagement with the rearward rail support 489 extending through the vertical cavity in response to rotation of the operating handle 494 to the locked and unlocked positions. The locking member can be designed in many various ways to be responsive to movement of the operating handle 494 to lockingly engage with and disengage from the rearward rail support 489 in the vertical cavity, and the locking member may be designed as a cam lock. When the operating handle 494 is in the unlocked position, the locking member is not in a position to lockingly engage the rearward rail support 489 extending through the vertical cavity. Accordingly, the rearward rail support 489 is free to slide longitudinally in the vertical cavity and is free to rotate in the vertical cavity. When the operating handle 494 is moved from the unlocked position to the locked position, the locking member is in a position to lockingly engage the rearward rail support 489 in the vertical cavity so that the rearward rail support is locked to the upper housing section 491. The rearward rail support 489, when locked to the upper housing section 491, cannot move longitudinally or rotationally relative to the upper housing section 491. However, the upper housing section 491 with the rearward rail support 489 locked thereto is rotatable relative to the lower housing section 492 about the central longitudinal axis of the vertical cavity.

The rearward rail clamp 490 is removably attachable to the rearward end of the rail 460. For this purpose, the rearward rail clamp 490 is provided with an attachment plate extending from the front of the lower housing section 492. The attachment plate has a size and configuration to fit within the slot 477 at the rearward end of rail 460 with a close fit, the attachment plate being disposed between the vertical webs of the girder members defining the rail 460. The attachment plate has a hole extending therethrough for axial alignment with holes in rail 460 respectively extending through the vertical webs of the girder members on each side of the attachment plate. The holes of rail 460 are coaxial and perpendicular to the central longitudinal axis of the rail. The rearward rail clamp 490 further includes a fastener, such as a threaded bolt, for being inserted through the aligned holes in the attachment plate and rail, and a nut for being threaded onto the end of the bolt so that the rail 460 is captured between the nut and the head of the bolt. In this way, the rearward rail clamp 490 is secured to the rearward end of the rail 460, with the rearward end of the rail 460 being pivotable about the bolt axis perpendicular to the central longitudinal axis of the rail. The rearward rail clamp 490 can be attached to tie lines when used in the installation method of the present invention, and an eye formation may be provided on the rearward rail clamp for this purpose. As seen in FIGS. 13-15, the rearward rail clamp 490 has an eye formation defining a pair of eyelets on the back of the lower housing section 492 extending laterally outwardly from opposite sides of the lower housing section.

In the anchoring device installation method utilizing the installation system, the rearward rail clamp 490 is secured to the rearward end of rail 460 by placing the attachment plate in the slot 477 at the rearward end of the rail so that the hole in the attachment plate is aligned with the holes in the rail 460, inserting the bolt through the aligned bore and holes, and threading the nut onto the end of the bolt. The rearward rail support 489 can be assembled to the rearward rail clamp 490 either before or after the rearward rail clamp has been secured to the rail 460. The rearward rail support 489 is inserted end first in the vertical cavity of the rearward rail clamp 490 so that the lower end of the rearward rail support extends from the bottom of the lower housing section 492. The rearward rail support 489 is inserted in the vertical cavity with the operating handle 494 in the unlocked position so that the rearward rail support slidably extends through the vertical cavity and is rotatable within the vertical cavity. The rearward rail support 489 is rotated in the vertical cavity to drive the lower end of the rearward rail support into the earthen floor 422 with the rearward rail support parallel or substantially parallel to the forward vertical support members 413. Prior to driving the lower end of the rearward rail support 489 into the earthen floor 422, the rearward end of rail 460 can be moved laterally by pivoting the rail in a horizontal plane about the axis of the stem of the forward rail clamp 474 as needed to position the installation axis at the selected lateral angle. In most cases, the installation axis will be contained in the vertical plane perpendicular to the seawall 410 so that the central longitudinal axis of the anchoring member to be installed through the seawall will be contained in the vertical plane and will be disposed at a neutral lateral angle. However, angling the rail 460 laterally so that the installation axis is laterally angled to the left or right of the vertical plane makes it possible to install an anchoring member so that the central longitudinal axis of the anchoring member is angled laterally to the left or right of the vertical plane which may be useful where the anchoring member must be installed to avoid an obstacle in the retained earth on the earth facing side of the seawall 410. Because the rearward rail support 489 is secured to the earthen floor 422, it fixes the position of the rail 460 at the lateral angle selected for the installation axis. The rearward rail clamp 490 with the rearward end of rail 460 secured thereto is moved linearly along the rearward rail support 489 upwardly or downwardly in a vertical plane as needed to obtain as close as practicable the vertical angle selected for the installation axis. As the rearward rail clamp 490 is moved upwardly or downwardly along the rearward rail support 489, the rearward end of the rail 460 can pivot about the bolt that secures the rail 460 to the lower housing section 492, and the forward end of the rail may pivot about the forward rail support 433. The rearward rail clamp 490 is then locked to the rearward rail support 489 by moving the operating handle 494 from the unlocked position to the locked position in which the locking member in the upper housing section 491 is moved into locking engagement with the rearward rail support 489. When the upper housing section 491 is locked to the rearward rail support 489, the rearward rail support 489 cannot move longitudinally or rotationally relative to the upper housing section 491. However, the rearward rail support 489 is still able to move longitudinally and rotationally as permitted due to rotation of the upper housing section 491 relative to the lower housing section 492. Further adjustments needed to obtain the vertical angle selected for the installation axis can thusly be effected, as needed, by rotating the rearward rail support 489 in the appropriate direction to cause longitudinal movement of the rearward rail support upwardly or downwardly in the vertical plane in accordance with the direction that the rearward end of the rail 460 must be correspondingly moved to adjust the position of the installation axis to the selected vertical angle. By rotating the rearward rail support 489 in the appropriate direction, the rearward rail support will either be withdrawn longitudinally upwardly from the earthen floor 422 or advanced longitudinally downwardly further into the earthen floor, and the rearward rail clamp 490 moves with the rearward rail support since the upper housing section 491 is locked to the rearward rail support. Since the rearward end of rail 460 is attached to the rearward rail clamp 490, the rearward end of the rail moves upwardly or downwardly by pivoting about the bolt that secures it to the lower housing section 492 in accordance with the upward or downward longitudinal movement of the rearward rail support 489. In the anchoring device installation method, coarse or large adjustments to the vertical angle of the rail 460 may thusly be obtained through longitudinal movement of the rearward rail clamp 490 relative to and along the rearward rail support 489 when the rearward rail clamp 490 is not locked to the rearward rail support. Fine or small adjustments to the vertical angle of rail 460 may be obtained through longitudinal movement of the rearward rail clamp 490 together with the rearward rail support 489 when the upper housing section 491 is locked to the rearward rail support.

As shown in FIG. 13, tie lines 495 have first ends respectively attached to the eyelets on the rearward rail clamp 490 and have second ends attached to any appropriate structure to assist in maintaining the rearward rail support 489 parallel or substantially parallel to the forward vertical support members 413. As shown in FIG. 13, the second ends of the tie lines 495 may be respectively attached to existing vertical pilings 413, but could be attached to any other appropriately located structure. The pilings to which the tie lines 495 are attached in FIG. 13 are not the same pilings to which the clamps 411 are secured. However, it should be appreciated that the second ends of the tie lines 495 can be attached to the same pilings to which the piling clamps are secured. Also, the tie lines 495 can be tensioned to better resist displacement of the rearward rail support 489 in a direction away from the seawall. One or more floats can be attached to the rail 460 at one or more locations for added buoyancy as seen in FIG. 13. Disassembly of the rearward rail support assembly involves unlocking the rearward rail clamp 490 from the rearward rail support 489, rotating the rearward rail support 489 to withdraw its lower end from the earthen floor 422, and sliding the rearward rail support 489 out of the vertical cavity of the clamp 490. The rearward rail clamp 490 is detached from the rail 460 by removing the nut and bolt and withdrawing the attachment plate of the clamp 490 from the slot 477.

Figure 16:
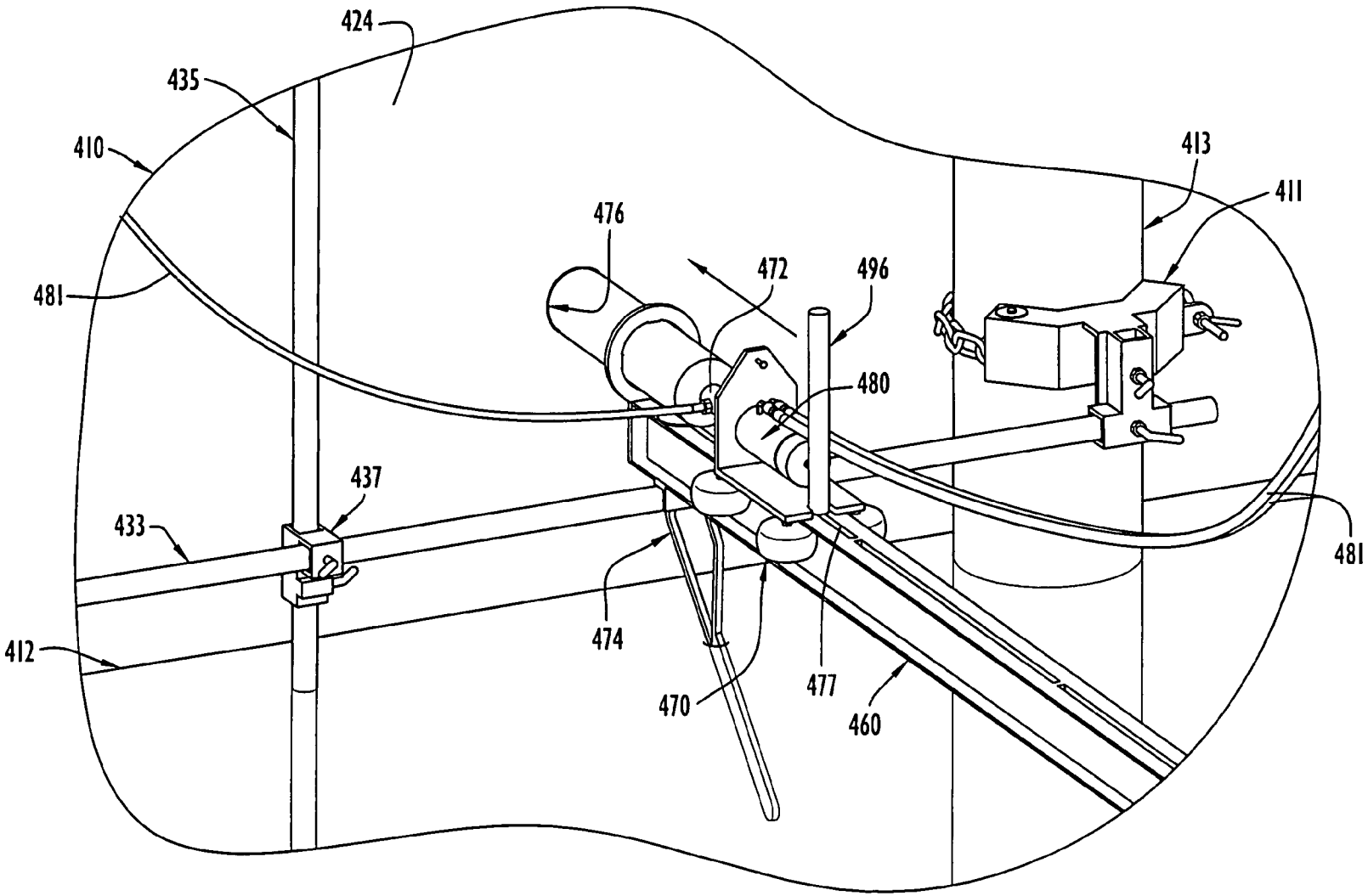
FIG. 16 is a broken perspective view of the seawall of FIG. 13 depicting formation of a passage in the seawall using the installation machine.
Figure 17:
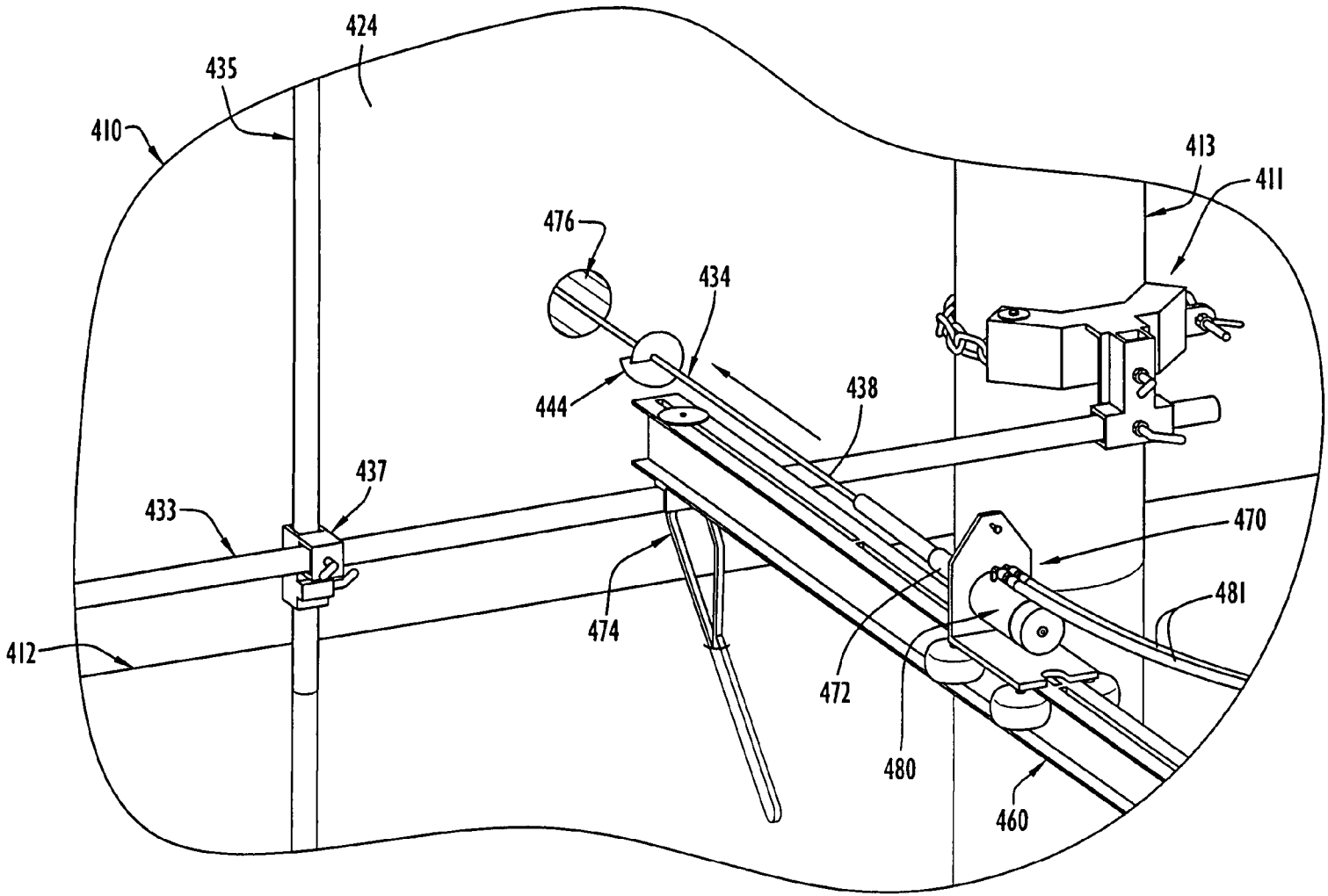
FIG. 17 is a broken perspective view of the seawall of FIG. 16 illustrating insertion of an anchoring member of an anchoring device through the passage using the installation machine.

Once the rail 460 has been supported by the forward and rearward rail support assemblies over the earthen floor 422 with the installation axis extending through the seawall 410 from the water facing side to the earth facing side at the selected vertical and lateral angles, the anchoring device installation system can be used to install an anchoring device in the seawall 410. FIGS. 16-19 illustrate a method of installing an anchoring device 432 in the seawall 410 utilizing the installation system, the anchoring device 432 being shown disassembled in FIG. 20 and fully installed on the seawall in FIG. 21. The installation method involves forming a passage 476 in the seawall 410 coaxial with the installation axis using installation machine 470. In order to form the passage 476 in the seawall 410 of appropriate cross-sectional size to accommodate the anchoring member 434 of the anchoring device 432 therethrough, an appropriate size drill bit is coupled coaxially with the drive shaft 472 as depicted in FIGS. 13 and 16 and as already explained above. The installation machine 470 guided by the track 475 is moved along the rail 460 in the direction of seawall 410 and, as shown in FIG. 16, a pushing device 496 may be associated with the installation machine 470 for use in manually pushing the installation machine 470 in the direction of the seawall 410. The pushing device 496 comprises a push handle having a lower end engageable in a notch in the base of carriage 479 and may be used to apply a pushing force to the carriage to force the drill bit against the seawall 410 with the appropriate amount of force or pressure to core through the seawall without binding. Of course, the push handle could be engaged with the rail 460 for movement along the rail or its slot 477. An alternative pushing device which optimizes the application of pressure on the installation machine is described below and can be used with the installation machine 470. The motor 480 of installation machine 470 is actuated to rotate the drive shaft 472 and the drill bit. As the drill bit is pushed against the seawall 410 with an appropriate amount of force, a passage 476 is formed in the seawall originating on its water facing side 424 as shown in FIGS. 16 and 17. The installation machine 470 is moved towards the seawall 410 the appropriate distance to form passage 476 to the appropriate depth, preferably through the entire thickness of the seawall 410 as explained above. The passage 476 is formed coaxial with the installation axis along which the drive shaft 472 moves longitudinally as the installation machine 470 moves longitudinally along the rail 460. Since the installation axis is parallel to the central longitudinal axis of the rail 460 with there being a determinable distance between the two axes, the rail positioning described previously above can be calculated for the drill bit to enter and originate the passage 476 on the water facing side 424 at a selected location, and for the passage to extend through the seawall at the selected vertical and lateral angles.

Figure 18:
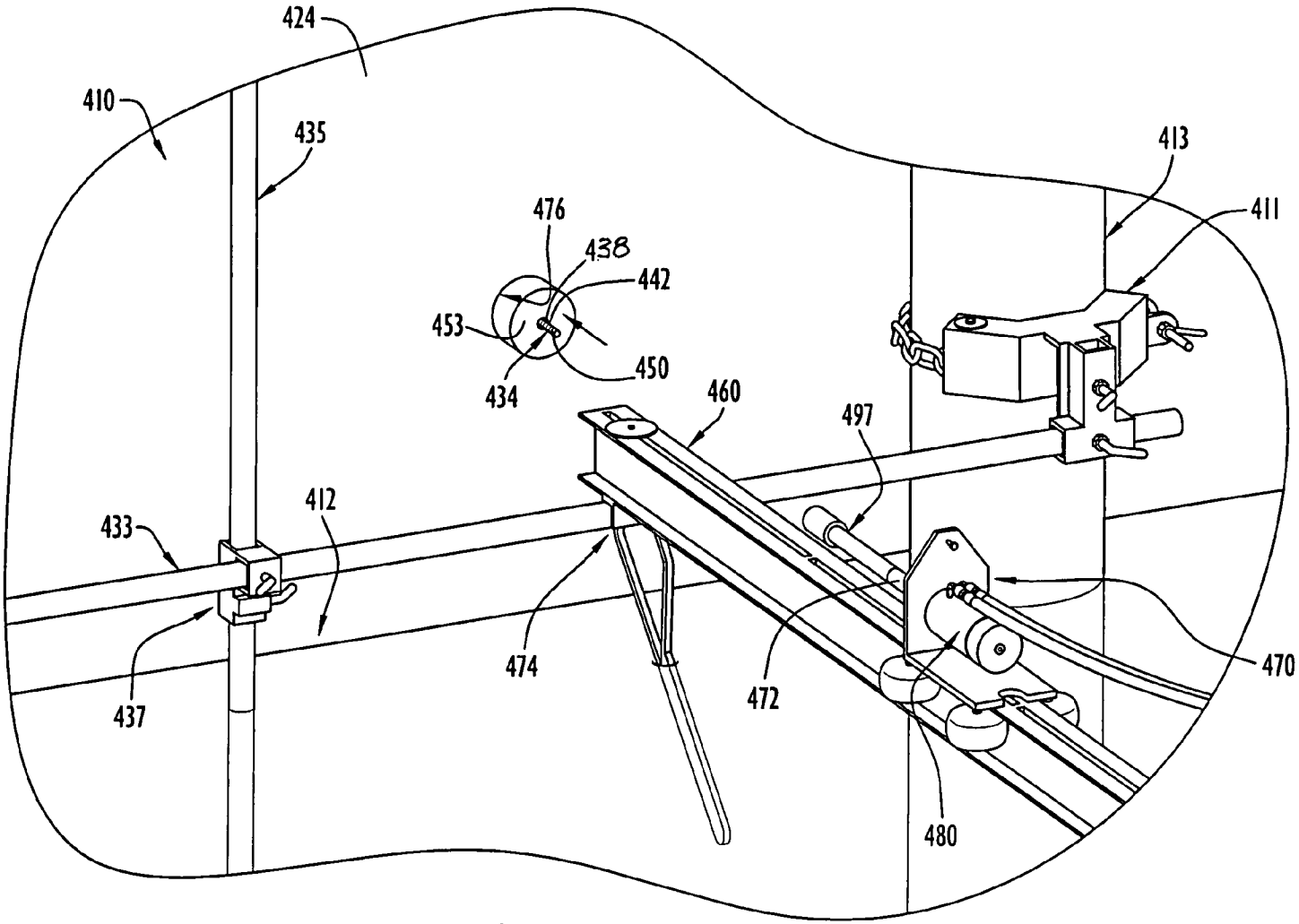
FIG. 18 is a broken perspective view of the seawall of FIG. 17 showing insertion of a plug member of the anchoring device in the passage around the anchoring member.

Once the passage 476 has been formed in the seawall 410, the drill bit is withdrawn from the seawall 410 by moving the installation machine 470 along the rail 460 toward the rearward end of the rail, i.e. in the direction away from the seawall 410. The drill bit is removed from the drive shaft 472, and the rearward end of the shaft 438 of anchoring member 434 is coupled with the drive shaft coaxially as depicted in FIG. 17. Any suitable coupling may be used as needed to couple the anchoring member 434 with the drive shaft 472. The installation machine 470 is again moved along rail 460 toward the seawall 410, causing the forward end of the anchoring member 434 to enter the passage 476 in the seawall. The installation machine 470 can be pushed along the rail 460 in the direction of the seawall 410 using the pushing device 496, which is not shown in FIG. 17 for the sake of simplicity, to push the anchoring member 432 through the seawall and into the retained earth on the earth facing side of the seawall with an appropriate amount of force to ensure that the anchor 444 begins to rotate properly into the earth when the motor 480 is actuated to rotate the drive shaft 472 and the anchoring member. As the installation machine 470 is moved in the direction of seawall 410, the helical formation forming the anchor 444 of the anchoring member 434 is rotatably driven into the earth 414 on the earth facing side of the seawall as depicted in FIG. 21 and as described above for anchoring member 34. The anchoring member 434 is illustrated in FIG. 21 as having more than one anchor 444 each comprising a helical formation. The helical formations comprising the anchors 444 promote longitudinal movement of the anchoring member 434 into the retained earth 414 as it is rotated by the drive shaft 472. The anchoring member 434 will be moved longitudinally into the earth 414 at the selected vertical and lateral angles as explained above and, once the anchoring member 434 has been introduced into earth 414 to the appropriate depth, its rearward end 442 is detached from the drive shaft 472. As shown in FIG. 18, a portion of the anchoring member rearward end 442 having engagement structure 450, such as an external thread, extends from the passage 476 on the water facing side 424 of seawall 410.

If, during introduction of the anchoring member 434 into the earth 414, an obstacle is encountered in the earth 414 which prevents the anchoring member from being introduced to a suitable depth, the anchoring member 434 can be withdrawn from the earth 414 and passage 476 and can be reintroduced through the passage 476 at a different vertical angle and/or lateral angle to avoid the obstruction. If necessary, the passage 476 can be enlarged to accommodate introduction of the anchoring member 434 at a different vertical angle and/or lateral angle. Alternatively, it would be possible to form the passage 476 initially of large enough cross-sectional size to allow some room for the anchoring member to be introduced non-coaxially through the passage at a vertical angle and/or lateral angle different from the vertical angle and/or lateral angle of the passage. In order to reintroduce the anchoring member 434 through the passage 476 at a different vertical angle and/or lateral angle, the position of rail 460 is adjusted as needed to position the installation axis at the different vertical angle and/or lateral angle.

The anchoring device installation method utilizing the anchoring device installation system may include insertion of a filler or plug into the gap or space in passage 476 surrounding the shaft 438 of the anchoring member 434 as described above for anchoring member 134. Accordingly, the anchoring device 432 can include a plug member 453 best depicted in FIG. 20. FIG. 18 illustrates the plug member 453 placed on the shaft 438 of anchoring member 434 by inserting the rearward end 442 of the shaft, which extends from the opening 476 on the water facing side 424 of the seawall, through the lumen 455 of the plug member. A drive tool 497, such as a hollow shaft device, can be coupled coaxially with the motor drive shaft 472 for use in driving or pushing the plug member 453 into the passage 476 as shown by the arrow in FIG. 18 when the installation machine 470 is moved along the rail 460 in the direction of the seawall 410. Where the plug member 453 can be introduced into the passage 476 by longitudinal movement alone, it is not necessary for the drive shaft 472 and drive tool 497 to be rotated. In the latter case, the drive tool 497 can be used to push the plug member 453 longitudinally as a result of longitudinal movement of the installation machine 470 toward the seawall with the forward end of the drive tool in contact with the plug member. The end 442 of the anchoring member shaft can enter the interior of the drive tool 497 in order to establish and maintain contact between the drive tool 497 and the plug member 453 as the installation machine 470 is moved toward the seawall. Where the plug member 453 is designed to be rotationally introduced into the passage 476, for example where the lumen 455 of the plug member is threadedly engaged with the thread forming the engagement structure 450 on the rearward end 442 of the anchoring member shaft as described for anchoring device 132, the drive shaft 472 can be rotated to rotate the drive tool 497 to impart rotation to the plug member 453. If needed, the drive tool 497 can include any suitable coupling for releasably connecting the drive tool to the plug member 453 to impart longitudinal and/or rotational movement to the plug member from the drive tool. Of course, the plug member 453 could be placed on the rearward end 442 of the anchoring member 434 and/or introduced in the passage 476 by hand, without the use of installation machine 470.

Figure 19:
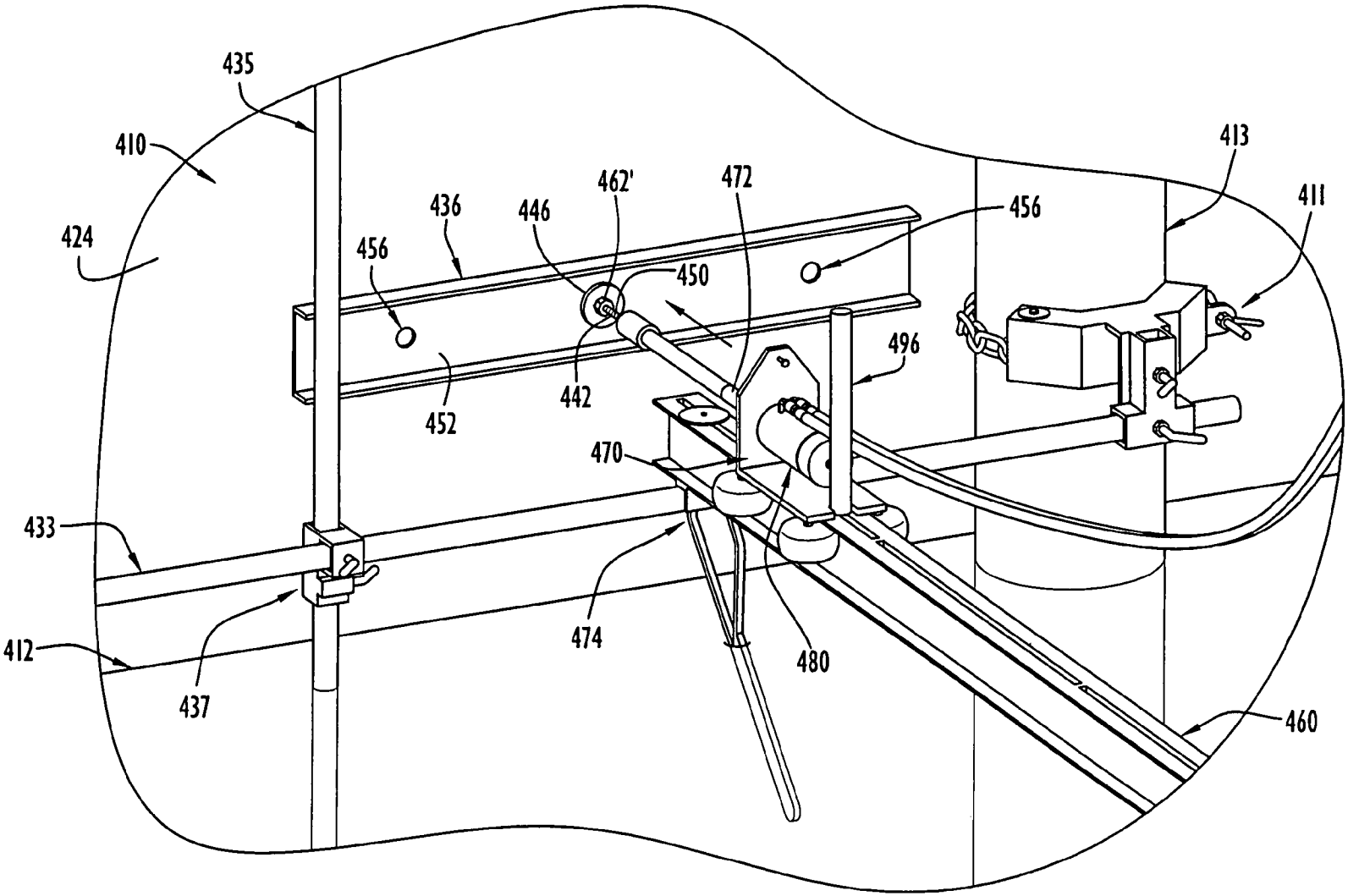
FIG. 19 is a broken perspective view of the seawall of FIG. 18 with a retaining member of the anchoring device assembled on an end of the anchoring member and illustrating securement of the retaining member on the end of the anchoring member.
Figure 20:
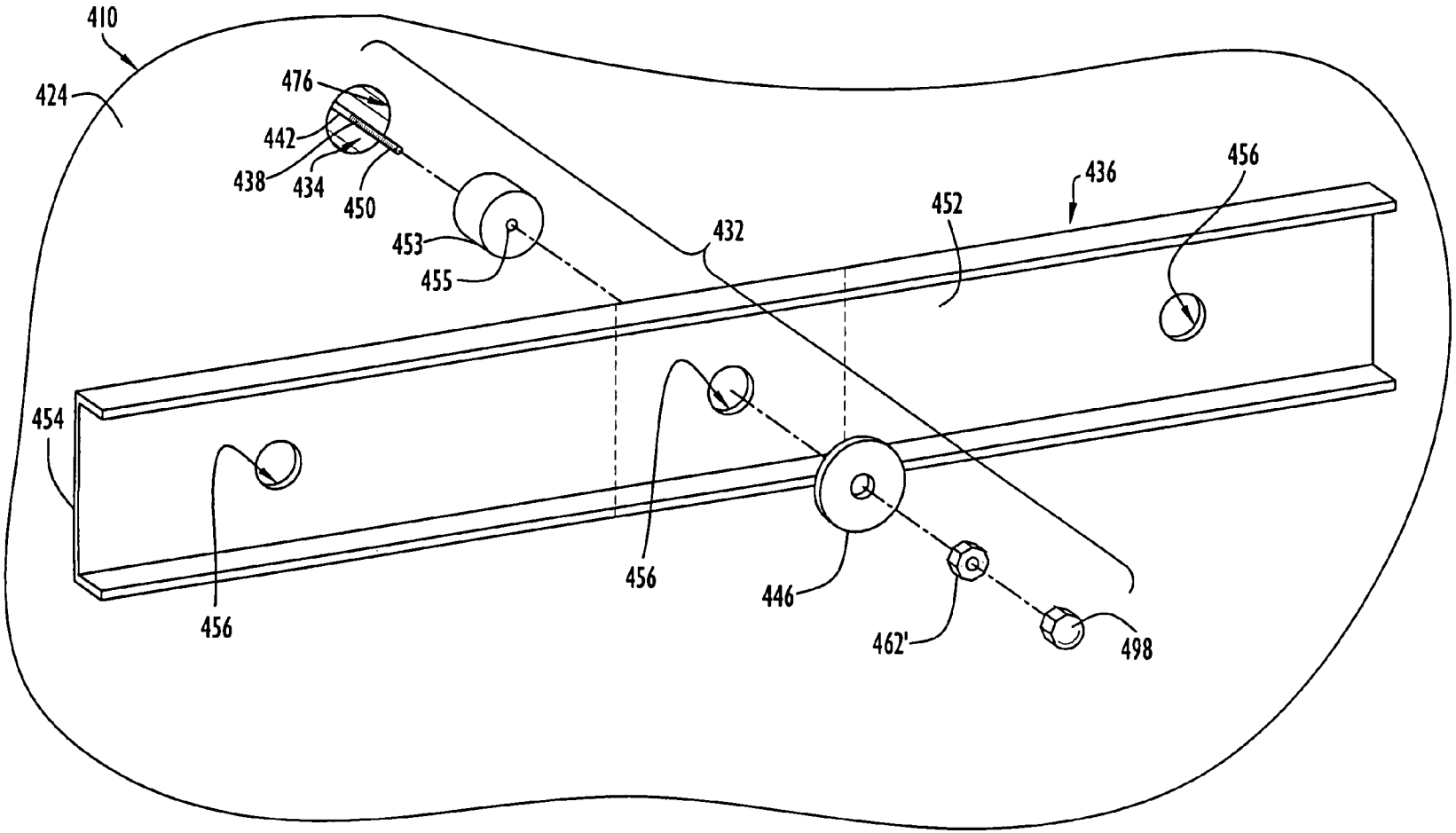
FIG. 20 is an exploded perspective view of the anchoring device of FIGS. 17-19.

Once the plug member 453 is inserted far enough into the passage 476 so that it does not protrude beyond the water facing side 424 of seawall 410, the installation machine 470 is backed away from the seawall 410 allowing the retaining member 436 of the anchoring device 432 to be placed on the rearward end 442 of the anchoring member 434 which extends from the plug member beyond the water facing side of the seawall. The retaining member 436 is placed on the anchoring member 434 by inserting the rearward end 442 of the anchoring member through a bore hole 456 in the flange 452 of the retaining member. As shown in FIGS. 19 and 20, the retaining member 436 can have more than one bore hole 456 so that the same retaining member 436 can serve as the retaining member for more than one anchoring device. A washer plate 446 of the anchoring device 432 is placed on the rearward end 442 of anchoring member 434 that extends from the bore hole 456 of the retaining member 436 on the water facing side 424 of the seawall by inserting the end 442 through an aperture in the washer plate. The flange 452 of the retaining member 436 will thusly be disposed between the washer plate 446 and the water facing side 424 of the seawall. A securing member 462' of the anchoring device 432 is secured to the engagement structure 450 on the rearward end 442 that extends from the aperture of the washer plate 446 on the water facing side 424 of the seawall. The securing member 462' can be a nut threadedly engaged with the thread comprising the engagement structure 450 and advanced a sufficient distance along the shaft 438 to force the washer plate 446 against the flange 452 so that the forward abutment surface 454 of the flange 452 is forced against the water facing side 424 of the seawall. Since the anchors 444 resist withdrawal of the anchoring member 434 from the earth 414, tension is produced in the anchoring member and compression is produced against the seawall 410 as explained for the anchoring devices already described above.

As shown in FIG. 19, the installation machine 470 can be used to secure the securing member 462' on the end 442 of the anchoring member 434 by rotating the securing member 462' in threaded engagement on the end 442 an amount sufficient to generate selected tension in the anchoring member and compression against the seawall. As an example of how the installation machine 470 can be used for this purpose, a socket member having a socket configuration to mate with the securing member 462' in rotational engagement is mounted on the end of drive tool 497 coaxially therewith, and the securing member 462' is placed in the socket. The installation machine 470 is moved longitudinally along the rail 460 toward the seawall 410, causing the rearward end 442 of the anchoring member shaft to align with the hole in the nut comprising the securing member 462'. The drive shaft 472 is rotated to drive the socket member rotationally to effect rotation of the securing member 462' in threaded engagement with the external thread comprising the engagement structure 450 on the rearward end 442. As the securing member 462' is threadedly advanced on the rearward end 442, the rearward end 442 can enter the interior of the socket member and drive tool. The securing member 462' is rotationally advanced a sufficient distance along the shaft 438 to obtain the selected tension in anchoring member 434 and the selected compression against seawall 410 in accordance with site specific conditions as explained above for the previously described anchoring devices. Alternatively, securing member 462' can be placed on end 442 and/or can be initially threaded onto end 442 by hand, with the installation machine 470 being used to complete the threaded advancement of the securing member 462' on the end 442 to obtain the selected tension and compression. Once the securing member 462' has been threadedly advanced on the end 442 the required distance, the installation machine 470 is moved away from the seawall 410 along rail 460 causing the socket member to be released from the securing member 462'.

The anchoring device 432 includes an end cap 498 which is placed over the end 442 of the anchoring member 434 that extends from the securing member 462' along the water facing side 424 of the seawall. The end cap 498 has a closed rearward end with a blunt configuration and has an open forward end to accommodate the securing member 462' within the end cap. The end cap 498 can be placed over the end 442 of the anchoring member and removably secured to the end 442 and/or the securing member 462' in various ways including an interference fit, a snap-on fit, or various mechanical components. Securement of the end cap 498 to the end 442 of anchoring member 434 can be accomplished, for example, by providing the end cap with an internal thread for engagement with the external thread forming the engagement structure 450 on end 442. Securement of the end cap 498 to the securing member 462' can be accomplished, for example, by providing the open forward end of the end cap with a configuration to engage with the securing member 462' via an interference fit or a snap-on fit. The end cap 498 can be assembled on the end 442 with or without use of the installation machine 470. The installation machine 470 can be used to assemble the end cap 498 on the end 442 by mounting the end cap coaxially on the drive tool 497 with the open forward end of the end cap facing the seawall 410 and advancing the installation machine along rail 460 toward the seawall so that the end 442 of the anchoring member enters the end cap 498. The drive shaft 472 can be rotated where it is necessary to rotate the end cap 498 on the end 442 in order to secure the end cap to the end 442 and/or the securing member 462'. Once the end cap 498 is secured over the end 442, the installation machine 470 can be backed away from the seawall 410 along the rail 460 to release the end cap from the drive tool 497. It should be appreciated that the length of end 442 extending from the securing member 462' can be trimmed as needed to fit within the end cap 498 so that the forward end of end cap 498 can be placed adjacent or close to and preferably in abutment with the washer plate 446. It should also be appreciated that the end 442 protruding along the water facing side 424 of seawall 410 can be trimmed at any other point in the installation method described above as needed or desirable to facilitate installation of any one or more components of the anchoring device 432 on the seawall 410 using the installation system.

If only one anchoring device 432 is to be installed on seawall 410, the installation system can be dismantled following installation of the anchoring device. If additional anchoring devices are to be installed on seawall 410, the installation system can be used to install the additional anchoring devices. An additional anchoring device can be installed on seawall 410 at a location on the water facing side 424 spaced in the horizontal direction from the anchoring device 432 by moving the forward end of rail 460 along the forward rail support 433 so that the installation axis is at the desired horizontally spaced location. An additional anchoring device can be installed on seawall 410 at a location on the water facing side 424 spaced in the vertical direction from the anchoring device 432 by adjusting the height of the forward rail support 433 so that the installation axis is at the desired vertically spaced location. The vertical and lateral angles selected for the additional anchoring device to be installed on seawall 410 at a laterally horizontally spaced and/or vertically spaced location from anchoring device 432 can be established by positioning the rail 460 as explained above. Of course, the forward and/or rearward rail support assemblies can be dismantled and reassembled at a different location along the seawall, for example when an additional anchoring device is to be installed at a horizontally spaced location from anchoring device 432 that is beyond the horizontal range afforded by the length of the forward rail support 433.

FIG. 21 illustrates the anchoring device 432 following installation on seawall 410. The anchoring member 434 of anchoring device 432 has been installed with its central longitudinal axis L defining a vertical angle A of 90° with plane P of seawall 410 and is thusly representative of an anchoring member installed so that the central longitudinal axis L is contained in the horizontal plane Ph perpendicular to the plane P of the seawall. The anchoring member 434 is thusly representative of an anchoring member installed with a neutral vertical angle. Seawall 410 is depicted in FIG. 21 with additional anchoring devices 32 and 32' also installed thereon. The anchoring members 34 of the anchoring devices 32 and 32' are each installed on seawall 410 with its central longitudinal axis L defining an angle A less than 90° with plane P. The anchoring members 34 are each thusly representative of an anchoring member installed at a downward vertical angle to plane P.

The anchoring device 432 is seen in FIG. 20 to be similar to the anchoring devices 32 and 132 except for the anchoring member 434 having the plurality of anchors 444, the retaining member 436 having upper and lower parallel flange segments perpendicular to flange 452, the retaining member 436 having a plurality of bore holes 456 to serve as the retaining member for more than one anchoring member, and the anchoring device 432 including the washer plate 446 and the end cap 498. As best seen in FIGS. 20 and 21, the retaining member 436 may be a channel member of generally C-shaped cross-section of suitable length to serve as the retaining member for more than one anchoring device. However, the channel member could be of shorter length to serve as the retaining member for only one anchoring device as depicted by dotted lines in FIG. 20. The upper and lower parallel flange segments of the retaining member 436 are perpendicular to the flange 452 and extend perpendicular to plane P of seawall 410 in a direction away from the water facing side 424 when the forward abutment surface 454 of flange 452 is in contact with the water facing side 424 along plane P. The upper and lower parallel flange segments of the retaining member 436 provide greater load bearing capacity and impart added strength and rigidity to the installed anchoring device 432. The axes of bore holes 456 through flange 452 are perpendicular to the forward abutment surface 454 as described above for retaining member 136 but could be non-perpendicular to the forward abutment surface as described above for retaining member 36. The anchoring device 432 can be provided and used with or without the plug member 453, the washer plate 446 and/or the end cap 498. The plug member 453 is advantageous to seal the passage 476 around the shaft 438 of the anchoring member 434 and to assist in centering and supporting the shaft 438 of the anchoring member in the passage. The washer plate 446 is advantageous as it provides better compressive force distribution against the flange 452 from securing member 462'. The end cap 498 is desirable because it shields the end 442 of the anchoring member 434 that protrudes from the securing member 462' and reduces the risk of damage to people or objects coming into contact with parts of the anchoring device which protrude or are exposed along the water facing side 424 of the seawall.

Like the other anchoring devices described above, the anchoring device 432 can be installed on seawall 410 at any location above or below the surface of water 412. The anchoring device 432, like the other anchoring devices described above, is completely disassemblable for partial or complete removal from the seawall 410. Like the anchoring devices already described above, the installed anchoring device 432 can be used to monitor for changes in seawall 410 over time by providing a visually detectible indication of anchoring device and/or seawall displacement potentially indicative of seawall instability. Also, torque, tension and compression measurements can be periodically taken of the installed anchoring device 432 and compared with measurements taken previously. Once changes indicative of seawall instability are detected, the anchoring device 432 as well as the other anchoring devices described above can be adjusted to apply the appropriate tension and compression needed to counteract the instability. Adjustments of any of the anchoring devices may include adjusting the tension and compression without removing the anchoring member, removing and reinserting the anchoring member, or removing the anchoring member and replacing it with a different anchoring member. Anchoring members and other components of the anchoring devices which have been removed can be reused. The components of the anchoring devices are preferably made of marine-grade materials having a long life expectancy. The anchoring devices are preferably made entirely or predominantly of marine-grade type 304 stainless steel.

One type of damage or instability that may occur in seawalls is represented in dotted lines in FIG. 21 and is known as "toe out", where the toe portion 420 of the seawall 410 has shifted or displaced outwardly in a direction away from the retained earth 414 as indicated by an arrow. Toe out may occur due to the toe portion 420 being insufficiently embedded in the earthen floor 422 and is a common problem with seawalls in some if not all geographic areas. According to the present invention, immediate relief of stress in the seawall 410 to avoid toe out is accomplished by installing one or more anchoring devices in the seawall at a location above the earthen floor 422 but close to or near the surface or mud line of the earthen floor 422. This is illustrated in FIG. 21 which depicts the anchoring device 32' installed on seawall 410 just above the surface or mud line of earthen floor 422 to provide immediate relief of stress on the seawall 410 and to avoid toe out by arresting movement of the toe portion 420 in a direction away from the retained earth.

Figure 22:
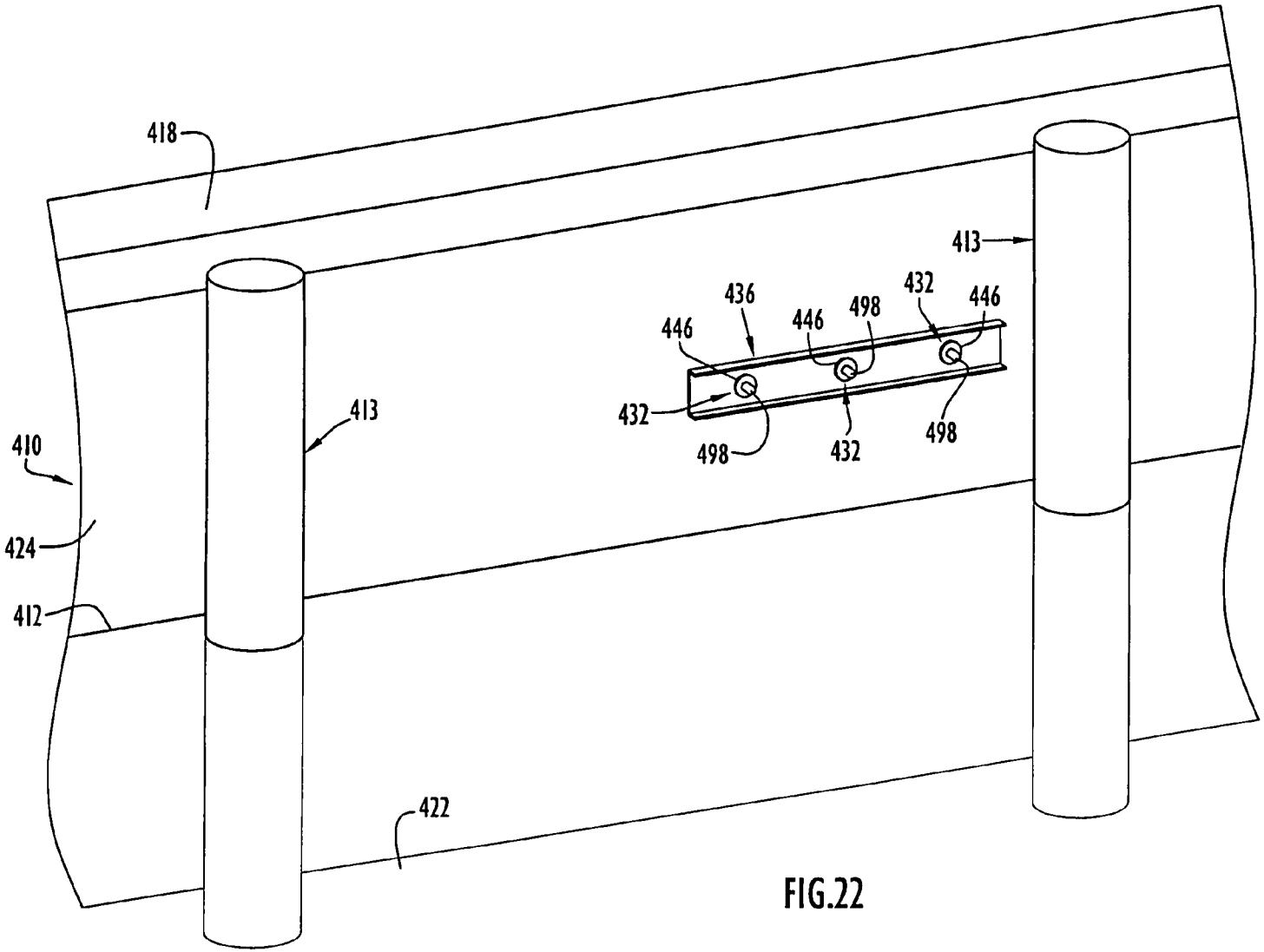
FIG. 22 is a broken perspective view of the seawall of FIG. 19 with the anchoring device of FIG. 20 installed thereon and depicting use of the retaining member of the anchoring device as the retaining member for a plurality of anchoring devices installed on the seawall.

FIG. 22 illustrates the retaining member 436 on seawall 410 serving as the retaining member for a plurality of anchoring devices 432 installed on seawall 410 with the anchoring members respectively extending through the bore holes 456 of the retaining member 436. The plurality of anchoring devices 432 having the single retaining member 436 serving as the retaining member for the entire plurality of anchoring devices may be installed on seawall 410 above or below the surface of the water 412 using the installation system described above. The anchoring devices 432 sharing the common retaining member 436 can be installed using an anchoring device installation method similar to that described above except that all of the anchoring members will ordinarily be installed through the seawall prior to the retaining member 436 being placed and secured on the rearward ends of the anchoring members that extend from the water facing side 424 of the seawall 410. In order to form passages in the seawall 410 for insertion of the anchoring members at locations where the rearward ends of the anchoring members will line up with the respective bore holes 456 of the retaining member 436, the forward end of rail 460 need only be moved horizontally along the forward rail support 433 a distance corresponding to the horizontal distance between the bore holes 456. When the retaining member 436 is used as the retaining member for more than one anchoring device, the anchoring members of the anchoring devices are rigidly interconnected by the retaining member in a manner similar to that described above for anchoring devices 232*a*, 232*b* and 232*c*.

Figure 23:
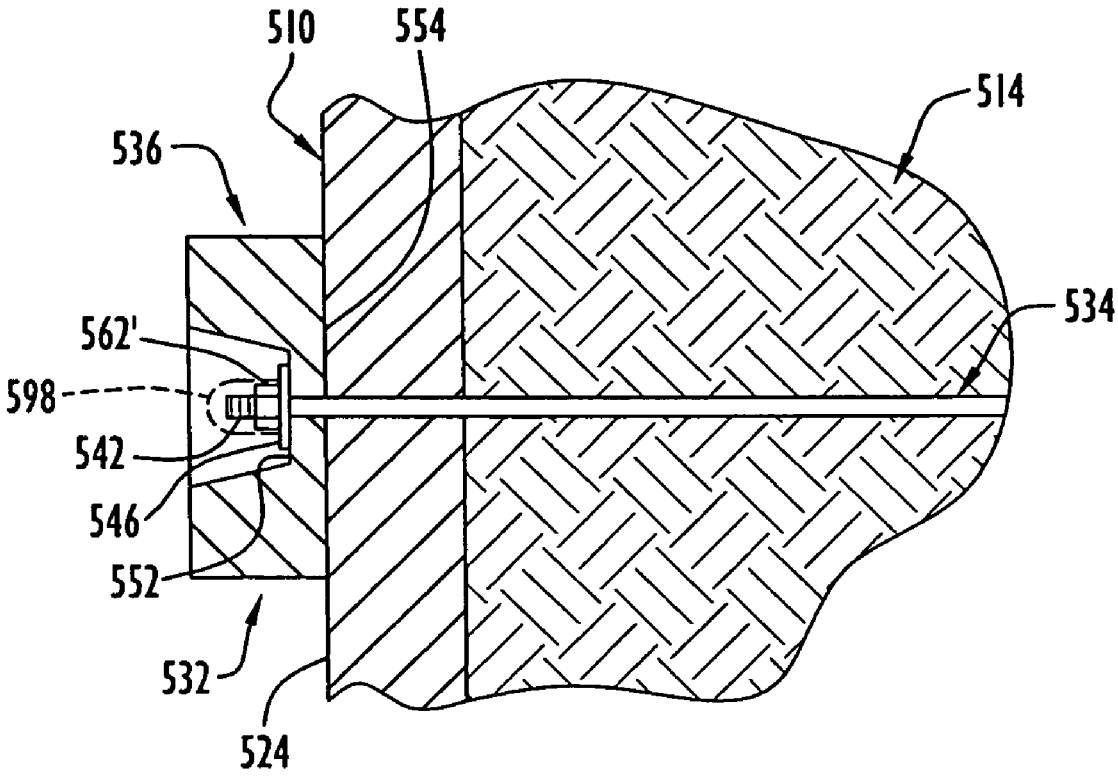
FIG. 23 is a broken side view, partly in section, of a modified anchoring device of the present invention installed on a seawall.

FIG. 23 illustrates an alternative anchoring device 532 installed on seawall 510. The anchoring device 532 is representative of an anchoring device where the rearward end 542 of the anchoring member 534, with or without the end cap 598 assembled thereon, does not protrude or extend beyond a rearward face of the retaining member 536 along the water facing side 524 of the seawall. The rearward face of the retaining member 536 is opposite the forward abutment surface 554 of flange 552 which bears against the water facing side 524 of the seawall 510. The flange 552 of the retaining member 536 has a rearward surface opposite the forward abutment surface 554 and against which the securing member 562' applies compressive force via washer plate 546. The rearward surface of flange 552 is recessed relative to the rearward face of the retaining member 536. Accordingly, the washer plate 546, the securing member 562' and the end 542 of the anchoring member 534 which extends from the securing member are all disposed in a recess of the retaining member 536 and do not protrude beyond the rearward face of the retaining member along the water facing side 524 of seawall 510. If the anchoring device 532 is provided with an end cap 598, the end cap is also disposed in the recess and does not protrude beyond the rearward face of the retaining member 536 as shown in dotted lines in FIG. 23. Where the end cap 598 is not provided, the end 542 of the anchoring member 534 can be flush with the rearward face of the retaining member 536 and, where the end cap 598 is provided, the rearward end of the end cap can be flush with the rearward face of the retaining member. For greater continuity along the rearward face of the retaining member 536, the rearward end of end cap 598 can be provided with a configuration to fill or substantially fill the recess along the rearward face of the retaining member so that the rearward face of the retaining member and the rearward end of the end cap cooperate to form an essentially continuous, uniform surface. The surface formed by the rearward face of the retaining member 536 and the rearward end of the end cap 598 may be planar. Any of the other anchoring devices described above can be provided with a retaining member similar to retaining member 536.

Figure 24:
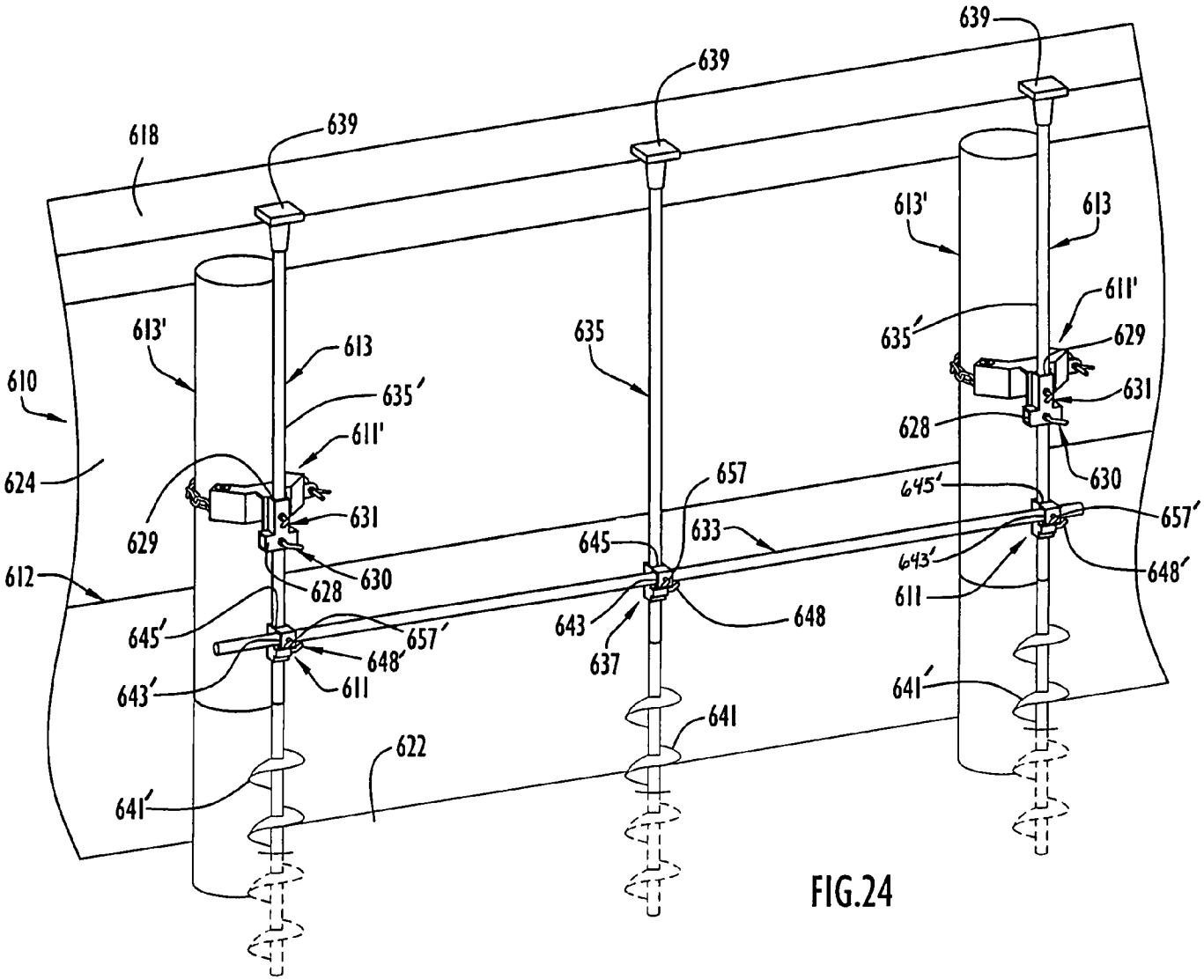
FIG. 24 is a broken perspective view of a modified installation system of the present invention having alternative fixation structure for fixating the forward rail support.

FIG. 24 depicts an installation system where the forward rail support fixation structure is different than that shown for the installation system depicted in FIG. 11. The forward vertical support members 613 for the alternative forward rail support fixation structure illustrated in FIG. 24 are not vertical pilings but, rather, comprise forward vertical support bars 635'. Also, the forward rail support clamps 611 for the alternative forward rail support fixation structure, which secure the opposite ends of the forward rail support 633 to the forward vertical support members 613, are not piling clamps. The vertical support bar 635' for each forward vertical support member 613 is similar to the vertical support bar 435 described above and has a lower end with a penetrating formation 641' for being driven or secured to the earthen floor 622 and an upper end provided with a removable shield plate 639. Each forward rail support clamp 611 is similar to the stabilizer clamp 437 and has a horizontal passage 643' and a vertical passage 645' with respective locking devices 648' and 657' . The forward rail support fixation structure of FIG. 24 optionally includes a stabilizer comprising a vertical support bar 635 and a stabilizer clamp 637 similar to the stabilizer described and illustrated in connection with FIG. 11.

In an anchoring device installation method utilizing the alternative forward rail support fixation structure of FIG. 24, each forward vertical support member 613, i.e. vertical support bar 635', is assembled to a forward rail support clamp 611 by inserting the forward vertical support member 613 end first into the vertical passage 645' of the clamp 611 with the locking member of locking device 657' sufficiently retracted from the vertical passage for accommodation of the forward vertical support member 613 therein. The lower ends of the forward vertical support members 613 which extend from the clamps 611 are respectively driven into the earthen floor 622 as described above for the vertical support bar 435. The lower ends of the forward vertical support members 613 are driven into the earthen floor 622 spaced from the water facing side 624 of seawall 610 so that the central longitudinal axes of the forward vertical support members 613 are parallel or substantially parallel to one another and perpendicular or essentially perpendicular to the earthen floor 622. Ordinarily the forward vertical support members 613 will also be parallel or substantially parallel to a plane of seawall 610. The forward vertical support members 613 will be spaced from one another along the length of the seawall 610 so that opposite ends of the forward rail support 633 can be received in the horizontal passages 643' of clamps 611. The forward vertical support members 613 will be secured to the earthen floor 622 by virtue of the penetrating formations 641' resisting withdrawal from the earthen floor 622. The forward rail support clamps 611 can be moved longitudinally upwardly or downwardly along the forward vertical support members 613 and locked in place on the forward vertical support members 613 via the locking devices 657' with the horizontal passages 643' of the clamps 611 in longitudinal alignment with each other at a selected location along the height of seawall 610 for the forward rail support 633. The forward rail support 633, which is similar to the forward rail support 433, is introduced in the horizontal passages 643' of the clamps 611 in a manner similar to that described above for introduction of the forward rail support 433 in the horizontal channels 428 of the clamps 411. The locking members of locking devices 648' may be sufficiently retracted from the horizontal passages 643' to ensure accommodation of the forward rail support 633 therein. Once the opposite ends of the forward rail support 633 are respectively received in the horizontal passages 643' of the clamps 611, the forward rail support 633 is secured to the clamps 611 via the locking devices 648' so that the forward rail support 633 is perpendicular or substantially perpendicular to the forward vertical support members. Where the stabilizer is provided, its vertical support bar 635 and stabilizer clamp 637 can be assembled to the forward rail support 633 in a manner similar to that described above for vertical support bar 435 and stabilizer clamp 437 so that the stabilizer is clamped to the forward rail support 633 at a selected location between the forward vertical support members 613.

In order to prevent the forward vertical support members 613 from moving away from the seawall 610 and thereby prevent the forward rail support 633 from moving away from the seawall, the forward vertical support members 613 can be respectively coupled to existing vertical pilings 613' disposed on the water facing side of the seawall 610 as described for seawall 410. Piling clamps 611', which are similar to the forward rail support clamps 411, can be used to clamp the forward vertical support members 613 to the respective pilings 613'. Accordingly, the anchoring device installation method may involve securing the piling clamps 611' on the pilings 613' as described above for clamps 411 and, prior to driving the lower ends of the forward vertical support members 613 into the earthen floor 622, inserting the forward vertical support members 613 end first into the vertical channels 629 of the piling clamps 611'. The locking members for the locking devices 631 for the vertical channels 629 of the piling clamps 611' may be retracted as necessary from the vertical channels 629 to ensure sufficient room in the vertical channels 629 for accommodation of the forward vertical support members 613 therein. The forward vertical support members 613 would ordinarily be inserted, lower ends first, into the tops of the vertical channels 629 and, after the lower ends of the forward vertical support members 613 have exited the bottoms of the vertical channels 629, the lower ends will be passed respectively through the vertical passages 645' of the clamps 611 and driven into the earthen floor 622. Once the forward vertical support members 613 have been driven into the earthen floor 622 a sufficient depth, the locking devices 631 are used to lockingly engage the forward vertical support members 613 in the vertical channels 629. Preferably, the piling clamps 611 are located on the pilings 613' so that upper portions of the forward vertical support members 613 will be clamped to the pilings. In this manner, the forward vertical support members 613 are constrained from moving away from the seawall at their upper portions and at their lower portions for enhanced restraint, balance and support.

The forward rail support fixation structure of FIG. 24 allows the height of the forward rail support 633 along the seawall 610 to be selectively adjusted by moving the forward rail support clamps 611 along the forward vertical support members 613. Height adjustments for the forward rail support 633 are thusly independent of the height of the existing pilings 613', and the forward rail support fixation structure of FIG. 24 can be used with seawalls that do not have existing pilings along their water facing side. Where pilings 613' are unavailable as a means to prevent movement of the forward vertical support members 613 away from the seawall, the forward vertical support members 613 can be clamped directly to the seawall as described further below.

Figure 25:
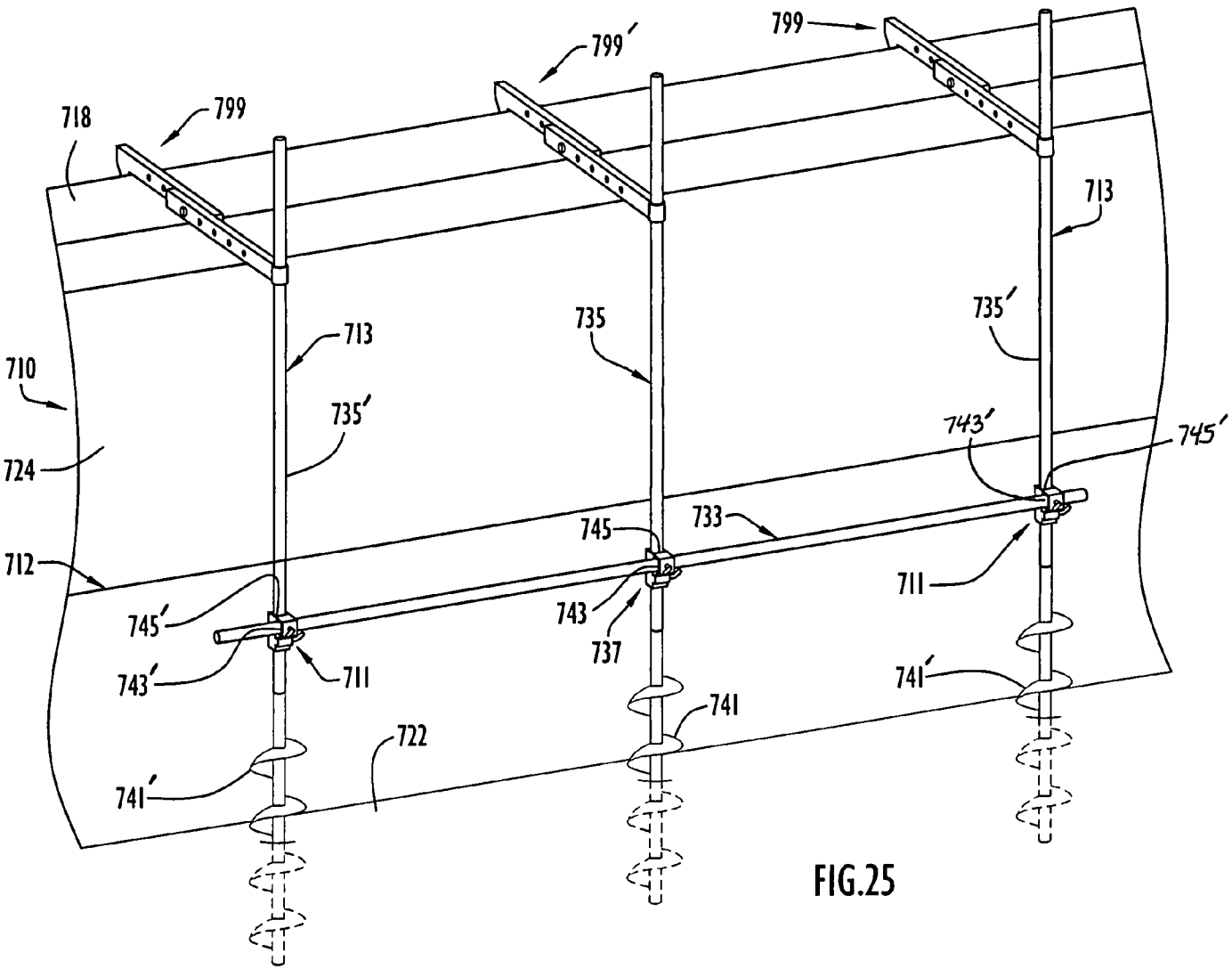
FIG. 25 is a broken perspective view of another modified installation system of the present invention having further alternative fixation structure for fixating the forward rail support.
Figure 26:
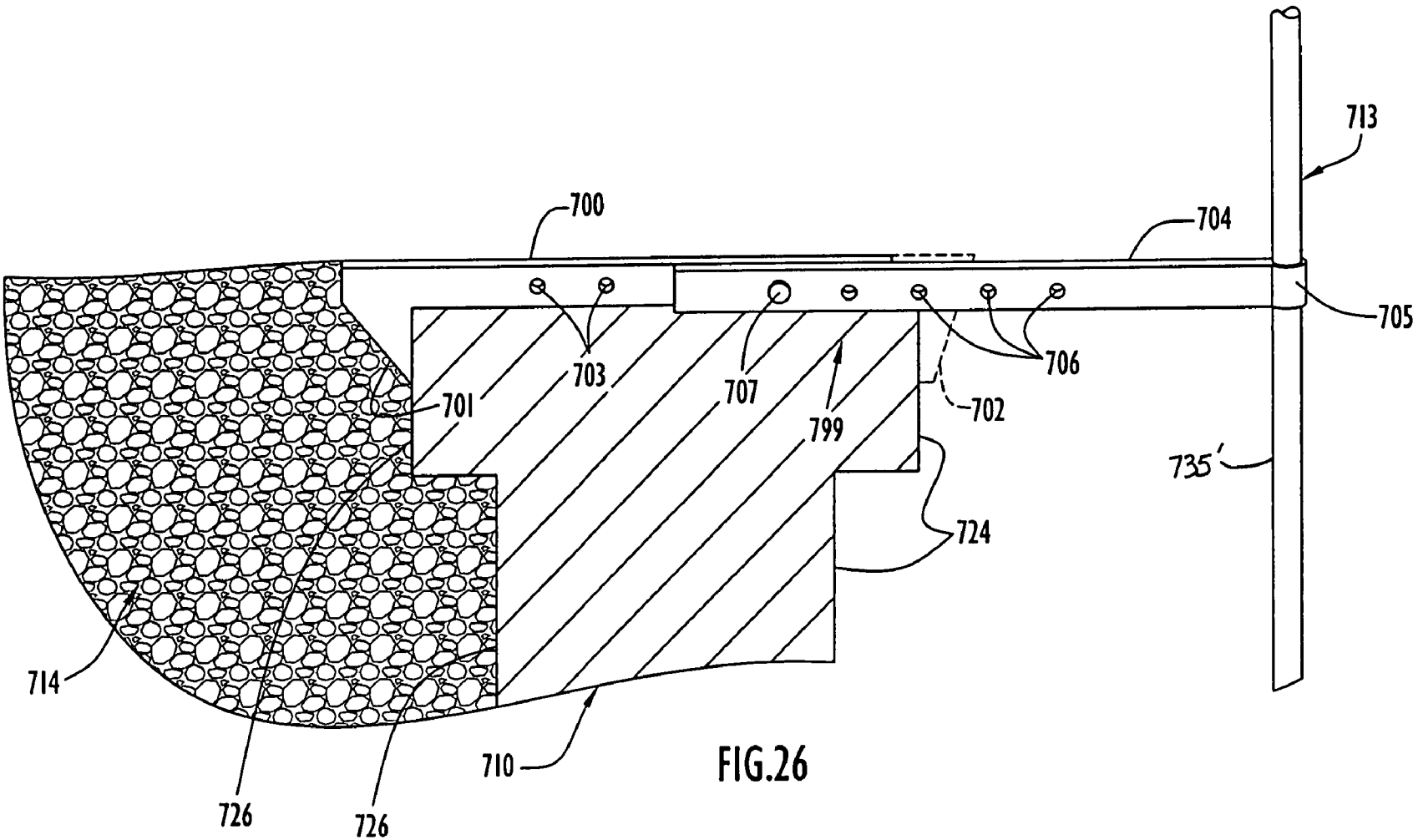
FIG. 26 is a broken side view, partly in section, of the seawall of FIG. 25 showing a seawall clamp of the further alternative fixation structure.

FIG. 25 illustrates an installation system having forward rail support fixation structure similar to that depicted in FIG. 24 but which does not use pilings and piling clamps as a means to prevent the forward vertical support members from moving away from the seawall. Rather, the forward rail support fixation structure of FIG. 25 includes seawall clamps 799 for clamping the forward vertical support members 713 directly to the seawall 710 to prevent the forward vertical support members 713 from moving away from the seawall. The forward rail support fixation structure of FIG. 25 comprises forward vertical support members 713, having lower ends secured to the earthen floor 722, and forward rail support clamps 711 for clamping opposite ends of the forward rail support 733 to the forward vertical support members 713. The forward vertical support members 713, forward rail support 733 and forward rail support clamps 711 are similar to the forward vertical support members 613, forward rail support 633 and forward rail support clamps 611, respectively, except that the vertical support bars 735' of the forward vertical support members 713 are shown without shield plates at their upper ends. A seawall clamp 799 is provided for each forward vertical support member 713 and is illustrated in FIGS. 25 and 26. The seawall clamp 799 comprises a forward clamp arm 700 having first and second ends. The first end of the forward clamp arm 700 carries a stake 701 of sufficient length to be driven into the earth 714 on the earth facing side 726 of seawall 710 with the forward clamp arm 700 extending over the top surface of the seawall in the direction of the water facing side 724. The stake 701 preferably extends vertically downwardly from the first end of the forward clamp arm 700 at a 90° angle or less than 90° angle to the forward clamp arm. The stake 701 is preferably driven into the earth 714 adjacent or close to the earth facing side 726 of the seawall 710, and the forward clamp arm 700 is preferably of sufficient length to extend over the entire or substantially the entire depth or thickness of the seawall at its top surface. The second end of the forward clamp arm 700 can be provided with a vertically depending leg 702 opposite the stake 701 to extend downwardly over the water facing side 724 of the seawall when the stake 701 is driven into the earth 714 as shown in FIG. 26. Accordingly, the seawall 710 can be captured or confined between the stake 701 and leg 702 as illustrated in FIG. 26 so that the forward clamp arm 700 is restricted from moving relative to the seawall forwardly and rearwardly in a vertical plane perpendicular or transverse to the seawall. A plurality of spaced apertures 703 are provided in the forward clamp arm 700 between the first and second ends thereof and are in longitudinal alignment with one another. The seawall clamp 799 includes a rearward clamp arm 704 having first and second ends, a collar 705 on the second end of the rearward clamp arm, and a plurality of spaced apertures 706 in the rearward clamp arm longitudinally aligned with each other between the first and second ends of the rearward clamp arm. The rearward clamp arm 704 is adjustably connected with the forward clamp arm 700 via a removable connector 707 extending through a selected pair of aligned apertures 703, 706 of the forward and rearward clamp arms. Depending on which pair of apertures 703, 706 are aligned to receive the connector 707 therethrough, the distance of collar 705 from the water facing side 724 of the seawall 710 can be selectively adjusted since the rearward clamp arm 704 can be extended an adjustable distance beyond the water facing side of the seawall. Also, the rearward clamp arm 704 can be connected in longitudinal alignment with the forward clamp arm 700 to extend perpendicular or substantially perpendicular to the seawall 710. The connector 707 of the seawall clamp 799 may comprise a bolt inserted through the selected pair of aligned apertures 703,706 of the forward and rearward clamp arms and a nut threaded onto the end of the bolt to fixedly secure the rearward clamp arm to the forward clamp arm at a selected extension distance for the collar 705 from the water facing side of the seawall. The collar 705 defines a vertical cavity extending entirely therethrough with a central longitudinal axis of the vertical cavity disposed perpendicular or substantially perpendicular to the earthen floor 722 when the seawall clamp 799 is assembled on the top of the seawall. The vertical cavity through collar 705 has a cross-sectional size and configuration to receive a forward vertical support member 713 therethrough coaxially or substantially coaxially with a close fit. The vertical cavity through collar 705 can have a circular cross-section to receive a forward vertical support member 713 of circular cross-section therethrough.

In an anchoring device installation method utilizing the forward rail support fixation structure of FIG. 25, the seawall clamps 799 are installed on the top of the seawall 710 by positioning the forward clamp arm 700 over the top surface of the seawall 710, i.e. the top surface of cap 718 in the case of seawall 710, with the stake 701 extending downwardly toward the earth 714 on the earth facing side of the seawall. The forward clamp arm 700 is lowered vertically toward the top surface of the seawall 710 to push the stake 701 into the earth 714. Preferably, the stake 701 is pushed or driven into the earth 714 so that it contacts or is adjacent the earth facing side 726 to best prevent the forward clamp arm 700 from moving in the direction of the water 712. The stake 701 can be pushed or driven into the earth 714 with the rearward clamp arm 704 already connected to the forward clamp arm 700 via the connector 707 at a selected pair of aligned apertures 703, 706 to obtain a desired extension distance for the collar 705 beyond the water facing side 724 of the seawall. Alternatively, the rearward clamp arm 704 can be connected to the forward clamp arm 700 after the stake 701 has been driven into the earth 714. The stake 701 is driven into the earth 714 to a sufficient depth and can be driven far enough into the earth for the forward clamp arm 700 to contact or be disposed adjacent or close to the top surface of the seawall 710. As the forward clamp arm 700 is lowered to drive the stake 701 into the earth 714, the foot 702 comes to be disposed over the water facing side 724 of the seawall 710. The distance between the stake 701 and the foot 702 can be selected to closely correspond to the depth or thickness of the top of the seawall, i.e. the depth or thickness of cap 718 in the case of seawall 710, so that the top portion of the seawall is closely confined between the stake 701 and foot 702. The water facing side of the seawall in contact or adjacent the foot 702 thereby prevents the forward clamp arm 700 from moving in a direction away from the water 712. If the rearward clamp arm 704 is not already connected to the forward clamp arm 700, the connector 707 is secured at a selected pair of aligned apertures 703,706 to fixedly secure the rearward clamp arm to the forward clamp arm at a desired extension distance for the collar 705 beyond the water facing side of the seawall. The lower ends of the forward vertical support members 713, i.e. vertical support bars 735', are passed through the collars 705 from top to bottom and are driven into the earthen floor 722. The seawall clamps 799 space the forward vertical support members 713 a selected distance from the water facing side 724 of seawall 710 with the forward vertical support members 713 being in parallel or substantially in parallel with one another along the seawall 710 and being perpendicular or substantially perpendicular to the earthen floor 722 as described for forward vertical support members 613. The distance that the forward vertical support members 713 are spaced from the water facing side 724 is established by the collars 705 and will depend on the spacing desired for the forward rail support 733 from the water facing side 724. The distance that the forward vertical support members 713 are spaced from each other along the length of the seawall is established by the spacing between the seawall clamps 799 and will depend on the length of the forward rail support 733 whose opposite ends are to be clamped to the forward vertical support members 713. Prior to being driven into the earthen floor 722, the forward vertical support members 713 can be respectively inserted to extend through the vertical passages 745' of forward rail support clamps 711 so that the clamps 711 are already disposed on the forward vertical support members 713 when the lower ends of the forward vertical support members are driven into the earthen floor. Alternatively, the clamps 711 can be placed on the forward vertical support members 713 after the lower ends of the forward vertical support members 713 have been driven into the earthen floor 722, and, the seawall clamps 799 can be assembled on the upper ends of the forward vertical support members 713 and on the seawall 710 after the forward vertical support members 713 have been secured to the earthen floor 722. In the latter case, the location of the forward vertical support members 713 will determine the extension distance for the collars 705 and at which aligned apertures 703,706 the fastener 707 will be connected. Although the top of seawall 710 is depicted as having a seawall cap 718, the seawall clamps 799 can be installed on the tops of seawalls which do not include a seawall cap. By virtue of the seawall clamps 799, upper portions of the forward vertical support members 713 are constrained from moving away from the water facing side 724 of the seawalls, and the lower ends of the forward vertical support members 713 are also constrained from moving away from the water facing side 724 due to their securement to the earthen floor 722. The forward rail support 733, which is secured to the forward vertical support members 713, is thereby constrained from moving away from the water facing side 724 of the seawall. In addition, the clamps 799 assist in maintaining the separation distance between the forward vertical support members 713. The forward rail support fixation structure employing seawall clamps 799 to clamp the forward vertical support members to the seawall is particularly advantageous for use on seawalls which do not have existing vertical pilings or which have existing vertical pilings too widely spaced from one another for the forward rail support to be clamped to the pilings.

The forward rail support fixation structure depicted in FIG. 25 may further comprise a stabilizer including a vertical support bar 735 and a stabilizer clamp 737 which are similar to the vertical support bar 435 and stabilizer clamp 437 described above. The stabilizer of FIG. 25 employs a seawall clamp 799 to avoid movement of the vertical support bar 735 of the stabilizer toward and/or away from the water facing side 724 of seawall 710. The vertical support bar 735 of the stabilizer extends through the vertical cavity of the collar of an additional seawall clamp 799' assembled on the top of seawall 710 to prevent movement of the vertical support bar 735' 735 away from the water facing side 724 of the seawall. Assembly of the additional seawall clamp 799 on the seawall 710 and on the vertical support bar 735 of the stabilizer is carried out in a manner similar to that described above for assembly of the seawall clamps 799' on the seawall 710 and on the forward vertical support members 713.

Figure 27:
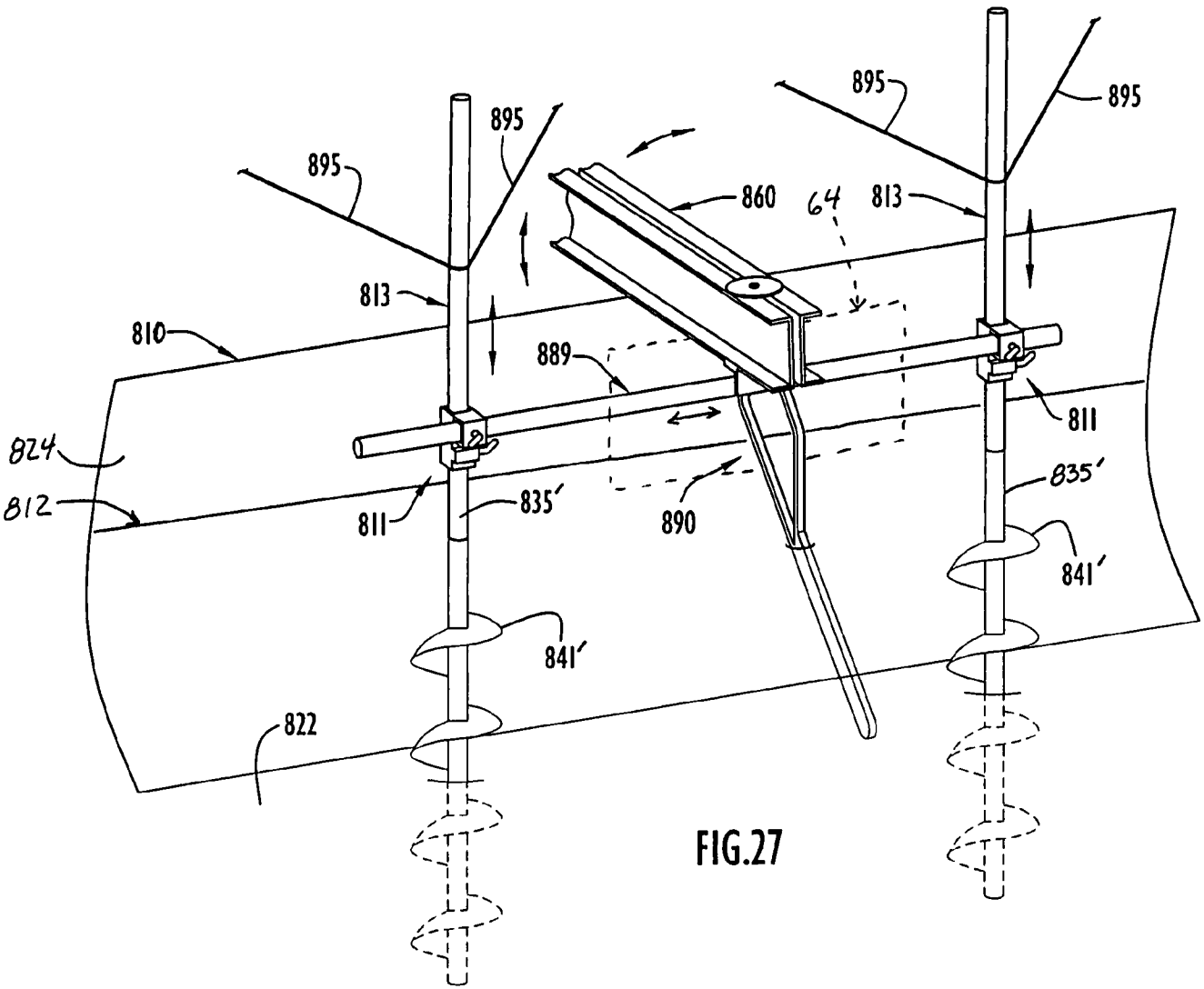
FIG. 27 is a broken perspective view of an alternative rearward rail support for the installation systems of the present invention and illustrating fixation structure for the alternative rearward rail support.

An alternative rearward rail support assembly for the installation systems of the present invention is depicted in FIG. 27 and comprises an alternative rearward rail support 889, alternative rearward rail support fixation structure, and an alternative rearward rail clamp 890. The alternative rearward rail support 889 is similar to the forward rail supports 433, 633 and 733 and comprises a horizontal support bar for supporting the rearward end of the rail 860. The alternative rearward rail support fixation structure is similar to the forward rail support fixation structure for forward rail support 733 and comprises rearward vertical support members 813, similar to the forward vertical support members 713, and rearward rail support clamps 811, similar to the forward rail support clamps 711, for clamping opposite ends of the rearward rail support 889 to the rearward vertical support members 813 which have their lower ends secured to the earthen floor 822. The rearward rail clamp 890 which clamps the rearward end of the rail 860 to the rearward rail support 889 is similar to the forward rail clamp 474.

In an anchoring device installation method employing the alternative rearward rail support assembly of FIG. 27, the lower ends of the rearward vertical support members 813, i.e. vertical support bars 835', having penetrating formations 841' are driven into the earthen floor 822 in parallel or substantially in parallel to one another and perpendicular or substantially perpendicular to earthen floor 822. The forward vertical support members 813 are driven into the earthen floor 722 an appropriate distance from the water facing side 824 of the seawall 810 for the rearward rail support 889 to be fixated by the rearward vertical support members 813 at the appropriate location to support the rearward end of rail 860. The spacing between the rearward vertical support members 813 will depend on the length of the rearward rail support 889 whose opposite ends are to be clamped to the rearward vertical support members 813. The rearward rail support clamps 811 are assembled to the rearward vertical support members 813 and to the rearward rail support 889 as described above for assembly of the forward rail support clamps 711 to the forward vertical support members 713 to clamp the opposite ends of the rearward rail support 889 to the rearward vertical support members 813. The rearward rail clamp 890 is used to clamp the rearward end of rail 860 to the rearward rail support 889 in a manner similar to that described above for use of the forward rail clamp 474 to clamp the forward end of rail 460 to the forward rail support 433. The rearward end of rail 860 can be raised or lowered in the vertical direction as shown by arrows in FIG. 27 to obtain a selected vertical angle for the installation axis by adjusting the position of the clamps 811 along the rearward vertical support members 813, which adjusts the position of the rearward rail support 889 along the height of the seawall. In addition, the position of the rearward rail clamp 890 along the rearward rail support 889 can be adjusted to move the rearward end of the rail 860 laterally in the horizontal direction as shown by an arrow in FIG. 27 to obtain a selected lateral angle for the installation axis. Also, the rearward rail support assembly of FIG. 27 allows the rail 860 to pivot or rotate in a horizontal direction about the vertical axis of clamp 890, i.e. the central longitudinal axis of the stem that connects the top plate to the foot, and in a vertical direction about the horizontal axis defined by the central longitudinal axis of the rearward rail support 889.

Another alternative rearward rail support may comprise a marine vessel, such as vessel 64, on which the rearward end of the rail 860 can be supported as shown in dotted lines in FIG. 27. The vessel 64 could be deployed on the body of water at an appropriate location to support the rearward end of the rail 860 to obtain a selected vertical angle and a selected lateral angle for the installation axis. The vessel could be provided with suitable equipment, such as a lift or hoist, for raising or lowering the rearward end of the rail 860 to obtain the selected vertical angle. The vessel may be fixated in position using any type of marine anchor, such as the spuds 68, and the marine anchor can thusly constitute rearward rail support fixation structure.

Figure 28:
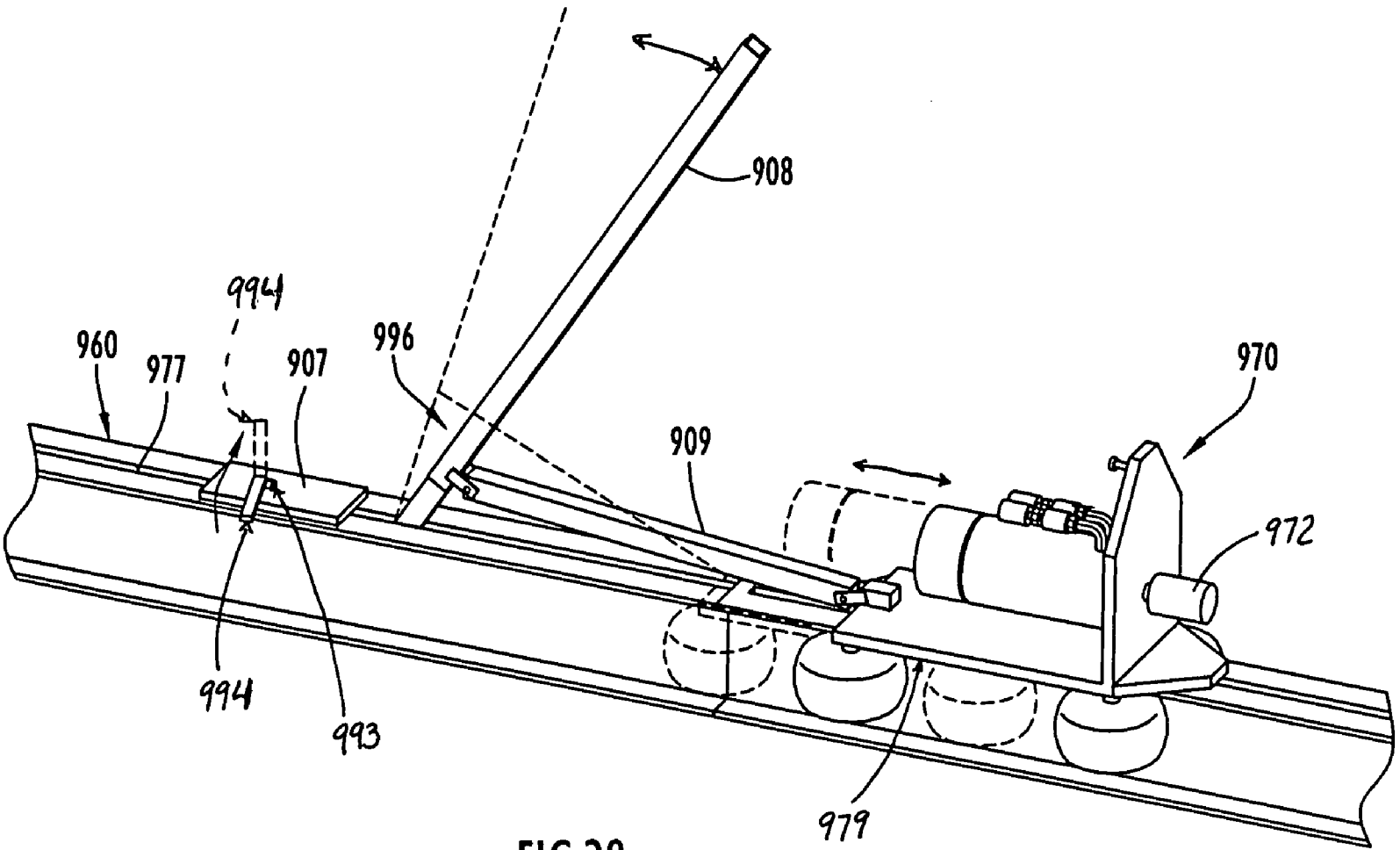
FIG. 28 is a broken perspective view of a rail and installation machine of an installation system including a pushing device for the installation machine.

FIG. 28 depicts an alternative pushing device 996 for the installation systems of the present invention. The pushing device 996 comprises an attachment plate 907, a locking mechanism 993 associated with the attachment plate 907, an actuating handle 908 and a connecting arm 909. The actuating handle 908 has a lower end pivotally attached to pivot or hinge structure connecting the lower end of the handle 908 to a front end of the attachment plate 907. The pivot or hinge structure by which the lower end of the actuating handle 908 is connected to the attachment plate 907 is not visible in FIG. 28 because it and the lower end of the handle 908 are disposed within the slot 977 of the rail 960. The locking mechanism 993 can be designed in various ways to removably secure the attachment plate 907 to the rail 960 and preferably comprises a cam lock on the attachment plate 907 operable via an operating handle 994 to selectively lockingly engage the attachment plate 907 with the rail 960 and disengage the attachment plate 907 from the rail 960. In FIG. 28, the operating handle 994 is shown in solid lines in a locked position for the locking mechanism 993 where the attachment plate 907 is locked to the rail 960 in overlapping relation with the upper flanges of the rail. In the locked position, the operating handle 994 is in a down position and the cam lock is in locking engagement with the slot 977 of the rail. As shown by an arrow and dotted lines in FIG. 28, the operating handle 994 is rotatable from the down position to an up position in an unlocked position for the locking mechanism 993 where the cam lock is moved out of locking engagement with the rail 960 permitting removal of the attachment plate 907 from the rail 960. The attachment plate 907 can be locked to the rail 960 at a selected location along the length of the rail. When the attachment plate 907 is locked to the rail 960 at a selected location, the attachment plate 907 is fixed or held in place on the rail at the selected location. The actuating handle 908, however, is free to rotate or pivot relative to the attachment plate 907 and rail 960 about a fixed pivot axis at the lower end of the handle 908 within slot 977 of the rail 960 as shown by an arrow in FIG. 28. The pivot axis about which the handle 908 pivots or rotates is a horizontal pivot axis perpendicular to the central longitudinal axis of the rail 960.

The connecting arm 909 has a rearward end pivotally or hingedly connected to the actuating handle 908 at a location on handle 908 inwardly spaced from the pivot axis for the handle 908, i.e. between the pivot axis and an upper free end of the handle. The connecting arm 909 has a forward end pivotally or hingedly connected to the back end of the base of carriage 979 of installation machine 970 mounted for movement along the rail 960 as described above for installation machine 470. The pivotal or hinged connection between the forward end of the connecting arm 909 and the base of carriage 979 can be releasable to permit detachment of the pushing device 996 from the installation machine 970.

The actuating handle 908 is pivotable about its pivot axis from a maximally retracted position shown in dotted lines in FIG. 28 to an extended position shown in solid lines in FIG. 28. In the maximally retracted position, the handle 908 is maximally pivoted toward the rearward end of rail 960 in a direction away from the installation machine 970 (counterclockwise about the pivot axis looking at FIG. 28). Since the pivot axis is fixed due to the lower end of the handle 908 being attached to the attachment plate 907 which is locked in position on the rail 960, placement of the handle 908 in the maximally retracted position causes the connecting arm 909 to pivot so that its rearward end is maximally elevated relative to its forward end which is attached to the base of carriage 979. When the rearward end of the connecting arm 909 is maximally elevated relative to its forward end with the handle 908 in the maximally retracted position, the carriage 979 and, therefore, the entire installation machine 970, is pulled longitudinally rearwardly by the connecting arm 909 to a maximally retracted longitudinal position for the installation machine 970 along the rail 960 as shown by dotted lines in FIG. 28. The handle 908 in the maximally retracted position and the connecting arm 909 connected to the handle 908 have their central longitudinal axes contained in the vertical plane bisecting the rail 960, which plane also contains the central longitudinal axis of the rail 960 and the installation axis along which the drive shaft 972 of the installation machine moves longitudinally coaxially when the installation machine is moved longitudinally along the rail. The central longitudinal axis of the handle 908 in the maximally retracted position can be disposed at any suitable angle to the central longitudinal axis of the rail 960 in the vertical plane. When the handle 908 is in the maximally retracted position, the central longitudinal axis of the connecting arm 909 is maximally angled upwardly relative to the central longitudinal axis of the rail 960 in the vertical plane.

The handle 908 is pivotable about its pivot axis from the maximally retracted position to the extended position by pivoting the handle 908 toward the forward end of rail 960 in a direction toward the installation machine 970 (clockwise about the pivot axis looking at FIG. 28). As the handle 908 is pivoted toward the installation machine 970 and the forward end of rail 960, its central longitudinal axis moves in the vertical plane, and the central longitudinal axis of connecting arm 909 also moves in the vertical plane since the forward pivotal movement of handle 908 causes the connecting arm 909 to pivot as its rearward end is lowered closer to the rail 960. The connecting arm 909 is able to pivot at its rearward end about a rearward pivot axis parallel to the pivot axis of handle 908 and is able to pivot at its forward end about a forward pivot axis parallel to the rearward pivot axis. Movement of the rearward end of the connecting arm 909 closer to the rail 960 reduces the angle between the central longitudinal axis of the connecting arm 909 and the central longitudinal axis of the rail 960 in the vertical plane so that the carriage 979 and, therefore, the entire installation machine 970, is pushed longitudinally forwardly by the connecting arm to an extended longitudinal position for the installation machine along the rail as shown in solid lines in FIG. 28. When the handle 908 is maximally pivoted forwardly, it will be in a maximally extended position with the installation machine 970 in a maximally extended longitudinal position along the rail 960. The extended longitudinal position depicted in FIG. 28 for the installation machine 970 may be considered an intermediate extended longitudinal position in that the handle 908 may still be pivoted further toward the installation machine 970 to further lower the rearward end of connecting arm 909 toward the rail 960 to push the installation machine 970 further forwardly along the rail 960. The central longitudinal axis of the handle 908 in the maximally extended position can be disposed in the vertical plane at any suitable angle to the central longitudinal axis of the rail 960 less than the angle between these axes in the maximally retracted position in order to obtain a desired range of longitudinal movement for the installation machine 970 between the maximally retracted and maximally extended longitudinal positions. When the handle 908 is in the maximally extended position, the central longitudinal axis of the connecting arm 909 in the vertical plane will be less than maximally angled relative to the central longitudinal axis of the rail 960.

Preferably, the range of longitudinal forward movement for the installation machine 970 along the rail 960 when the installation machine is pushed by the pushing device 996 from the maximally retracted longitudinal position to the maximally extended longitudinal position is about eight to ten inches. This range of longitudinal forward movement is advantageous to allow a drill bit (not shown) coupled to the drive shaft 472 to be pushed through the entire thickness of a seawall with constant force or pressure in one pivotal swing of the handle 908 from the maximally retracted position toward the maximally extended position. By pivoting the handle 908 from the maximally extended position back to the maximally retracted position, the installation machine 970 is moved rearwardly along the rail 960 from the maximally extended longitudinal position to the maximally retracted longitudinal position the same range of longitudinal movement but in a rearward direction away from the seawall.

The pushing device 996 is particularly advantageous for use in the anchoring device installation methods to push the installation machine 970 in the direction of the seawall so that the drill bit is forced against the seawall with the right amount of force for the drill bit to core the passage through the seawall without binding. The attachment plate 907 of the pushing device 996 is locked in position on the rail 960 at an appropriate location for the drill bit (not shown), which is coupled to the drive shaft 972 of the installation machine 970, to be moved longitudinally through the entire thickness of the seawall from its water facing side to its earth facing side within the range of longitudinal forward movement for the installation machine from the maximally retracted longitudinal position to the maximally extended longitudinal position. Preferably, the drill bit is placed adjacent or close to the water facing side of the seawall with the handle 908 in the maximally retracted position, and the attachment plate 907 is locked to the rail 960 with the drill bit and installation machine so positioned. The installation machine 970 is moved from the maximally retracted longitudinal position toward the maximally extended longitudinal position by pivoting the handle 908 from the maximally retracted position toward the maximally extended position. As a result, the installation machine 970 is pushed forwardly toward the seawall causing the drill bit, which is rotated by the drive shaft 972, to core a passage through the seawall. The pushing device 996 creates a mechanical advantage through leverage and, as the handle 908 is pivoted toward the maximally extended position, a constant pushing force is applied to the installation machine 970. The pushing device 996 ensures that a relatively light pushing force, preferably about twenty to thirty pounds, is applied against the installation machine 970 by the connecting arm 909 and thence to the drill bit. The constant and controlled force applied to the installation machine 970 and its drill bit by the pushing device 996 prevents the application of non-uniform and excessive pushing force on the installation machine 970 which could cause the drill bit to bind or jam in the seawall. Since the range of longitudinal movement for the installation machine 970 from the maximally retracted longitudinal position to the maximally extended longitudinal position is large enough for the drill bit to core through the entire thickness of the seawall in one pivotal swing of the handle 908, the pushing force on the installation machine 970 from the pushing device 996 remains constant throughout the coring process.

The pushing device 996 may also be beneficial for pushing the installation machine 970 while the drive shaft 972 is being used to rotate or screw an anchoring member into the retained earth. The pushing device 996 can be used in a manner similar to that described above to apply relatively light controlled force or pressure to the installation machine 970 when initially screwing the anchoring member into the earth to ensure that the anchoring member rotates or screws into the earth properly. The pushing device 996 may thusly be used to avoid the problems associated with applying excessive and/or non-uniform force or pressure to the anchoring member which could cause an "auger" effect wherein the anchoring member rotates in place within the earth without advancing longitudinally. Once the pushing device 996 has been used to initiate proper rotation of the anchoring member into the earth, a pushing force on the installation machine 970 is no longer necessary because rotation of the anchoring member by the drive shaft 972 causes the anchoring member to carry or draw the installation machine 970 forwardly along the rail 960 as the anchoring member advances into the retained earth by virtue of its rotation.

Figure 29:
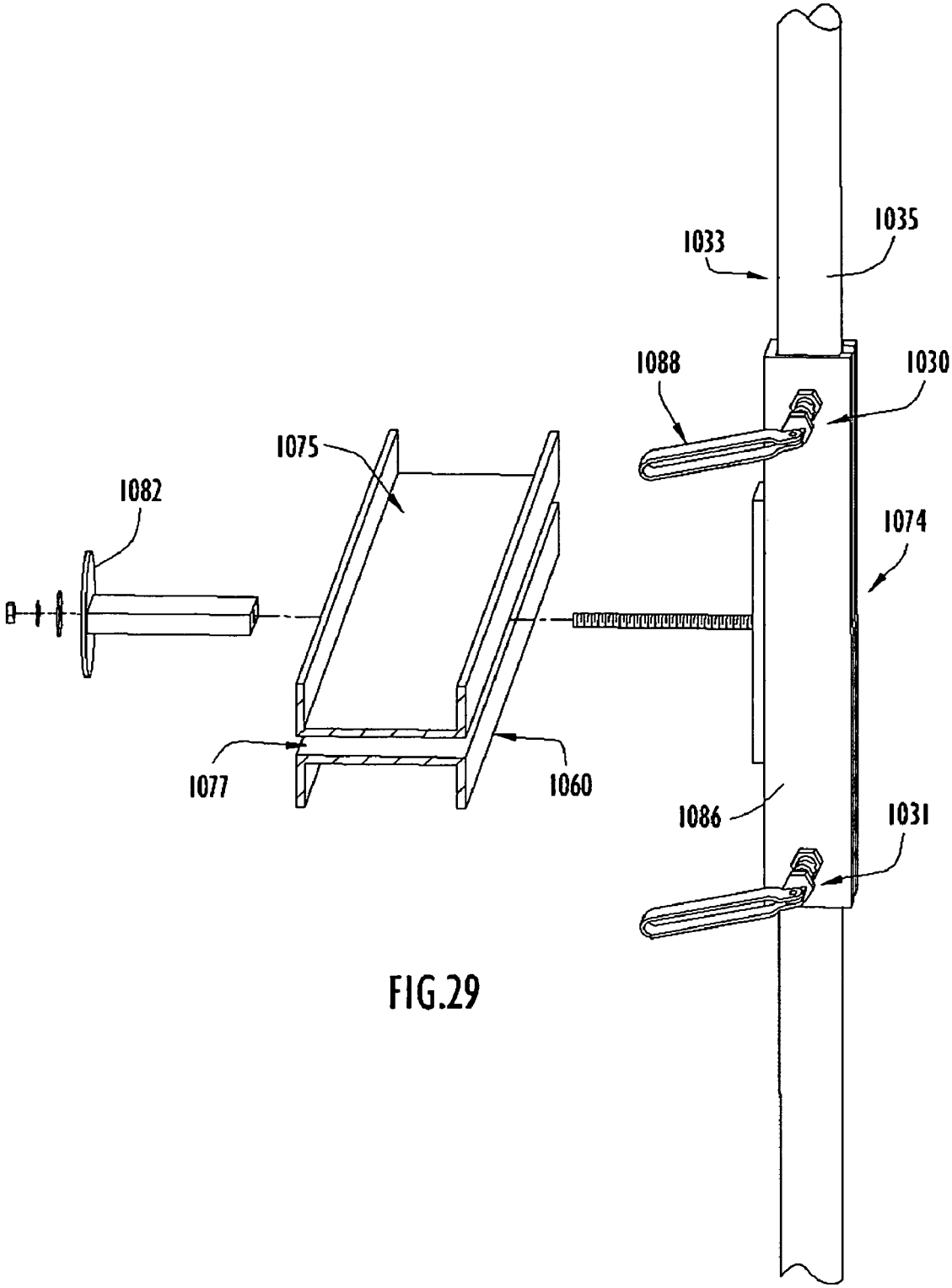
FIG. 29 is a front perspective view, partly broken and exploded, of an alternative forward rail support and forward rail clamp for use in the anchoring device installation systems and methods of the present invention.
Figure 30:
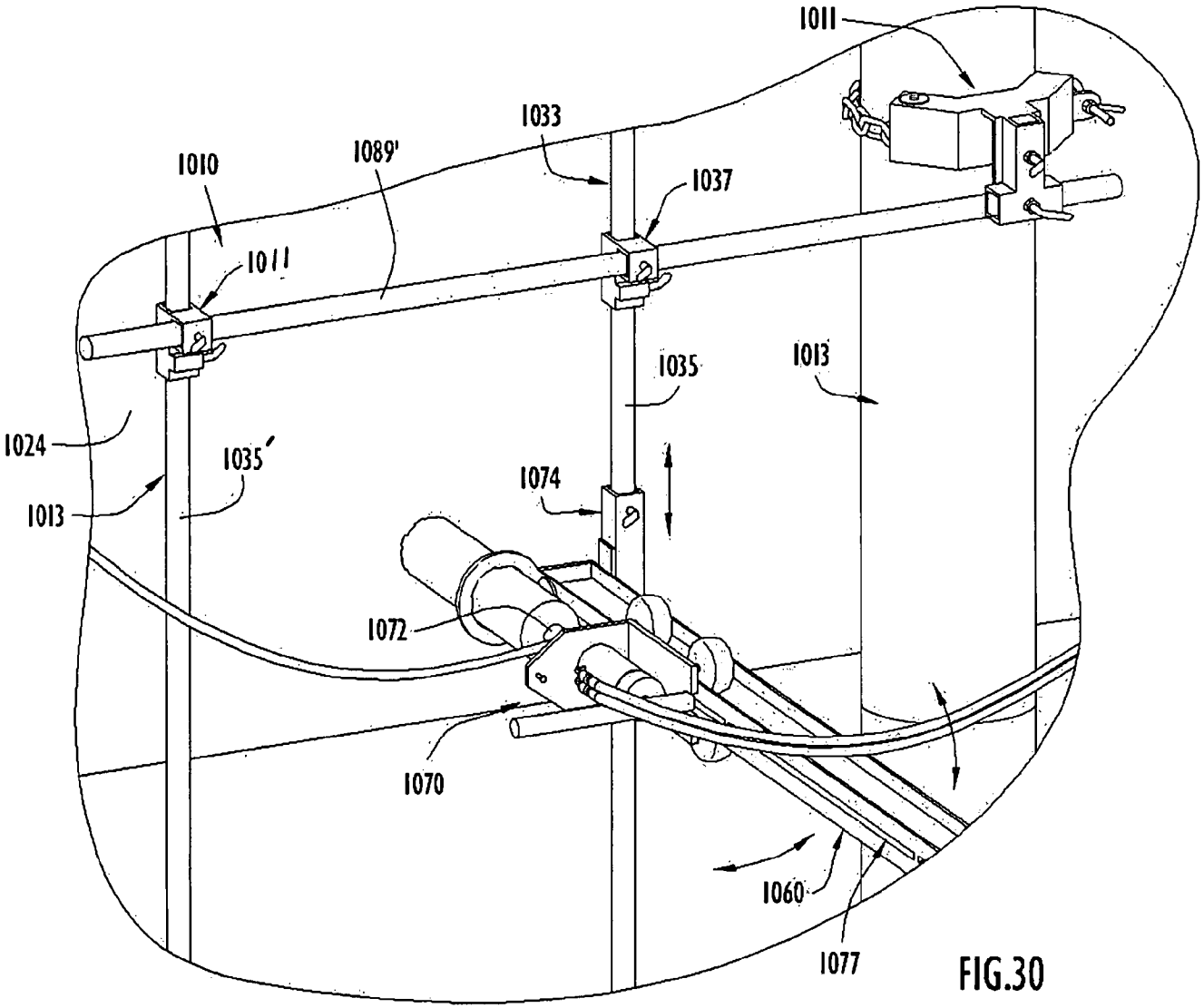
FIG. 30 is a broken front perspective view depicting use of the forward rail support and forward rail clamp of FIG. 29 to support the rail to guide the installation machine.

FIGS. 29 and 30 illustrate an alternative forward rail support 1033 and an alternative forward rail clamp 1074 for use in the anchoring device installation systems and methods of the present invention. The forward rail support 1033 differs from the forward rail supports previously described in that it supports the forward end of rail 1060 with the rail 1060 in a position rotated 90° about the central longitudinal axis of the rail from the position for the rail previously described. Instead of comprising a horizontal support bar, the forward rail support 1033 comprises a vertical support bar 1035, and the forward rail clamp 1074 clamps the forward end of rail 1060 to the vertical support bar 1035 such that the central partition of the rail 1060 is oriented horizontally and the parallel flanges of the rail 1060 are oriented vertically. Accordingly, the central partition of rail 1060 may be considered a horizontal central partition, the parallel flanges of rail 1060 may be considered left and right side vertical flanges, and the plane that bisects the rail 1060 centrally may be considered a horizontal plane. The vertical support bar 1035 is similar to the vertical support bars 35, 435, 435', 635, 635' and has a lower end (not shown) with a penetrating formation for being driven in or secured to the earthen floor as described above for the vertical support bars 35, 435, 435', 635, 635'. The upper end of the vertical support bar 1035 may be provided with a shield, such as the shield 439 described above. The forward rail clamp 1074 is similar to forward rail clamp 74 and comprises a plate component including an end plate 1082 and a stem extending perpendicularly from the end plate 1082, a foot component including a foot 1086 and an externally threaded shaft extending perpendicularly from foot 1086, and a clamping device 1088 associated with the foot 1086. The stem defines a longitudinal passage therethrough in alignment with a hole in plate 1082 for receiving the shaft of the foot component to extend through the plate component. The stem has an external cross-sectional configuration and size to fit between planar parallel side walls of the slot 1077 of rail 1060 with a close fit. Preferably the stem has planar parallel side walls in correspondence with the side walls of the slot 1077 to allow the rail 1060 to be supported on the stem by virtue of a slot side wall being supported on the corresponding stem side wall. The slot 1077 may be considered a horizontal slot extending through the rail 1060 from side to side, and the track segments of track 1075 of the rail 1060 are disposed vertically one over the other on opposite sides of the central horizontal partition of the rail.

The foot 1086 has a channel extending longitudinally entirely therethrough, the channel of foot 1086 being oriented vertically to receive the vertical support bar 1035 longitudinally therethrough. The channel of foot 1086 has a cross-sectional size and configuration to receive the external cross-section of the vertical support bar 1035 with a close fit. The foot 1086 may be made from a channel member of C-shaped cross-section presenting a slot along one side of the foot 1086 extending the entire length of and providing communication with the channel through the foot 1086, with the slot being of a size to allow the support bar 1035 to be inserted laterally through the slot into the channel. The channel in foot 1086 may be bounded by flat or planar internal surfaces of the foot 1086 to better resist rotation of the foot relative to a support bar 1035 of circular external cross-section. The external surface of foot 1086 from which the shaft extends may comprise a planar elevated surface, perpendicular to the shaft and parallel to the central longitudinal axis of the channel, forming a bearing surface for contact with the flanges of rail 1060 as explained further below.

The clamping device 1088 can be designed in various ways to secure or clamp the foot 1086 at a selected location along the length of the vertical support bar 1035 when the vertical support bar 1035 extends through the vertical channel in foot 1086. The clamping device 1088 can comprise locking devices 1030 and 1031 respectively disposed at opposite or upper and lower ends of the foot 1086. The locking devices 1030 and 1031 can be similar to locking devices 430 and 431 and can comprise threaded locking members threadedly engaged in nuts or nut formations associated with holes in the foot 1086 respectively in communication with the channel in the foot. Ends of the locking members which do not pass into the nut formations may be respectively coupled with pivotal operating handles movable from a position coaxial with the locking members to a position bent or angled from the central longitudinal axes of the locking members to provide additional leverage facilitating rotation of the locking members for selective advancement in and retraction from the channel of the foot 1086. Advancement of the locking members of locking devices 1030 and 1031 into the channel of foot 1086 causes the locking members to lockingly engage the support bar 1035 in the channel, and retraction of the locking members from the channel causes disengagement of the locking members from the support bar. The locking devices 1030 and 1031 being at spaced locations along the length of the support bars 1035 ensures that the foot 1086 is secured or clamped to the support bar at two longitudinally spaced locations to better hold the foot component in fixed position on the support bar 1035. Although the clamping device 1088 of the forward rail clamp 1074 differs from the clamping device 88 of the forward rail clamp 74, it should be appreciated that either forward rail clamp 74, 1074 can be used to clamp a rail to either a horizontal or a vertical forward rail support in the different orientations for the rail. The forward rail clamp 1074 also includes an internally threaded nut, and may include one or more washers, used to secure the plate component to the foot component as described further below.

In an anchoring device installation method utilizing the forward rail support 1033 and forward rail clamp 1074, the vertical support bar 1035 is secured to the earthen floor at an appropriate distance in front of the water facing side 1024 of seawall 1010 to support the forward end of rail 1060. Securing the vertical support bar 1035 to the earthen floor involves rotating the vertical support bar 1035 to advance the penetrating formation on its lower end into the earthen floor. Once the lower end of the vertical support bar 1035 is advanced into the earthen floor a suitable distance, the penetrating formation resists withdrawal of the vertical support bar from the earthen floor. The vertical support bar 1035 is secured to the earthen floor with its central longitudinal axis extending vertically and essentially perpendicular to the earthen floor. If there is a vertical piling 1013 along the water facing side 1024 of the seawall 1010, the central longitudinal axis of the vertical support bar 1035 will ordinarily be parallel or substantially parallel to the central longitudinal axis of the piling. In addition, the central longitudinal axis of the vertical support bar 1035 will typically be parallel or substantially parallel to a plane of the seawall 1010.

In order to maintain the vertical orientation for the vertical support bar 1035, the anchoring device installation system utilizing a vertical forward rail support 1033 will preferably include forward rail support fixation structure for constraining the vertical support bar 1035 against movement relative to the water facing side 1024 of the seawall 1010. As shown in FIG. 30, the anchoring device installation system utilizing the vertical forward rail support 1033 can include forward rail support fixation structure comprising a forward horizontal support bar 1089', similar to horizontal support bars 433, 633, 733 and 889, clamped or secured to the upper portion of the vertical support bar 1035, and a pair of forward vertical support members 1013 respectively secured to opposite ends of the forward horizontal support bar 1089' and to the earthen floor. The forward rail support fixation structure of FIG. 30 includes a forward rail support clamp 1037, similar to clamp 437, for clamping the upper portion of the forward rail support 1033 to the horizontal support bar 1089', and includes clamps 1011 for clamping the ends of the horizontal support bar 1089' to the forward vertical support members 1013. Either forward vertical support member 1013 can be an existing vertical piling or a vertical support bar having a lower end secured to the earthen floor as explained above for vertical support members 413,713. In FIG. 30 one vertical support member 1013 is an existing vertical piling and the other vertical support member 1013 is a vertical support bar 1035'. The clamp 1011 for the vertical piling is a piling clamp similar to piling clamps 411,611'. The clamp 1011 for the vertical support bar 1035' is similar to clamps 437, 611, 711, 737, 811, 1037. Both vertical support members 1013 can be existing vertical pilings or vertical support bars. Both clamps 1011 can be piling clamps or clamps similar to clamp 1037. The seawall clamps 799 could be used in conjunction with the vertical support bar 1035 and/or 1035' as explained above.

The forward rail support fixation structure can be assembled to the forward rail support 1033 prior to or subsequent to the lower end of the forward rail support 1033 being secured to the earthen floor. In order to assemble the forward rail support fixation structure to the forward rail support 1033 prior to securing the lower end of the forward rail support 1033 to the earthen floor, the forward rail support fixation structure is first set up the appropriate distance from the water facing side 1024 of seawall 1010 by clamping the end portions of the horizontal support bar 1089' to the forward vertical support members 1013 using clamps 1011 and then inserting the forward rail support 1033 longitudinally or laterally into the vertical passage of the forward rail support clamp 1037 carried on the horizontal support bar 1089' such that the lower end of the forward rail support 1033 is extended from the bottom of the vertical passage. Where either or both of the forward vertical support members 1013 is a vertical support bar 1035', the lower end thereof is secured to the earthen floor via its penetrating formation as explained above for vertical support bars 435, 435', 635, 635', 735, 735'm 835'. The clamps 1011 can be assembled and secured to the forward vertical support members 1013 and to the horizontal support bar 1089' in the same manner described above for clamps 411, 437, 611, 611', 637, 711, 737, 811. The clamp 1037 can be assembled and secured to the horizontal support bar 1089' and to the forward rail support 1033, in the same manner described above for clamps 437, 611, 637, 711, 737, 811. Prior to locking the clamp 1037 to the forward rail support 1033 in the vertical passage, the lower end of the forward rail support 1033 is rotatably driven into the earthen floor. Thereafter the locking member associated with the vertical passage of clamp 1037 is lockingly engaged with the forward rail support 1033 to clamp the forward rail support 1033 to the horizontal support bar 1089'. When the forward rail support fixation structure is assembled to the forward rail support 1033 after the lower end of the forward rails support 1033 has already been secured to the earthen floor, the horizontal support bar 1089'is assembled and secured to the forward rail support 1033 via forward rail support clamp 1037 and to the forward vertical support members 1013 via the clamps 1011. The procedural steps by which this can be accomplished is readily understood from the explanations already provided herein.

The forward rail support 1033 can be secured to the earthen floor prior to or subsequent to the foot 1086 being assembled on the vertical support bar 1035. The foot 1086 is assembled on the vertical support bar 1035 by either inserting the vertical support bar 1035 longitudinally end first into the top or bottom end of the vertical channel of the foot 1086 or inserting the vertical support bar 1035 laterally into the vertical channel through the vertical slot in the side of foot 1086. Prior to inserting the vertical support bar 1035 in the vertical channel of foot 1086, the locking members of locking devices 1030 and 1031 are retracted as needed from the vertical channel to provide sufficient room in the vertical channel to receive the vertical support bar. Once the vertical support bar 1035 extends through the vertical channel of foot 1086, the foot 1086 can be secured in place on the vertical support bar using the clamping device 1088 by advancing the locking members of locking devices 1030, 1031 a sufficient distance into the vertical channel to lockingly engage the vertical support bar 1035. Foot 1086 is secured in place on the vertical support bar 1035 so that the shaft carried by the foot 1086 extends laterally or horizontally to the right or to the left of the vertical support bar and is perpendicular or substantially perpendicular to the central longitudinal axis of the vertical support bar. In FIG. 29, the shaft is depicted extending to the left of the vertical support bar 1035.

The plate component is assembled to the rail 1060 by aligning the end of the stem with the slot 1077 at the forward end of the rail and moving the plate component toward the rail 1060 such that the stem enters the slot 1077 and the plate 1082 abuts the flanges on one side of the rail. The stem is oriented in the slot 1077 with its parallel side walls in correspondence with the parallel side walls of the slot 1077 so that the stem is positioned correctly to enter the slot 1077 and essentially fill the space between the side walls of the slot. The rail 1060 and the plate component are assembled to the foot component by aligning the end of the stem with the end of the shaft and moving the plate component and rail toward the foot 1086 to insert the shaft into the passage of the stem. The rail 1060 is moved toward the foot 1086 until the side flanges of the rail opposite plate 1082 are in contact with the bearing surface of foot 1086 and the end of the shaft extends from the hole in plate 1082. The one or more washers of clamp 1074 are placed on the end of the shaft and the nut is rotatably secured on the end of the shaft extending from the hole in plate 1082 to secure the plate component to the foot component with the forward end of the rail 1060 confined between the plate 1082 and the foot 1086. The nut can be used to apply sufficient compressive force to plate 1082 to forcefully clamp the rail 1060 between the plate 1082 and the bearing surface of foot 1086. A side wall of the slot 1077 is supported on the corresponding side wall of the stem, and the configuration of the stem prevents rotation of the rail 1060 relative to the stem. However, the stem is able to rotate on the shaft about the central longitudinal axis of the shaft when the nut is removed from the shaft or sufficiently untightened. As explained above for forward rail clamp 74, the steps involved in assembling the plate component and foot component of forward rail clamp 1074 to one another and to the forward rail support 1033 and rail 1060 can be performed in any suitable sequence.

The forward rail clamp 1074, the forward rail support fixation structure including forward rail support clamp 1037, forward horizontal support bar 1089', fixation clamps 1011 and forward vertical support members 613, and optionally one or more stabilizers and/or seawall clamps comprise a forward rail support assembly for supporting the forward end of rail 1060. The forward rail support 1033 is fixated to the earthen floor by virtue of its lower end being secured to the earthen floor and by virtue of the lower ends of the forward vertical support members 1013 being secured to the floor. Since the upper end portion of the forward rail support 1033 is also secured to the horizontal support bar 1089' which, in turn, is secured to the forward vertical support members 1013, the forward rail support 1033 is also secured to the horizontal support bar 1089' which, in turn, is secured to the forward vertical support members 1013, the forward rail support 1033 is constrained from moving longitudinally in the direction of its central longitudinal axis and radially in a direction radial to its central longitudinal axis. Accordingly, the forward rail support 1033 is constrained from moving relative to the seawall 1010 upwardly and downwardly in a vertical plane along the height of the seawall, toward and away from the water facing side of the seawall in a vertical plane perpendicular or transverse to the seawall, and lengthwise along the seawall in a vertical plane parallel or substantially parallel to the seawall.

The installation machine 1070 is similar to installation machine 70 but is rotated 90° from the orientation shown for installation machine 70 in order for the wheels of installation machine 1070 to engage with the track segments of track 1075 which are disposed in vertical alignment with one another on opposite sides of the central horizontal partition of the rail 1060. Accordingly, the base of the carriage is oriented vertically and is horizontally or laterally offset from the forward rail support 1033, the base being disposed over the left or right vertical side flanges of the rail 1060. The drive shaft 1072 of the installation machine 1070 defines an installation axis coaxial therewith for formation of a passage in the seawall 1010 along the installation axis when the installation machine is moved along the rail 1060 toward the water facing side 1024 of seawall 1010 in order for the drill bit to core through the seawall as explained above for installation machine 70.

The rail 1060 is supported for linear movement along the forward vertical support bar 1035, for pivotal movement in a vertical plane transverse or perpendicular to the water facing side 1024 of seawall 1010, and for pivotal movement in a horizontal plane transverse or perpendicular to the water facing side 1024 of the seawall 1010. When the locking members of locking devices 1030 and 1031 are disengaged from the vertical support bar 1035 in the vertical channel of the foot 1086, the foot 1086 can be moved linearly upwardly and downwardly along the length of the vertical support bar 1035. Also, the foot 1086 can be rotated on the vertical support bar 1035 about the central longitudinal axis of the vertical support bar so that the shaft on foot 1086 extends in a different direction relative to the central longitudinal axis of the vertical support bar. When the nut is removed or is sufficiently unthreaded from the shaft, the stem can be rotated on the shaft about the central longitudinal axis of the shaft. Moving the foot 1086 upwardly or downwardly along the length of the vertical support bar 1035 allows the position of the forward end of rail 1060 along the height of the water facing side 1024 of seawall 1010 to be selectively adjusted for formation of a passage in the seawall to originate at a selected location where the installation axis intersects the water facing side 1024 of the seawall. Also, by moving the forward end of rail 1060 vertically along the vertical support bar 1035 relative to the rearward end of the rail 1060, the vertical angle for the installation axis can be selectively adjusted. The vertical angle for the installation axis can also be selectively adjusted by raising or lowering the rearward end of the rail 1060 relative to its forward end, causing the stem within the slot 1077 in the rail 1060 to rotate about the shaft. Rotating the foot 1086 on the vertical support bar 1035 to change the direction for the shaft permits the lateral angle for the installation axis to be selectively adjusted and permits the rail 1060 to be pivoted laterally.

The forward rail support 1033 is particularly advantageous for installing a plurality of anchoring devices in the seawall 1010 through respective passages that originate on the water facing side 1024 of the seawall at vertically spaced locations. The forward rail support 1033 reduces and simplifies the procedural steps involved with positioning the rail 1060 to form a first passage in the seawall 1010 originating at a selected first location on the water facing side 1024 and then repositioning the rail 1060 to form a second passage in the seawall 1010 originating at a selected second location above or below the first location. In particular, repositioning the rail 1060 to form the second passage is accomplished merely by releasing the clamping device 1088, moving the foot 1086 upwardly or downwardly along the vertical support bar 1035 to the new location, and clamping the foot 1086 to the vertical support bar 1085 at the new location using the clamping device 1088. The foot 1086 can be moved to the new location while the rail 1060 remains assembled to the forward rail clamp 1074. Repositioning the rail 1060 in this manner is especially beneficial in that only a single clamp is required to be moved in order to obtain repositioning of the rail.

All of the steps of the anchoring device installation methods described above can be performed with or without a marine vessel by personnel located in the water, on the seawall and/or on land on the earth facing side of the seawall. The anchoring device installation methods can be performed without any especially heavy or massive equipment being brought on to property on the earth facing side of the seawall. The anchoring device installation systems can be easily transported in a completely or partially unassembled condition to the site of a seawall on which one or more anchoring devices is to be installed, and the completely or partially unassembled installation systems can be fully assembled quickly and easily on site.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A method for maintenance of a seawall located between a body of water on a water facing side of the seawall and retained earth on an earth facing side of the seawall with there being a floor at the bottom of the body of water on the water facing side of the seawall, comprising the steps of securing a forward rail support to forward rail support fixation structure that is secured to the floor at the bottom of the body of water on the water facing side of the seawall so that the forward rail support is fixated at a selected location in front of the water facing side of the seawall;

supporting a forward end of an elongate rail on the forward rail support so that the rail extends longitudinally from its forward end to a rearward end in a direction away from the water facing side of the seawall;

supporting the rearward end of the rail so that an installation axis, along which a rotatable drive shaft of an installation machine moves longitudinally when the installation machine is moved along a track of the rail, intersects the water facing side of the seawall at a selected location and at preselected vertical and lateral angles to the seawall;

moving the installation machine longitudinally along the track of the rail toward the water facing side of the seawall so that a rotatable drill bit coupled with the drive shaft is moved coaxially along the installation axis;

rotating the drive shaft to rotate the drill bit while the installation machine is pushed along the rail toward the water facing side of the seawall with sufficient force for the drill bit to core a passage through the seawall coaxial with the installation axis;

moving the installation machine longitudinally along the track of the rail away from the water facing side of the seawall to withdraw the drill bit from the passage;

coupling a rearward end of an anchoring member to the drive shaft of the installation machine;

moving the installation machine longitudinally along the track of the rail toward the water facing side of the seawall so that the anchoring member is moved coaxially along the installation axis into the passage;

rotating the drive shaft to rotate the anchoring member through the passage and into the retained earth coaxial with the installation axis to embed an anchor of the anchoring member in the retained earth at a distance from the earth facing side of the seawall to resist withdrawal of the anchoring member from the retained earth with a rearward end of the anchoring member extending from the passage on the water facing side of the seawall, said step of rotating the drive shaft to rotate the anchoring member including contacting the retained earth with the anchoring member such that the anchoring member penetrates the retained earth and the anchor is anchored in the retained earth at the distance from the earth facing side of the seawall as a result of the anchor being embedded in the earth;

uncoupling the drive shaft from the rearward end of the anchoring member extending from the passage on the water facing side of the seawall;

securing a retaining member on the rearward end of the anchoring member extending from the passage on the water facing side of the seawall to tension the anchoring member and apply compressive force against the water facing side of the seawall to compress the seawall and the retained earth between the anchor and the retaining member to resist displacement of the seawall;

and leaving the anchoring member and retaining member in place on the seawall.

2. The method for maintenance of a seawall as recited in claim 1 wherein said step of supporting the forward end of the rail includes supporting the rail for linear movement along the forward rail support bar, for pivotal movement in a horizontal plane transverse to the water facing side of the seawall and for pivotal movement in a vertical plane transverse to the water facing side of the seawall.

3. The method for maintenance of a seawall as recited in claim 2 wherein the forward rail support comprises a forward vertical support bar having a lower end secured to the floor with the forward vertical support bar extending upwardly from its lower end along the height of the seawall, the forward rail support fixation structure comprises a horizontal support bar and a pair of forward vertical support members spaced from one another along the water facing side of the seawall and having lower ends secured to the floor with the forward vertical support members extending upwardly from their lower ends along the height of the seawall, on opposite sides of the forward vertical support bar, said step of securing includes securing opposite ends of the horizontal support bar to the respective forward vertical support members, said step of supporting the forward end of the rail includes securing the forward vertical support bar to the horizontal support bar between the forward vertical support members.

4. The method for maintenance of a seawall as recited in claim 3 wherein said step of supporting the rail for pivotal movement in a horizontal plane includes supporting the rail for pivotal movement about a central longitudinal axis of the forward vertical support bar and said step of supporting the rail for pivotal movement in a vertical plane includes supporting the rail for pivotal movement about an axis perpendicular to the central longitudinal axis of the forward vertical support bar.

5. The method for maintenance of a seawall as recited in claim 3 wherein the forward vertical support members comprise a pair of existing vertical pilings along the water facing side of the seawall having lower ends embedded in the floor and said step of securing opposite ends of the horizontal support bar to the forward vertical support members includes clamping the opposite ends of the horizontal support bar to the respective pilings.

6. The method for maintenance of a seawall as recited in claim 3 wherein the forward vertical support members comprise a pair of additional forward vertical support bars having penetrating formations at their lower ends and further including, prior to said step of securing the opposite ends of the horizontal support, bar the step of securing the additional forward vertical support bars to the floor at spaced locations along the water facing side of the seawall by penetrating the floor with the penetrating formations so that the additional forward vertical support bars extend upwardly from their lower ends along the height of the seawall, and said step of securing the opposite ends of the horizontal support bar to the forward vertical support members includes clamping the opposite ends of the horizontal support bar to the respective additional forward vertical support bars.

7. The method for maintenance of a seawall as recited in claim 6 and further including the step of clamping upper portions of the forward vertical support bars to the seawall.

8. The method for maintenance of a seawall as recited in claim 2 wherein the forward rail support comprises a forward horizontal support bar, the forward rail support fixation structure comprises a pair of forward vertical support members spaced from one another along the water facing side of the seawall and having lower ends secured to the floor with the forward vertical support members extending upwardly from their lower ends along the height of the seawall, said step of securing includes securing opposite ends of the forward horizontal support bar to the respective forward vertical support members at a selected height along the forward vertical support members, said step of supporting the forward end of the rail includes securing the forward end of the rail to the forward horizontal support bar at a selected location between the forward vertical support members.

9. The method for maintenance of a seawall as recited in claim 8 wherein said step of supporting the rail for pivotal movement in a horizontal plane includes supporting the rail for pivotal movement about a vertical axis at its forward end perpendicular to a central longitudinal axis of the horizontal support bar, said step of supporting the rail for pivotal movement in a vertical plane includes supporting the rail for pivotal movement about the central longitudinal axis of the horizontal support bar.

10. The method for maintenance of a seawall as recited in claim 8 and further including the step of stabilizing the forward horizontal support bar between the forward vertical support members.

11. The method for maintenance of a seawall as recited in claim 1 wherein said step of supporting the rearward end of the rail includes securing the rearward end of the rail to a rearward rail support fixated to the floor.

12. The method for maintenance of a seawall as recited in claim 11 wherein the rearward rail support comprises a rearward vertical support bar having a penetrating formation at its lower end and further including the step of securing the rearward vertical support bar to the floor by penetrating the floor with the penetrating formation at the lower end of the rearward vertical support bar so that the rearward. vertical support bar extends upwardly from its lower end along the height of the seawall, and said step of securing the rearward end of the rail to the rearward rail support includes clamping the rearward end of the rail to the rearward vertical support bar at a selected height along the rearward vertical support bar.

13. The method for maintenance of a seawall as recited in claim 12 and further including, subsequent to said step of clamping the rearward end of the rail to the rearward vertical support bar, the step of selectively adjusting the height of the rearward end of the rail above the floor.

14. The method for maintenance of a seawall as recited in claim 11 wherein the rearward rail support comprises a rearward horizontal support bar and further including, prior to said step of securing the rearward end of the rail to the rearward rail support, the steps of securing the lower ends of a pair of rearward vertical support bars to the floor at spaced locations so that the rearward vertical support bars extend upwardly from their lower ends along the height of the seawall and clamping opposite ends of the rearward horizontal support bar to the respective rearward vertical support bars at a selected height along the rearward vertical support bars, and said step of securing the rearward end of the rail to the rearward rail support includes clamping the rearward end of the rail to the rearward horizontal support bar at a selected location between the rearward vertical support bars.

15. The method for maintenance of a seawall as recited in claim 11 wherein said step of supporting the rearward end of the rail includes supporting the rearward end of the rail on a vessel floating on the body of water and fixated to the floor.

16. The method for maintenance of a seawall as recited in claim 1 wherein said step of rotating the drive shaft to rotate the drill bit includes, as the drill bit is rotated, pushing the installation machine along the rail toward the water facing side of the seawall using a pushing device to control the pushing force on the installation machine to avoid binding of the drill bit in the seawall.

17. The method for maintenance of a seawall as recited in claim 1 wherein said step of rotating the drive shaft to rotate the anchoring member includes, as the drive shaft is rotated, pushing the installation machine along the rail toward the water facing side of the seawall using a pushing device to control the pushing force on the installation machine so that the anchoring member is rotatably advanced with appropriate pressure to avoid an augur effect.

* * * * *